US011199066B2

(12) United States Patent
DeBerry et al.

(10) Patent No.: US 11,199,066 B2
(45) **Date of Patent: *Dec. 14, 2021**

(54) SUBSEA EQUIPMENT ALIGNMENT DEVICE

(71) Applicant: Dril-Quip, Inc., Houston, TX (US)

(72) Inventors: Blake T. DeBerry, Houston, TX (US); Morris B. Wade, Houston, TX (US); Flavio Santos, Houston, TX (US); Andrew Mitchell, Houston, TX (US); Gregory Norwood, Boerne, TX (US); Robert Buxton, Cypress, TX (US); David Scantlebury, Houston, TX (US); Matthew Crotwell, Houston, TX (US); Justin Rye, Houston, TX (US); Todd L. Scaggs, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/112,951

(22) Filed: Dec. 4, 2020

(65) Prior Publication Data

US 2021/0087899 A1 Mar. 25, 2021

Related U.S. Application Data

(63) Continuation-in-part of application No. 17/067,590, filed on Oct. 9, 2020, now Pat. No. 10,947,805, and (Continued)

(51) Int. Cl.
*E21B 33/04* (2006.01)
*E21B 33/043* (2006.01)

(52) U.S. Cl.
CPC ..... *E21B 33/04* (2013.01); *E21B 33/043* (2013.01); *E21B 33/0407* (2013.01)

(58) Field of Classification Search
CPC ... E21B 33/04; E21B 33/0407; E21B 33/0415
See application file for complete search history.

(56) References Cited

U.S. PATENT DOCUMENTS 4,067,385 A 1/1978 Schwager et al.
4,770,248 A 9/1988 Houlgrave et al.
(Continued)

FOREIGN PATENT DOCUMENTS

GB 2397312 A 7/2004

OTHER PUBLICATIONS

Dril-Quip, Inc. VXTe presentation given to Walter Oil & Gas on Apr. 11, 2019, 9 pages.
(Continued)

*Primary Examiner* — Giovanna Wright
(74) *Attorney, Agent, or Firm* — Baker Botts L.L.P.

(57) ABSTRACT

Systems and methods for coupling subsea tubular members together are provided. An apparatus may be used to properly orient and/or provide communication between a first subsea tubular member that is being landed on a second subsea tubular member. An apparatus for coupling subsea tubular members may include an alignment sub and a corresponding alignment member. The alignment sub includes: a generally cylindrical body having one or more fluid, electric, or fiber optic lines extending therethrough, one or more couplings coupled to at least one end of the alignment sub, and an orientation profile disposed on a surface of the alignment sub. The alignment member has a profile designed to interface with the orientation profile of the alignment sub. One of the alignment sub and the alignment member remains stationary while the other rotates relative to the stationary structure.

30 Claims, 22 Drawing Sheets

Related U.S. Application Data a continuation-in-part of application No. 16/869,452, filed on May 7, 2020, and a continuation of application No. 16/111,987, filed on Aug. 24, 2018, now Pat. No. 10,830,015, and a continuation-in-part of application No. 16/119,847, filed on Aug. 24, 2018, now Pat. No. 10,830,015.

(60) Provisional application No. 62/574,491, filed on Oct. 19, 2017.

(56) References Cited

U.S. PATENT DOCUMENTS

| | | | | |
|---|---|---|---|---|
| 5,503,230 | A | 4/1996 | Osborne et al. | |
| 10,830,015 | B2 * | 11/2020 | DeBerry | E21B 33/043 |
| 2009/0211761 | A1 | 8/2009 | Broussard | |
| 2010/0078176 | A1 | 4/2010 | Christie | |
| 2010/0101800 | A1 | 4/2010 | June et al. | |
| 2013/0126181 | A1 | 5/2013 | Bell | |
| 2020/0399973 | A1 * | 12/2020 | Mitchell | E21B 33/0407 |

OTHER PUBLICATIONS

Sales Order (H20)3018325 from Dril-Quip, Inc. to Walter Oil & Gas, Order Date Jun. 4, 2019, 3 pages.
Sales Order (H12)3017492 Rev. 4 from Dril-Quip, Inc. to Walter Oil & Gas, Revision Date Jun. 26, 2019, 5 pages.
View 1, Photograph of VXTe prototype, Dril-Quip, Inc., Jul. 2019, 1 page.
View 2, Photograph of VXTe prototype, Dril-Quip, Inc., Jul. 2019, 1 page.
View 3, Photograph of VXTe prototype, Dril-Quip, Inc., Jul. 2019, 1 page.
View 4, Photograph of VXTe prototype, Dril-Quip, Inc., Jul. 2019, 1 page.
OTC Publication: "VXTe Deepwater Tree Development—Cost and Risk Reduction Through New and Advanced Technology," May 4, 2020, 8 pages.
Draft VXTe Tubing Hanger Drawing, Dril-Quip, Inc., Mar. 16, 2020, 1 page.
Draft VXTe ITW Stack-Up Drawing, Dril-Quip, Inc., Jun. 9, 2020, 1 page.

* cited by examiner

SUBSEA EQUIPMENT ALIGNMENT DEVICE

CROSS REFERENCE TO RELATED PATENT APPLICATION

The present application is a continuation in part claiming the benefit of U.S. patent application Ser. No. 16/869,452, entitled "Tubing Hanger Alignment Device," filed on May 7, 2020, which is a continuation in part claiming the benefit of U.S. patent application Ser. No. 16/111,987, entitled "Tubing Hanger Alignment Device," filed on Aug. 24, 2018, which claims priority to Provisional Patent Application Ser. No. 62/574,491, entitled "Tubing Hanger Alignment Device," filed on Oct. 19, 2017. The present application is also a continuation in part claiming the benefit of U.S. patent application Ser. No. 17/067,590, entitled "Tubing Hanger Alignment Device," filed on Oct. 9, 2020, which is a continuation of U.S. patent application Ser. No. 16/111,987, entitled "Tubing Hanger Alignment Device," filed on Aug. 24, 2018, which claims priority to Provisional Patent Application Ser. No. 62/574,491, entitled "Tubing Hanger Alignment Device," filed on Oct. 19, 2017.

TECHNICAL FIELD

The present disclosure relates generally to subsea equipment systems and, more particularly, to alignment devices used to properly align a first subsea tubular member to a second subsea tubular member.

BACKGROUND

Conventional subsea wellhead systems include a wellhead housing mounted on the upper end of a subsurface casing string extending into the well bore. During a drilling procedure, a drilling riser and BOP are installed above a wellhead housing (casing head) to provide pressure control as casing is installed, with each casing string having a casing hanger on its upper end for landing on a shoulder within the wellhead housing. A tubing string is then installed through the well bore. A tubing hanger connectable to the upper end of the tubing string is supported within the wellhead housing above the casing hanger for suspending the tubing string within the casing string. Upon completion of this process, the BOP is replaced by a Christmas tree installed above the wellhead housing, with the tree having a valve to enable the oil or gas to be produced and directed into flow lines for transportation to a desired facility.

The tubing hanger contains numerous bores and couplings, which require precise alignment with corresponding portions of the tree. Conventionally, there are two ways to achieve orientation of a tree relative to a tubing hanger. The first uses a tubing spool assembly, which latches to the wellhead and provides landing and orientation features. The tubing spool is very expensive, however, and adds height to the overall stack-up. Additionally, the tubing spool is so heavy that few work class vessels can install it, and it frequently requires installation by expensive drilling vessels. Furthermore, the drilling riser must be removed to install the tubing spool.

The second method of orienting a tree relative to a tubing hanger involves the use of a blowout preventer ("BOP") stack hydraulic pin and orientation adapter joint. This method requires detailed knowledge of the particular BOP stack in order to accurately install a hydraulically actuated pin, which protrudes into the BOP stack bore. An orientation helix is attached above the tubing hanger running tool, and, as the tubing hanger lands, the helix engages the hydraulic pin and orientates the tubing bores to a defined direction. This method requires accurate drawings of the BOP stack elevations and spacing between the main bore and the outlet flanges, which may require hours of surveying and multiple trips to make measurements. Room for error exists with this method, particularly in older rigs. Thus, this method requires significant upfront planning. Additionally, setting the lock-down sleeve in the wellhead generally requires a rig because the BOP must remain in place as a reference point for orientation of the tubing hanger and corresponding lock-down sleeve.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
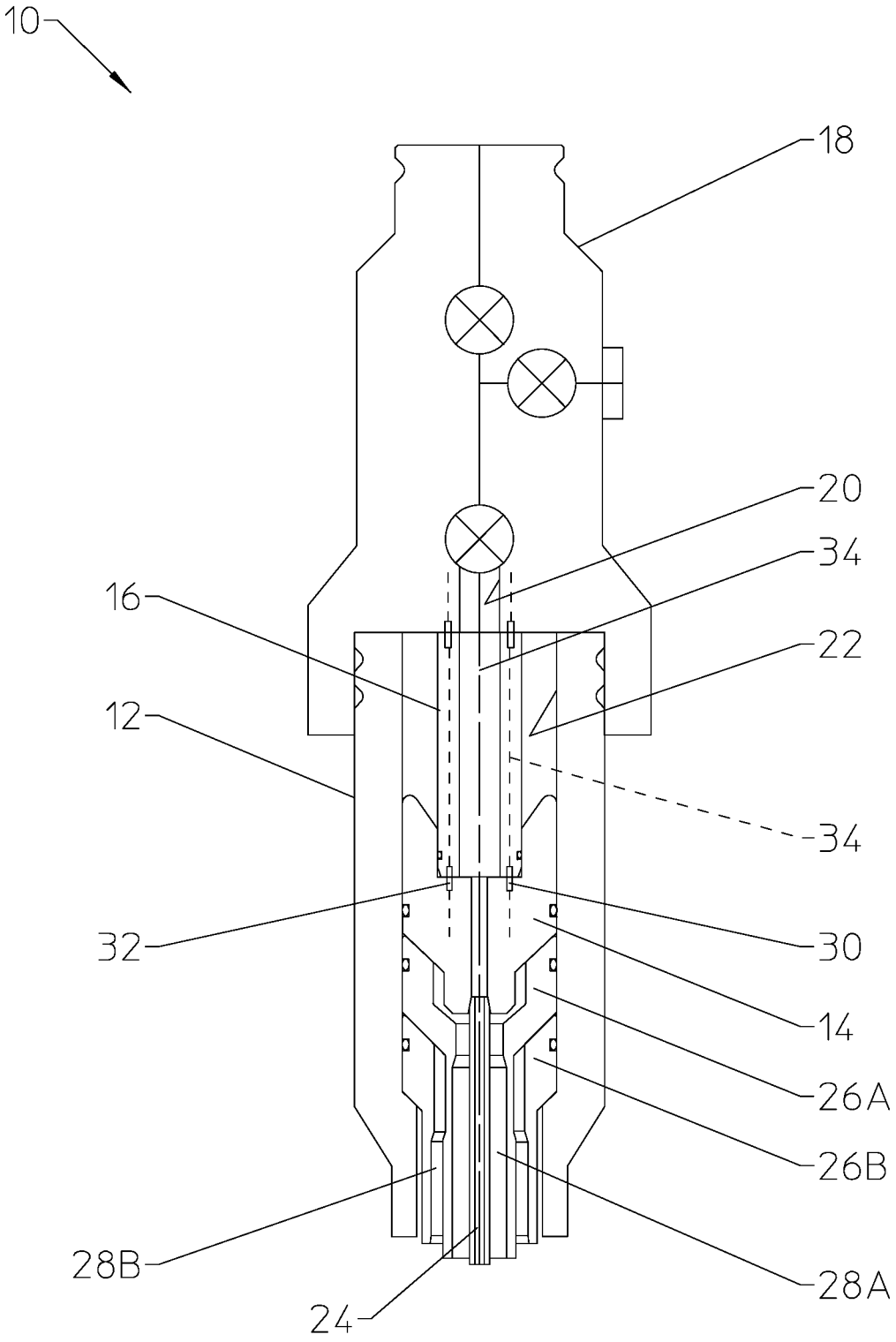
FIG. 1 is a schematic cutaway view of components of a production system having a tubing hanger alignment device, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to an alignment apparatus for coupling subsea tubular members together. The apparatus may be used to properly orient and/or provide communication between a first subsea tubular member that is being landed on a second subsea tubular member. For example, the first subsea tubular member may include a tubular housing (e.g., a tree, spool, or flowline connection body) that is being landed on a wellhead relative to a tubing hanger that is set in the wellhead. The alignment apparatus disclosed herein may be used to align any desired combinations of subsea tubular members including, but not limited to, a horizontal tree, a vertical tree, a tubing head spool, a flowline connection body, a tubing hanger, a blowout preventer (BOP), a casing hanger, a running tool (e.g., tubing hanger running tool, casing hanger running tool, BOP running tool, tree running tool, etc.), a retrieving tool, a test tool, a subsea wellhead, a riser, a connector, a tubing string, a control pod, and other subsea equipment. While coupling the subsea tubular members to each other, the alignment apparatus may facilitate coupling of one or more fluid (e.g., hydraulic), electric, or fiber optic lines of the first subsea tubular member with one or more fluid, electric, or fiber optic lines of the second subsea tubular member regardless of a relative orientation of the first subsea tubular member to the second subsea tubular member.

In the following discussion, the term "tree" will be used to refer to any type of component that is landed on a wellhead, has one or more flowlines extending therethrough, and has one or more communication flow paths (e.g., electric, fiber optic, or fluidic) for communicating with communication flow paths in the associated tubing hanger. The term "tree" will be used throughout this application to refer to a tubular housing, which may include any one of a tree body, a spool, or a flowline connection body. The term "tree" refers to a subsea tree and may be one of several different types of subsea tubular members that may be coupled with another subsea tubular member via the disclosed alignment apparatus.

The alignment apparatus may be used properly couple or orient certain features of a first subsea tubular member with corresponding features on a second subsea tubular member. As an example, in subsea wellhead systems, a tree (e.g., a tree body, spool, or flowline connection body) that is positioned on the wellhead must be properly oriented with respect to the tubing hanger that is set in the wellhead. This is because there are a number of couplings or stabs that have to be made up between the tubing string and the tree so as to allow electric, hydraulic, and/or fiber optic signals or power to be communicated from the tree to the tubing hanger and various downhole components. Existing methods for orienting a tree relative to a tubing hanger in the wellhead involve the use of either an expensive tubing spool or a BOP stack hydraulic pin and orientation adapter joint, which can be difficult to properly place on the wellhead and expensive to adjust if improperly placed.

The present disclosure is directed to systems and methods for functionally coupling a first subsea tubular member to a second subsea tubular member without regard to the orientation of the subsea tubular members with respect to each other. An apparatus for coupling subsea tubular members may include an alignment sub and a corresponding alignment member. The alignment sub includes: a generally cylindrical body having one or more fluid, electric, or fiber optic lines extending therethrough, one or more couplings coupled to at least one end of the alignment sub, and an orientation profile disposed on a surface of the alignment sub. The alignment member has a profile designed to interface with the orientation profile of the alignment sub. One of the alignment sub and the alignment member remains stationary while the other rotates relative to the stationary structure. The present disclosure describes other types of alignment apparatuses as well.

The alignment apparatus may include any subsea tubular alignment device used for landing and communicatively coupling one subsea tubular member with respect to another subsea tubular member regardless of the orientation of the one subsea tubular member.

As an example, the subsea tubular alignment device may be used for landing a tubing hanger in a wellhead without regard to its orientation and landing a tree at any orientation desired by the operator. The tree can land at any orientation and the systems and methods according to the present invention can be used to orientate the various couplings (e.g., the electric, fluidic, and/or fiber optic couplings) relative to the tubing hanger while landing the tree on the wellhead. This is accomplished without the use of either a separate tubing spool or a BOP stack with an orientation pin. This can save the operator a large amount of money (on the order of millions of dollars) since no additional tubing spool is necessary to perform the orientation. In addition, the disclosed systems and methods will save the operator money because they avoid the possibility of costly remediation associated with an improperly positioned BOP. The alignment device is able to align the tree to the tubing hanger independent of the original tree orientation at the beginning of the landing process. Essentially, the disclosed alignment devices enable the tree to function as a "self-aligning tree" or "self-orienting tree." The tree can be landed in any orientation desired by the operator. The present invention thus provides a self-alignment and orientation of couplings or stabs that have to be made up between the tubing string and the tree so as to allow electric, fluidic (e.g., hydraulic), and/or fiber optic signals to be communicated from the tree to the tubing hanger and various downhole components. The self-aligning subsea tubular alignment device may reduce the number of trips into a subsea well between drilling and completion of the subsea well. For example, the self-aligning subsea tubular alignment device may eliminate three to six additional trips that might otherwise be needed between drilling and completion of a subsea well using existing tree landing systems. Using the self-orienting subsea tubular alignment device, a system (e.g., tubular housing and alignment device) may be landed in a subsea component (e.g., wellhead), picked up, rotated, and re-stabbed/set back down into the wellhead multiple times, thus enabling easy connection and reconnection of subsea components at different times throughout the life of a subsea well.

Turning now to the drawings, FIG. 1 illustrates certain components of a subsea system 10 in which the disclosed alignment devices may be utilized. The system 10 may include two subsea tubular members 14 and 18 that are coupled via an alignment device 16, in accordance with the present disclosure. As those of ordinary skill in the art will appreciate, the alignment device 16 may be coupled to the first subsea tubular member 14 or the second subsea tubular member 18 prior to landing (not shown) or alternatively landed independent of both subsea tubular members (not shown). As shown, the alignment device 16 may connect the second subsea tubular member 18 to the first subsea tubular member 14.

In the illustrated embodiment, the first subsea tubular member 14 may be a tubing hanger, and the second subsea tubular member 18 may be a tree (which may include a horizontal or vertical tree body, a spool, or a flowline connection body). However, as mentioned above, it should be understood that the disclosed alignment device 16 may be used to couple other types of subsea tubular members including, but not limited to, a blowout preventer (BOP), a casing hanger, a running tool, a retrieving tool, a test tool, a subsea wellhead, a riser, a connector, a tubing string, a control pod, and other subsea equipment.

The system 10 depicted in FIG. 1 may also include a wellhead 12. The second subsea tubular member (e.g., tree) 18 may include various valves for fluidly coupling a vertical bore 20 formed through the second subsea tubular member (e.g., tree) 18 to one or more downstream production flow paths, such a well jumper, for example. The second subsea tubular member (e.g., tree) 18 may be connected to and sealed against the wellhead 12. The first subsea tubular member (e.g., tubing hanger) 14 may be fluidly coupled to the bore 20 of the second subsea tubular member (e.g., tree) 18.

As shown, the alignment device 16 may connect the second subsea tubular member (e.g., tree) 18 to the first subsea tubular member (e.g., tubing hanger) 14. In other embodiments, a tubing hanger alignment device may include a plug that is removably placed within the tubing hanger at one or more times throughout a completion process, as described below. In such cases, the tubing hanger may be connected to and sealed against the tree via an isolation sleeve that is integral with the tree.

The tubing hanger (14) may be landed in and sealed against a bore 22 of the wellhead 12, as shown. The tubing hanger (14) may suspend a tubing string 24 into and through the wellhead 12. Likewise, one or more casing hangers (e.g., inner casing hanger 26A and outer casing hanger 26B) may be held within and sealed against the bore 22 of the wellhead 12 and used to suspend corresponding casing strings (e.g., inner casing string 28A and outer casing string 28B) through the wellhead 12.

In the illustrated embodiment, the alignment device 16 may include one or more communication lines (e.g., fluid lines, electrical lines, and/or fiber optic cables) 30 disposed therethrough and used to communicatively couple the second subsea tubular member (e.g., tree) 18 to the first subsea tubular member (e.g., tubing hanger) 14. The first subsea tubular member (e.g., tubing hanger) 14 may include couplings or stabs 32 located at an end (e.g., the top) of the first subsea tubular member (e.g., tubing hanger) 14 in a specific orientation with respect to a longitudinal axis 34. The alignment device 16 is configured to facilitate a mating connection that communicatively couples the second subsea tubular member (e.g., tree) 18 to the couplings/stabs 32 on the first subsea tubular member (e.g., tubing hanger) 14 as the second subsea tubular member (e.g., tree) 18 is landed onto the wellhead 12, regardless of the orientation in which the second subsea tubular member (e.g., tree) 18 is initially positioned during the landing process.

Different arrangements of an alignment device 16 will now be disclosed in the following sections of this description. The alignment device may utilize one or more of a rotatable profile alignment mechanism, a coiled conduit alignment mechanism, a multi-start alignment thread mechanism, a helical slot alignment mechanism, a torsional spring alignment mechanism, or a plug-based alignment mechanism.

Rotatable Profile Alignment Mechanism

An alignment device 16 having a rotatable profile alignment mechanism will be described with reference to FIGS. 2A-6. It should be noted that the general rotatable profile alignment mechanism described with reference to FIGS. 2A-6 is also specifically applied in the embodiments illustrated in FIGS. 7-8C (coiled conduit), FIGS. 9-14 (multi-start alignment threads), FIGS. 15-16 (helical slot), and FIGS. 17-18 (torsional spring).

Figure 2A:
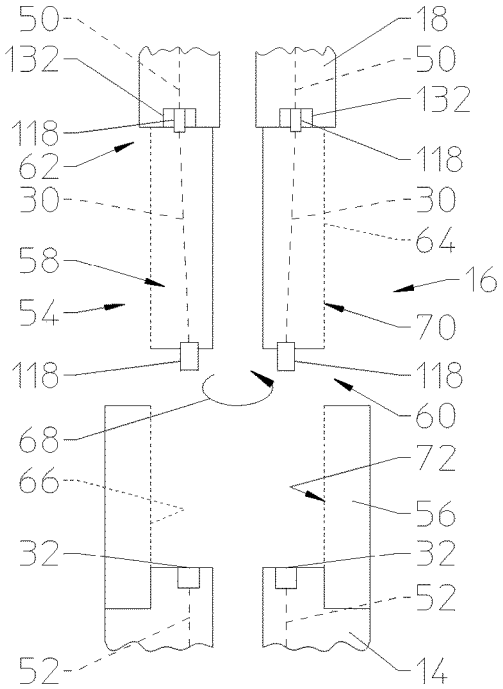
FIGS. 2A and 2B are schematic cross-sectional views of subsea tubular member alignment devices, in accordance with embodiments of the present disclosure.
Figure 2B:
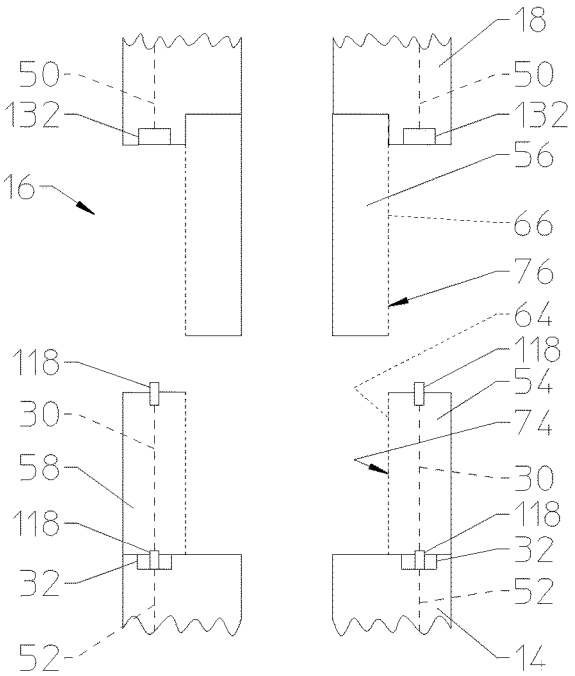

FIGS. 2A and 2B are schematic illustrations of embodiments of an alignment device 16 in accordance with aspects of the present disclosure. The alignment device 16 may be an apparatus for coupling subsea tubular members 14 and 18. The first subsea tubular member 14 may include a tubing hanger in certain embodiments. The second subsea tubular member 18 may include a tree (e.g., a tree body, a spool, or a flowline connection body) in certain embodiments. The alignment device 16 may be configured to couple one or more fluid, electric, or fiber optic lines 50 of the second subsea tubular member 18 with one or more fluid, electric, or fiber optic lines 52 of the first subsea tubular member 14 regardless of a relative orientation of the first subsea tubular member 14 and the second subsea tubular member 18 with respect to each other. In some embodiments, the alignment device 16 may be configured to couple one or more fluid, electric, or fiber optic lines 50 of the second subsea tubular member 18 with one or more fluid, electric, or fiber optic lines 52 of a first subsea tubular member 14 landed in a wellhead (e.g., 12 of FIG. 1) during landing of the second subsea tubular member 18 onto the wellhead regardless of a relative orientation of the first subsea tubular member 14 and the second subsea tubular member 18 with respect to the wellhead. This may be particularly applicable, for example, where the alignment device 16 is a tubing hanger alignment device, the first subsea tubular member 14 is a tubing hanger landed in the wellhead, and the second subsea tubular member 18 is a tree being landed on the wellhead.

The alignment device 16 of FIGS. 2A and 2B may include an alignment sub 54 and a corresponding alignment member 56. Prior to using the alignment device 16 to couple the first and second subsea tubular members 14 and 18, the alignment sub 54 may be separated from the alignment member 56. In other embodiments, the alignment member 56 may be coupled to the alignment sub 54 throughout the operation.

Figure 7:
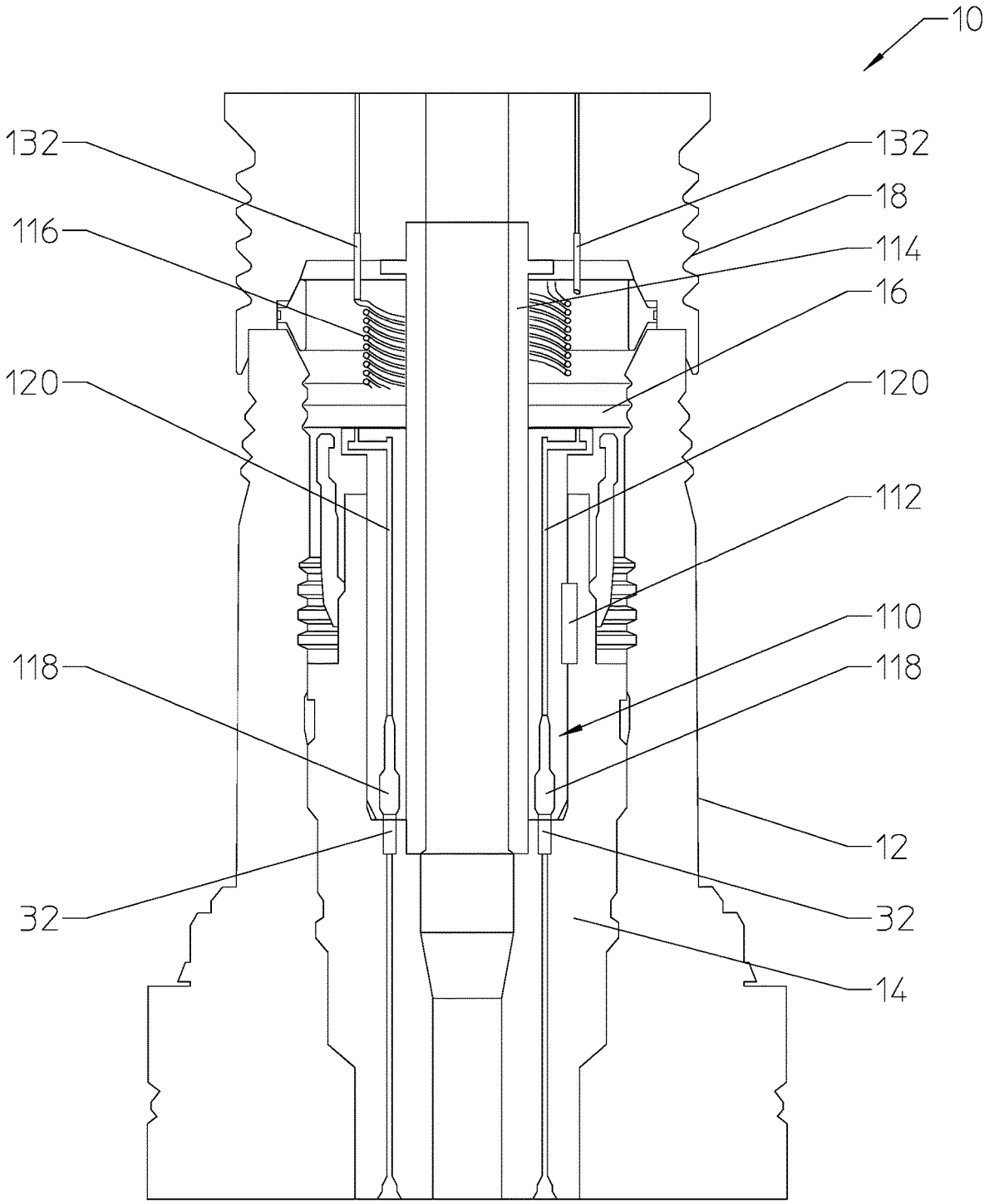
FIG. 7 is a cross-sectional view of a production system comprising a tubing hanger alignment device with a coiled conduit alignment mechanism, in accordance with an embodiment of the present disclosure.

The alignment sub 54 may include a generally cylindrical body 58 having one or more fluid, electric, or fiber optic lines 30 extending therethrough, and one or more couplings 118 coupled to at least one end of the alignment sub 54. For example, the alignment sub 54 may include couplings 118 at both a lower end 60 and an upper end 62 thereof, as shown. In other embodiments (e.g., as shown in FIG. 7), the alignment sub 54 (e.g., production stab sub 114) may have one or more couplings 118 coupled to only the lower end 60 of the alignment sub 54. In still other embodiments, the alignment sub 54 may have one or more couplings 118 coupled to only the upper end 62 of the alignment sub 54. The couplings 118 may be disposed on an upper surface of the alignment sub 54, a lower surface of the alignment sub 54, or a side surface of the alignment sub 54 at or proximate the desired end. The couplings 118 on the alignment sub 54 may be configured to be coupled to the couplings 32 on the first subsea tubular member 14, the couplings 132 on the second subsea tubular member 18, or both. As an example, upon lowering the second subsea tubular member 18 toward the first subsea tubular member 14, the couplings 118 on the lower end 60 of the alignment sub 54 may be brought into contact with the couplings 32 on the first tubular member 14. The alignment sub 54 also includes an orientation profile 64 disposed on a surface of the alignment sub 54. The orientation profile 64 is illustrated schematically in FIGS. 2A and 2B as a dashed line.

The alignment member 56 has a profile 66 designed to interface with the orientation profile 64 of the alignment sub 54. The profile 66 may be complementary to the orientation profile 64. The profile 66 is illustrated schematically in FIGS. 2A and 2B as a dashed line, similar to the orientation profile 64 of the alignment sub 54. As illustrated, the alignment member 56 may not include communication lines extending therethrough in some embodiments. These complementary profiles 64 and 66 may facilitate self-alignment of the alignment member 56 with respect to the alignment sub 54, or vice versa, and any attached subsea components that are being aligned.

The alignment sub 54 and corresponding alignment member 56 are designed such that one of the two components remains stationary while the other rotates relative to the stationary structure. For example, as shown by an arrow 68 in FIG. 2A, the alignment sub 54 may rotate with respect to the alignment member 56 to rotationally align the alignment sub 54 with the alignment member 56. In other embodiments, however, the structures may be reversed such that the alignment member 56 rotates with respect to the stationary alignment sub 54 to rotationally align the alignment member 56 with the alignment sub 54.

FIG. 2A illustrates an embodiment of the alignment device 16 in which the orientation profile 64 is disposed on an outside (i.e., radially outward facing) surface 70 of body 58 of the alignment sub 54. In this embodiment, the corresponding profile 66 is disposed on an inside (i.e., radially inward facing) surface 72 of the alignment member 56. FIG. 2B illustrates another embodiment of the alignment device 16 in which the orientation profile 64 is disposed on an inside (i.e., radially inward facing) surface 74 of the body 58 of the alignment sub 54. In this embodiment, the corresponding profile 66 is disposed on an outside (i.e., radially outward facing) surface 76 of the alignment member 56.

FIG. 2A illustrates the alignment device 16 as having the alignment sub 54 with the orientation profile 64 on the outside surface 70 disposed above and lowered down toward the alignment member 56 with the profile 66 on the inside surface 72. However, in other embodiments this direction may be reversed. That is, the alignment device 16 may include the alignment member 56 with the profile 66 on the inside surface 72 disposed above and lowered down toward the alignment sub 54 with the orientation profile 64 on the outside surface 70.

FIG. 2B illustrates the alignment device as having the alignment member 56 with the profile 66 on the outside surface 76 disposed above and lowered down toward the alignment sub 54 with the orientation profile 64 on the inside surface 74. However, in other embodiments this direction may be reversed. That is, the alignment device 16 may include the alignment sub 54 with the orientation profile 64 on the inside surface 74 disposed above and lowered down toward the alignment member 56 with the profile 66 on the outside surface 76. Other variations of the placements and orientations of these components may be used in other embodiments as well.

One or more components of the alignment device 16 may be coupled to the first subsea tubular member 14 or the second subsea tubular member 18 throughout operation of the alignment device 16. For example, the alignment sub 54 may be coupled to the second subsea tubular member 18 while the corresponding alignment member 56 may be coupled to the first subsea tubular member 14 throughout the alignment operation. In other embodiments, this arrangement may be reversed such that the alignment sub 54 is coupled to the first subsea tubular member 14 while the corresponding alignment member 56 is coupled to the second subsea tubular member 18. In some embodiments, the alignment sub 54 and the corresponding alignment member 56 may each comprise components that are mounted (directly or indirectly) to the subsea tubular members 14, 18.

In other embodiments, one or both of the alignment sub 54 and the corresponding alignment member 56 may comprise at least one component that is integral with one of the subsea tubular members 14, 18. For example, the alignment sub 54 may include a rotating sub rotatably coupled directly to a portion of one of the subsea tubular members (e.g., second subsea tubular member 18), and the alignment member 56 may remain stationary. In this instance, the subsea tubular member 18 may include a body and a generally cylindrical stab portion coupled to the body, wherein the rotating alignment sub 54 is disposed around and rotatably coupled to the stab portion of the subsea tubular member 18. The corresponding alignment member 56 may be an orientation sub that is mounted to or integral with the other subsea tubular member (e.g., 14).

As another example, the alignment member 56 may be integral with one of the subsea tubular members (e.g., first subsea tubular member 14), such that the profile 66 is formed on a surface of the subsea tubular member. The alignment member 56 may be stationary while the alignment sub 54 is a rotating sub having the orientation profile 64 that rotates relative to the alignment member 56. The alignment sub 54 may be rotatably coupled to a production stab sub mounted to the other subsea tubular member (e.g., 18), rotatably coupled to a generally cylindrical body integral with a body of the subsea tubular member 18, and/or rotatably coupled to a generally cylindrical body extending from a body of the subsea tubular member 18.

FIGS. 3A-3E illustrate various embodiments of the orientation profile 64 of the alignment sub 54 and the profile 66 of the corresponding alignment member 56. FIGS. 3A-3E show embodiments in which one of the profiles 64, 66 includes a helical profile 78 while the other profile includes a key 80. In FIGS. 3A-3E, the alignment devices 16 are each illustrated as having the alignment sub 54 located above the alignment member 56. However, any of the helical/key profile configurations illustrated in FIGS. 3A-3E may be similarly applied to embodiments of the alignment device 16 having the alignment member 56 located above the alignment sub 54. In FIGS. 3A-3E, the alignment devices 16 are each illustrated as having the orientation profile 64 disposed on the outside surface 70 of the alignment sub 54. However, any of the helical/key profile configurations illustrated in FIGS. 3A-3E may be similarly applied to embodiments of the alignment device 16 having the orientation profile 64 disposed on the inside surface 74 of the alignment sub 54, as shown in FIG. 2B. In the embodiments of FIGS. 3A-3E, the helical profile 78 generally includes a helical recess.

Figure 3A:
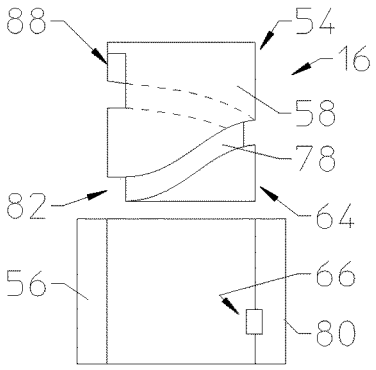
FIGS. 3A-3E are schematic partially cut-away views illustrating orientation profile configurations for the alignment device of FIG. 2A, in accordance with embodiments of the present disclosure.
Figure 3B:
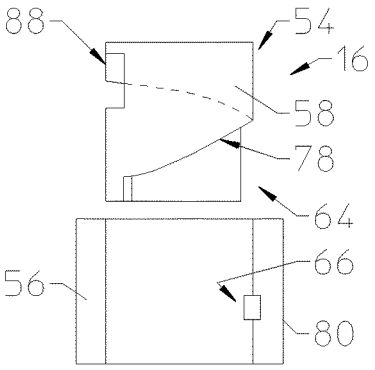
Figure 3C:
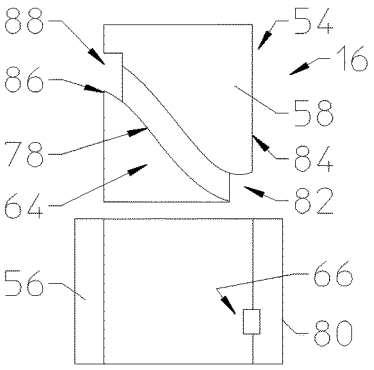

FIGS. 3A-3C illustrate embodiments of the alignment device 16 where the orientation profile 64 of the alignment sub 54 comprises a helical profile 78 and the profile 66 of the alignment member 56 comprises a key 80. The helical profile 78 is a profile that extends in at least one rotational direction about the alignment sub 54 as it extends in an axial direction along the alignment sub 54. As shown in FIGS. 3A and 3B, the helical profile 78 may extend one full rotation (in one direction) around the outer surface of the cylindrical body 58 as it extends in the axial direction of the alignment sub 54. In other embodiments, the helical profile 78 may extend multiple rotations around the outer surface of the cylindrical body 58 as it extends in the axial direction. The profile 66 of the corresponding alignment member 56 may include a key 80 designed to be received into the helical profile 78 and to move along the helical profile 78 as one of the alignment sub 54 and the alignment member 56 rotates with respect to the other. Interaction of the key 80 with the helical profile 78 drives this rotation as the connected subsea tubular members (not shown) are brought together. As discussed in detail below, the key 80 may be a generally rectangular shaped member having at least one tapered surface at one end thereof. The key 80 may take other forms, such as a pin or an irregular shape, in other embodiments.

In some embodiments, the helical profile 78 may be a helical groove that is bounded on both the upper and lower sides thereof along the entire length of the groove or most of the length of the groove, as shown in FIGS. 3A and 3C. An opening of the helical groove 78 may intersect an axial end (e.g., bottom 82) of the alignment sub 54, as shown in FIG. 3A. That way, as the alignment sub 54 and alignment member 56 are brought together, one of the components rotates with respect to the other until the key 80 enters the opening at the end of the helical groove 78 and the key 80 rides along the groove to orient the components with respect to each other. In other embodiments, however, the key 80 may be spring-loaded such that no opening to the helical groove 78 is needed at an axial end of the alignment sub 54. The key 80 may be compressed to ride along the outside surface of the alignment sub 54 until it reaches the helical groove 78, at which point the key 80 may be biased inward and captured in the groove. In still other embodiments, the key 80 may be caught within the helical groove 78 during the entire operation of the alignment device 16. This is the case, for example, in the alignment device embodiment of FIGS. 9A-13B, in which the timing ring 614 (which functions as the alignment member 56) is caught within the alignment threads 620 (which function as helical grooves 78) of the alignment sub 612 (54). This is also the case in the alignment device 16 of FIGS. 14 and 15, in which the alignment pin(s) 230 (which function as the key 80) of the timing ring 212 (alignment member 56) are caught within the helical slot(s) 222 (helical groove(s) 78) of the alignment body 210 (alignment sub 54).

In some embodiments, the alignment device 16 may include multiple helical grooves 78 (also referred to as "multi-start alignment threads") in the alignment sub 54. These multiple helical grooves 78 may be separated from each other about the circumference of the alignment sub 54 along their entire lengths. In such embodiments, the corresponding alignment member 56 may include multiple keys 80 to be received in the corresponding helical grooves 78. An example of an alignment sub 54 having multiple helical grooves 78 formed therein is provided in the embodiment of FIGS. 9A-13B described below, in which the alignment sub 612 functions as the alignment sub 54, the timing ring 614 functions as the alignment member 56, and the alignment threads 620 function as the multiple grooves 80.

Figure 8:
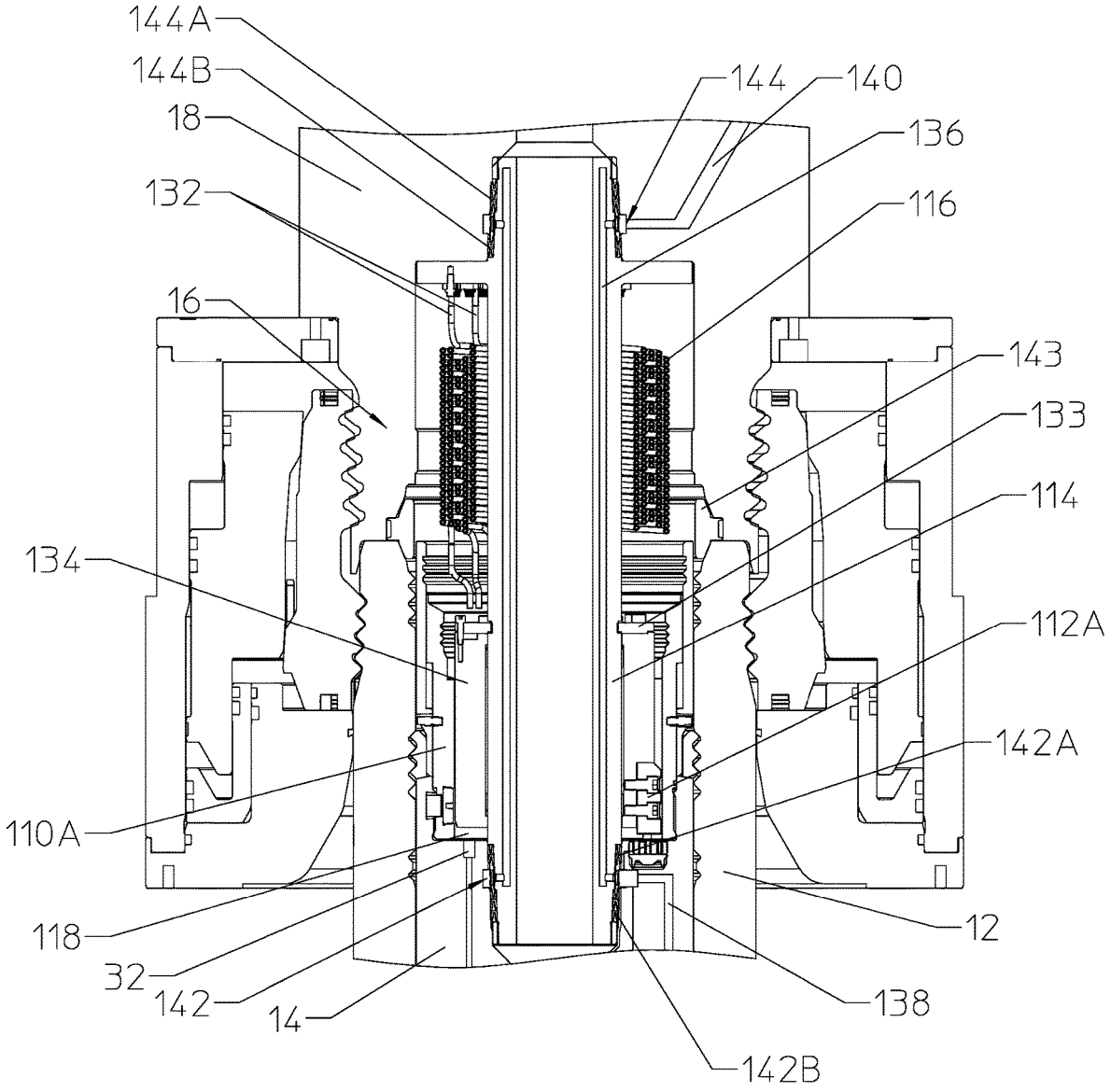
FIG. 8 is a cross-sectional view of a production system comprising a tubing hanger alignment device with a coiled conduit alignment mechanism, in accordance with an embodiment of the present disclosure.
Figure 8A:
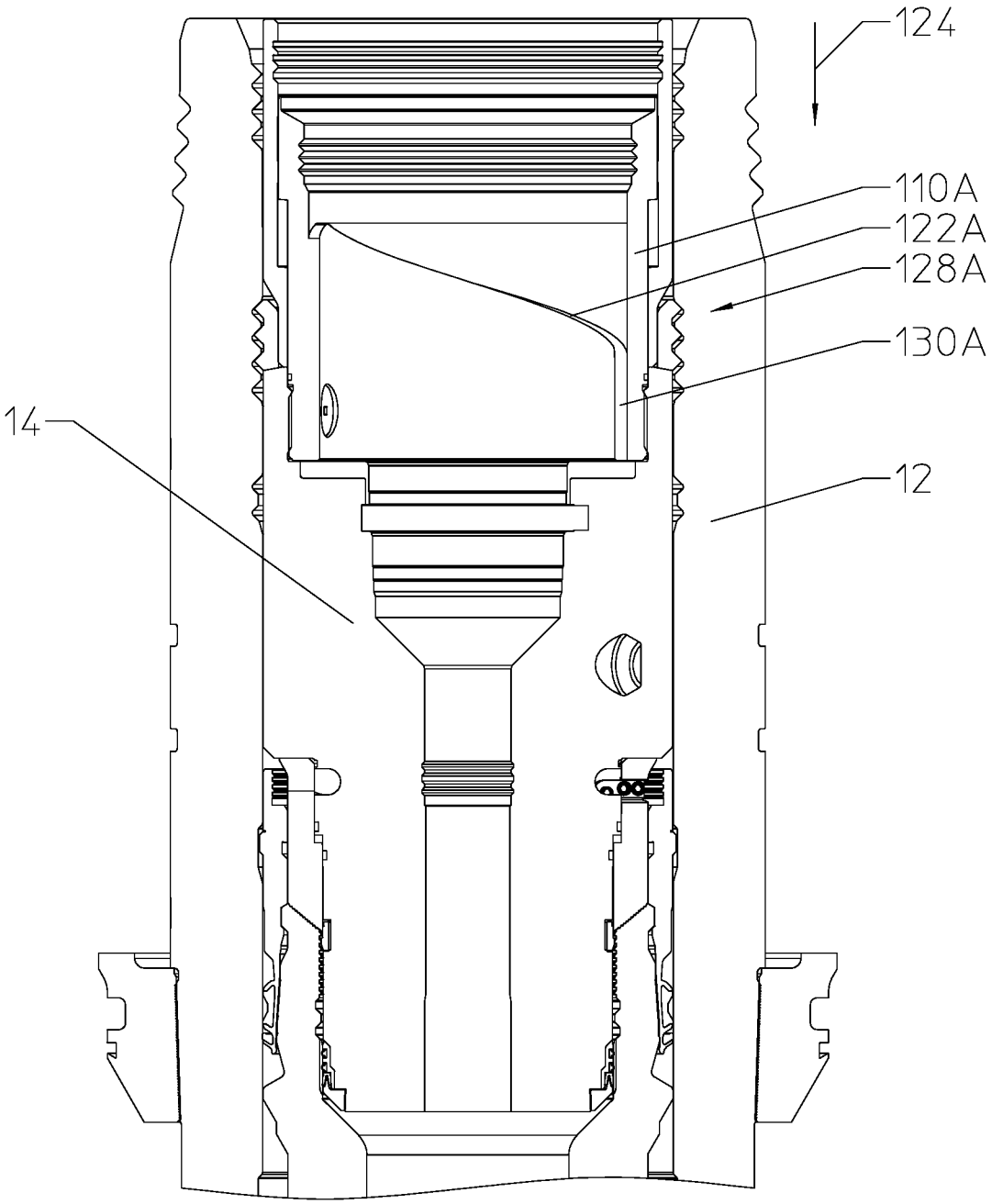
FIG. 8A is a cross-sectional view of a tubing hanger equipped with a mule shoe sub used in the production system of FIG. 8, in accordance with an embodiment of the present disclosure.
Figure 8B:
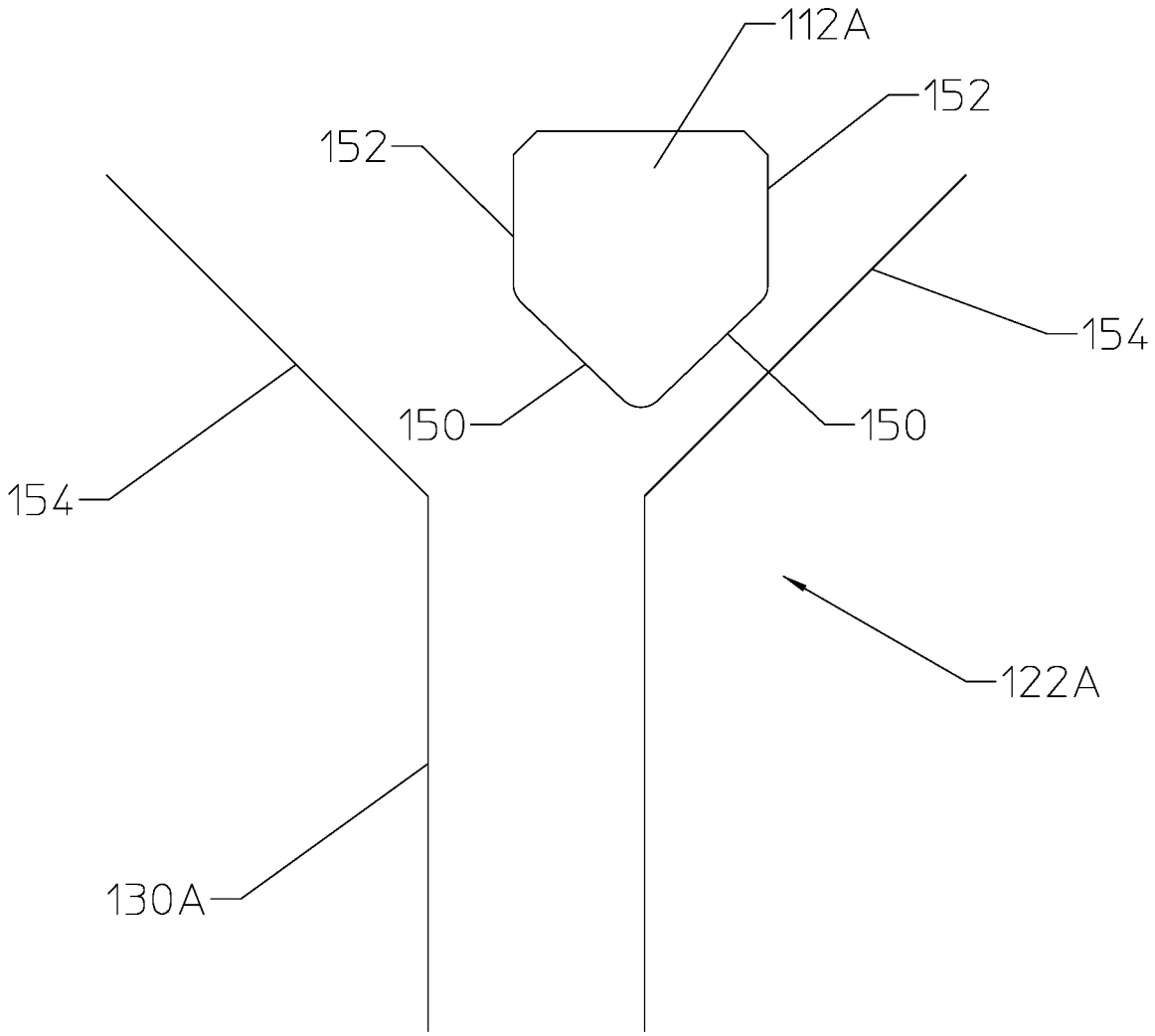
FIG. 8B is a schematic illustration of a mule shoe profile and alignment key interfacing with each other, in accordance with an embodiment of the present disclosure.
Figure 8C:
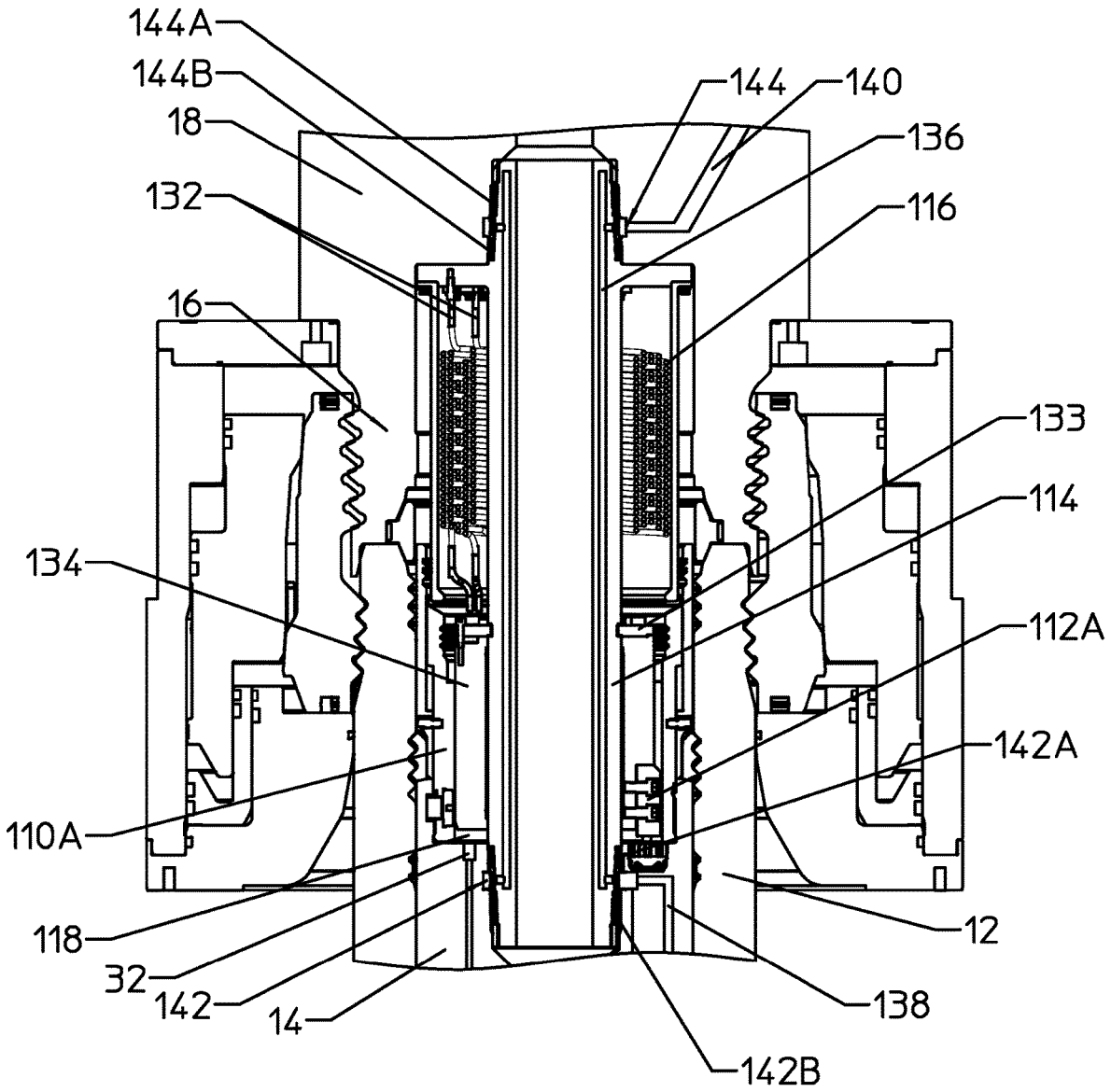
FIG. 8C is a cross-sectional view of the production system of FIG. 8 with an additional shroud covering the coiled conduits, in accordance with an embodiment of the present disclosure.

In other embodiments, the helical profile 78 may be a helical recess bounded only on one side (e.g., upper side in the illustrated configuration). An example of this is shown in FIG. 3B. In this embodiment, the helical profile 78 can interact directly with a stationary key 80 (not spring-loaded)

without requiring any rotation of the alignment sub 54/alignment member 56 with respect to each other until the key 80 contacts the helical profile 78. In such embodiments, the helical profile 78 may be limited to one full rotation about the axis of the alignment sub 54. Additional examples of an alignment sub 54 with a helical profile 78 bounded on only one side are shown in the embodiment of FIGS. 7-8C, in which the mule shoe profile 122 (122A) functions as the helical profile 78 and the alignment key 112 (112A) functions as the key 80.

In some embodiments, the helical profile 78 may extend axially along the length of the alignment sub 54 as it rotates in one direction about the axis of the alignment sub 54, as shown in FIGS. 3A and 3B. In other embodiments, the helical profile 78 may extend axially along the length of the alignment sub 54 in the same direction as it rotates in opposite directions (from one side 84 to an opposite side 86) about the axis of the alignment sub 54, as shown in FIG. 3C. This limits the relative amount of rotation needed between the alignment sub 54 and the alignment member 56 to reach the aligned position. Although FIG. 3C shows the helical profile 78 as a groove bounded on both sides (as described above), it should be noted that the shape of the helical profile 78 of FIG. 3C may be bounded on just one side in other embodiments. In embodiments where this helical profile 78 is bounded only on one side, this profile may also be referred to as a "mule shoe profile," as in the alignment devices 16 of FIGS. 7-7A which show the mule shoe profile 122 functioning as a helical profile 78 bounded on just one side.

As illustrated, the helical profiles 78 of FIGS. 3A-3C may include at least one vertically oriented portion 88 at an axial end of the helical profile 78. The vertically oriented portion 88 functions as a final location of the key 80 upon full connection and alignment of the associated first and second subsea tubular members being coupled via the alignment device 16. The vertically oriented portion 88 may be a vertically oriented slot or groove that functions to enable a final landing/connection of the associated subsea tubular members during connection via the alignment device 16. Once the key 80 reaches the vertically oriented portion 88 at the end of the helical profile 78, rotation between the alignment sub 54 and the alignment member 56 stops and these components move in a vertical direction with respect to each other for final alignment and coupling. Examples of vertically oriented portion(s) 88 are provided in the embodiments of FIGS. 7-8C (in which the alignment slot 130, 130A is the vertically oriented portion 88), the embodiment of FIGS. 9A-13B (in which the vertical alignment slots 624 are the vertically oriented portions 88), and the embodiment of FIGS. 14 and 15 (in which the straight portion 224 is the vertically oriented portion 88).

Figure 3D:
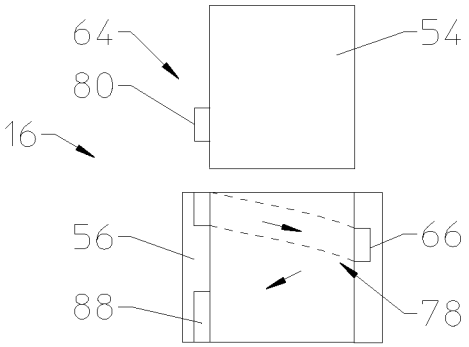
Figure 3E:
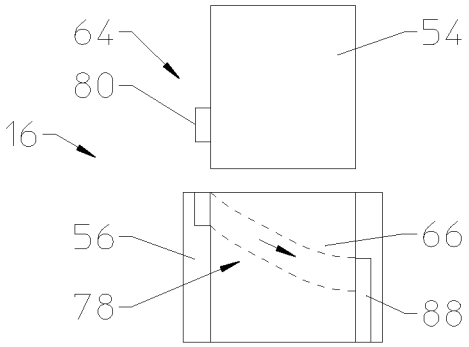

FIGS. 3D and 3E illustrate embodiments of the alignment device 16 where the orientation profile 64 comprises a key 80 and the profile 66 of the corresponding alignment member 56 comprises a helical profile 78. The helical profile 78 is a profile that extends in at least one rotational direction about an inside surface of the alignment member 56 as it extends in an axial direction along the alignment member 56. As shown in FIG. 3D, the helical profile 78 may extend one full rotation (in one direction) around the inside surface as it extends in the axial direction of the alignment member 56. In other embodiments, the helical profile 78 may extend multiple rotations around the inside surface of the alignment member 56 as it extends in the axial direction. The orientation profile 64 of the alignment sub 54 may include a key 80 designed to be received into the helical profile 78 and to move along the helical groove 78 as one of the alignment sub 54 and the alignment member 56 rotates with respect to the other. Interaction of the key 80 with the helical profile 78 drives this rotation as the connected subsea tubular members (not shown) are brought together. As discussed in detail below, the key 80 may be a generally rectangular shaped member having at least one tapered surface at one end thereof. The key 80 may take other forms, such as a pin or an irregular shape, in other embodiments.

As discussed at length above with reference to FIGS. 3A-3C, the helical profile 78 may take several different forms, shapes, and configurations. For example, the helical profile 78 may be a helical groove bounded on both the sides thereof along the entire length of the groove or most of the length of the groove, as shown in FIGS. 3D and 3E. An opening of the helical groove 78 may intersect an axial end (e.g., top) of the alignment member 56. In other embodiments, the key 80 may be spring-loaded such that no opening to the helical groove 78 is needed at an axial end of the alignment member 56. In still other embodiments, the key 80 may be caught within the helical groove 78 during the entire operation of the alignment device 16. In some embodiments, the alignment device 16 may include multiple helical grooves 78 (also referred to as "multi-start alignment threads") in the alignment member 56. These multiple helical grooves 78 may be separated from each other about the circumference of the alignment member 56 along their entire lengths. In such embodiments, the corresponding alignment sub 54 may include multiple keys 80 to be received in the corresponding helical grooves 78.

In other embodiments, the helical profile 78 may be bounded only on one side (e.g., lower side in the illustrated configuration). In this embodiment, the helical profile 78 can interact directly with a stationary key 80 (not spring-loaded) without requiring any rotation of the alignment sub 54/alignment member 56 with respect to each other until the key 80 contacts the helical profile 78. In such embodiments, the helical profile 78 may be limited to one full rotation about the axis of the alignment member 56.

In some embodiments, the helical profile 78 may extend axially along the length of the alignment member 56 as it rotates in one direction about the axis of the alignment member 56, as shown in FIG. 3D. In other embodiments, the helical profile 78 may extend axially along the length of the alignment member 56 in the same direction as it rotates in opposite directions (from one side 84 to an opposite side 86) about the axis of the alignment sub 54, as shown in FIG. 3E. Although FIG. 3E shows the helical profile 78 as a groove bounded on both sides (as described above), it should be noted that the shape of the helical profile 78 of FIG. 3E may be bounded on just one side in other embodiments. In embodiments where this helical profile 78 is bounded only on one side, this profile may also be referred to as a "mule shoe profile," as in the alignment devices 16 of FIGS. 8-8C which show the mule shoe profile 122A functioning as a helical profile 78 bounded on just one side.

As illustrated, the helical profiles 78 of FIGS. 3D and 3E may include at least one vertically oriented portion 88 at an axial end of the helical profile 78. The vertically oriented portion 88 may be a vertically oriented slot or groove that functions to enable a final landing/connection of the associated subsea tubular members during connection via the alignment device 16. Once the key 80 reaches the vertically oriented portion 88 at the end of the helical profile 78, rotation between the alignment sub 54 and the alignment member 56 stops and these components move in an entirely vertical direction with respect to each other for final alignment and coupling.

Figure 4A:
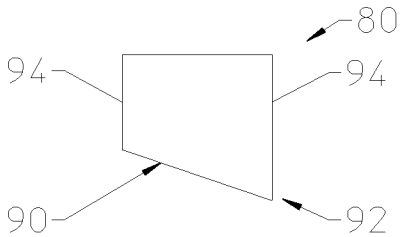
FIGS. 4A and 4B are side views of keys that may be used in the profiles of FIGS. 3A-3E, in accordance with embodiments of the present disclosure.
Figure 4B:
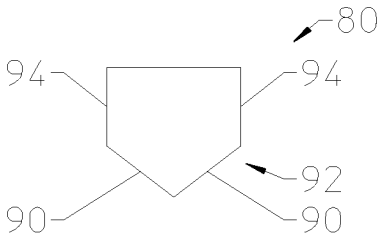

In the alignment devices 16 of FIGS. 3A-3E, the key 80 (either on the alignment sub 54 or the alignment member 56) may have a particular shape. FIGS. 4A and 4B illustrate two different forms that the key 80 may take, depending on the form of the corresponding helical profile 78. As shown, the key 80 may be a generally rectangular shaped member having at least one tapered surface 90 at one end 92 thereof. The end 92 on which the at least one tapered surface 90 is formed faces the helical profile 78 in a direction of the axis of the alignment device 16. For example, in the embodiments of FIGS. 3A-3C, the end 92 is facing upward toward the helical profile 78. In the embodiments of FIGS. 3D and 3E, the end 92 is facing downward toward the helical profile 78. The tapered surface 90 may be oriented such that it can directly interface with and slide along the corresponding helical profile 78, thereby causing rotation between the alignment sub 54 and alignment member 56 in response to axial movement of one of the components with respect to the other.

FIG. 4A shows the key 80 having a generally rectangular shape with a single tapered surface 90 at the end 92 of the key 80. This shape of the tapered surface 90 corresponds to a helical profile 78 that extends in a single rotational direction around the alignment sub 54 or alignment member 56, as shown in FIGS. 3A, 3B, and 3D. FIG. 4B shows the key 80 having a generally rectangular shape with two tapered surfaces 90 at the end 92 of the key 80. This shape of the tapered surface 90 corresponds to a helical profile 78 that extends in two opposing rotational direction around the alignment sub 54 or alignment member 56, as shown in FIGS. 3C and 3E. The two tapered surfaces 90 allow the key 80 to directly engage with and slide along the helical profile 78 regardless of which side of the helical profile 78 the key 80 first engages. An example of a key 80 having this shape and interacting with the corresponding helical groove 78 is provided in the embodiment of FIG. 8B (in which the alignment key 112A functions as the key 80 and the mule shoe profile 122A functions as the helical profile 78). In both FIGS. 4A and 4B, the key 80 has substantially parallel side surfaces 94, which are designed to guide the key 80 into its final alignment in cooperation with the vertically oriented portion 88 of the helical profile 78. In some embodiments, the vertically oriented portion 88 may have one or more tapered surfaces at an end thereof that substantially match the tapered surface(s) of the corresponding key 80.

FIGS. 5A-5D illustrate other embodiments of the orientation profile 64 of the alignment sub 54 and the profile 66 of the corresponding alignment member 56. FIGS. 5A-5D show embodiments in which the profiles 64, 66 are both helically shaped. In FIGS. 5A-5D, the alignment devices 16 are each illustrated as having the alignment sub 54 located above the alignment member 56. However, the helical/helical profile configurations illustrated in FIGS. 5A-5D may be similarly applied to embodiments of the alignment device 16 having the alignment member 56 located above the alignment sub 54. In FIGS. 5A-5D, the alignment devices 16 are each illustrated as having the orientation profile 64 disposed on the outside surface 70 of the alignment sub 54. However, any of the helical/helical profile configurations illustrated in FIGS. 5A-5D may be similarly applied to embodiments of the alignment device 16 having the orientation profile 64 disposed on the inside surface 72 of the alignment sub 54, as shown in FIG. 2B.

Figure 5A:
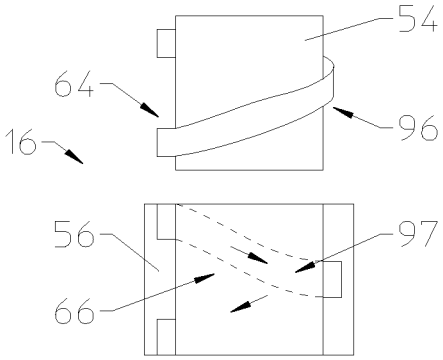
FIGS. 5A-5D are schematic partially cut-away views illustrating orientation profile configurations for the alignment device of FIG. 2A, in accordance with embodiments of the present disclosure.
Figure 5B:
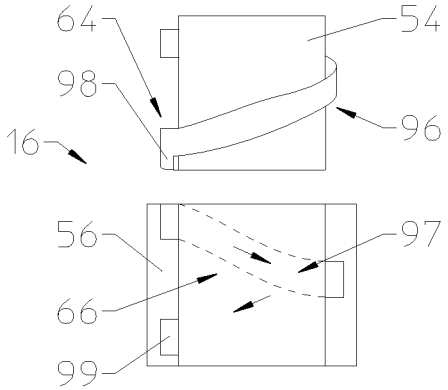
Figure 5C:
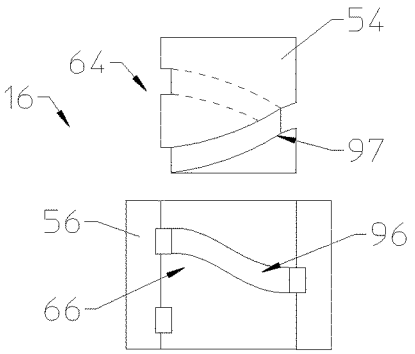
Figure 5D:
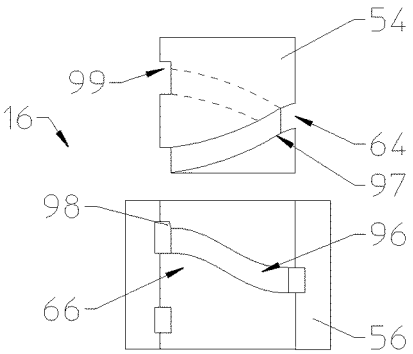

FIGS. 5A-5D illustrate embodiments of the alignment device 16 where both the orientation profile 64 and the profile 66 comprise helical profiles. For example, as shown in FIGS. 5A and 5B, the orientation profile 64 of the alignment sub 54 may be a helical protrusion 96 while the profile 66 of the corresponding alignment member 56 is a complementary shaped helical groove 97. As shown in FIGS. 5C and 5D, the orientation profile 64 of the alignment sub 54 may be a helical groove 97 while the profile 66 of the corresponding alignment member 56 is a complementary shaped helical protrusion 96. The complementary helical protrusions 96 and grooves 97 in FIGS. 5A-5D may have similar helical profiles that each extend in a rotational direction about the alignment sub 54/alignment member 56 as it extends in an axial direction along the alignment sub 54/alignment member 56.

As shown in FIGS. 5A-5D, the helical protrusion 96 and groove 97 may each extend one full rotation (in one direction) around the alignment sub 54/alignment member 56 as they extend in the axial direction of the alignment sub 54/alignment member 56. In other embodiments, the helical protrusion 96 and groove 97 may extend multiple rotations around the alignment sub 54/alignment member 56 as they extends in the axial direction. The helical protrusion 96 is designed to be received into the helical groove 97 and to move along the helical groove 97 as one of the alignment sub 54 and the alignment member 56 rotates with respect to the other. Interaction of the helical protrusion 96 and groove 97 drives this rotation as the connected subsea tubular members (not shown) are brought together.

In some embodiments, the alignment device 16 may include multiple helical protrusions 96 and grooves 97 in the alignment sub 54/alignment member 56. The multiple helical protrusions 96 may be separated from each other about the circumference of the alignment sub 54 or alignment member 56 along their entire lengths. The corresponding helical grooves 97 may be separated from each other about the circumference of the alignment sub 54 or alignment member 56 along their entire lengths.

The helical groove 97 may be bounded on both the upper and lower sides thereof along the entire length of the groove or most of the length of the groove, as shown in FIGS. 5A-5D. An opening of the helical groove 97 may intersect an axial end of the alignment sub 54 or alignment member 56 in which the groove 97 is located. That way, as the alignment sub 54 and alignment member 56 are brought together, one of the components rotates with respect to the other until the helical protrusion 96 enters the opening at the end of the helical groove 97 and the helical protrusion 96 rides along the groove to orient the components with respect to each other.

In other embodiments, the helical groove 97 may be bounded on just one side thereof (e.g., lower side in FIGS. 5A-5B and upper side in FIGS. 5C-5D). In such an embodiment, the helical groove 97 (or recess) can interact directly with the corresponding helical protrusion 96 without requiring any rotation of the alignment sub 54/alignment member 56 with respect to each other until the helical protrusion 96 contacts the helical recess 97. In such embodiments, the helical recess 97 may be limited to one full rotation about the axis of the alignment member 56. The helical recess 97 in such embodiments may take the form of a "mule shoe" profile as described above.

As shown in FIGS. 5B and 5D, the helical profiles 64 and 66 may each include at least one vertically oriented portion at an axial end of the helical profiles. For example, in FIG. 5B, the helical protrusion 96 on the alignment sub 54 has a vertically oriented portion 98 at a lower axial end thereof, while the helical groove 97 of the corresponding alignment member 56 has a vertically oriented portion 99 at a lower axial end thereof. In FIG. 5D, the helical groove 97 on the alignment sub 54 has a vertically oriented portion 99 at an upper axial end thereof, while the helical protrusion 96 on the alignment member 56 has a vertically oriented portion 98 at an upper axial end thereof. The vertically oriented portion 99 may be a vertically oriented slot or groove that functions to enable a final landing/connection of the associated subsea tubular members during connection via the alignment device 16. The vertically oriented portion 98 of the helical protrusion 96 may be designed to be received and seated into the vertically oriented portion 99 of the helical groove 97. Once the vertically oriented portion 98 of the protrusion 96 reaches the vertically oriented portion 99 at the end of the helical profile 97, rotation between the alignment sub 54 and the alignment member 56 stops and these components move in a vertical direction with respect to each other for final alignment and coupling.

Figure 6:
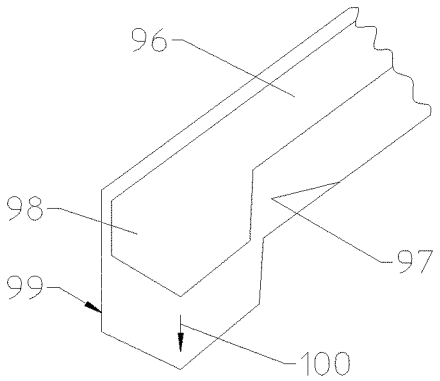
FIG. 6 is a side view illustrating a configuration of two helical profiles that may be used in the profiles of FIGS. 5B and 5D, in accordance with an embodiment of the present disclosure.

FIG. 6 illustrates a shape of the vertically oriented portions 98 and 99 of the helical protrusion 96 and groove 97, respectively. As shown, the helical protrusion 96 may be less wide than the helical groove 97 for most of the length of the helical profiles, enabling the vertically oriented portion 98 of the helical protrusion 96 to be received into and move along the helical groove 97. Upon reaching the end of the helical profile engagement, the vertically oriented portion 98 of the protrusion 96 may be received into and moved vertically (arrow 100) through the portion 99 of the groove 97.

More detailed embodiments of the disclosed alignment device 16 will now be provided. These embodiments may include similar features to those described above with reference to FIGS. 1-6. Various components described below may be used in combination with the assemblies described above, or may include portions of the assemblies described above.

Coiled Conduit Alignment Mechanism

An alignment device 16 having a coiled conduit mechanism in shown in FIGS. 7-8C. The alignment device 16 as described below may be a tubing hanger alignment device used to couple a tree (second subsea tubular member 18) to a tubing hanger (first subsea tubular member 14). However, it will be understood that the disclosed alignment device 16 may be similarly used to couple other types of subsea tubular members as well. The alignment devices (referred to hereinafter as "tubing hanger alignment device") 16 of FIGS. 7 and 8 each include a mule shoe sub 110 (110A), an alignment key 112 (112A), a production stab sub 114, and one or more lengths of coiled fluid (e.g., hydraulic) tubing and/or electrical conduits 116. The arrangement and interaction of these components will now be described.

Figure 7A:
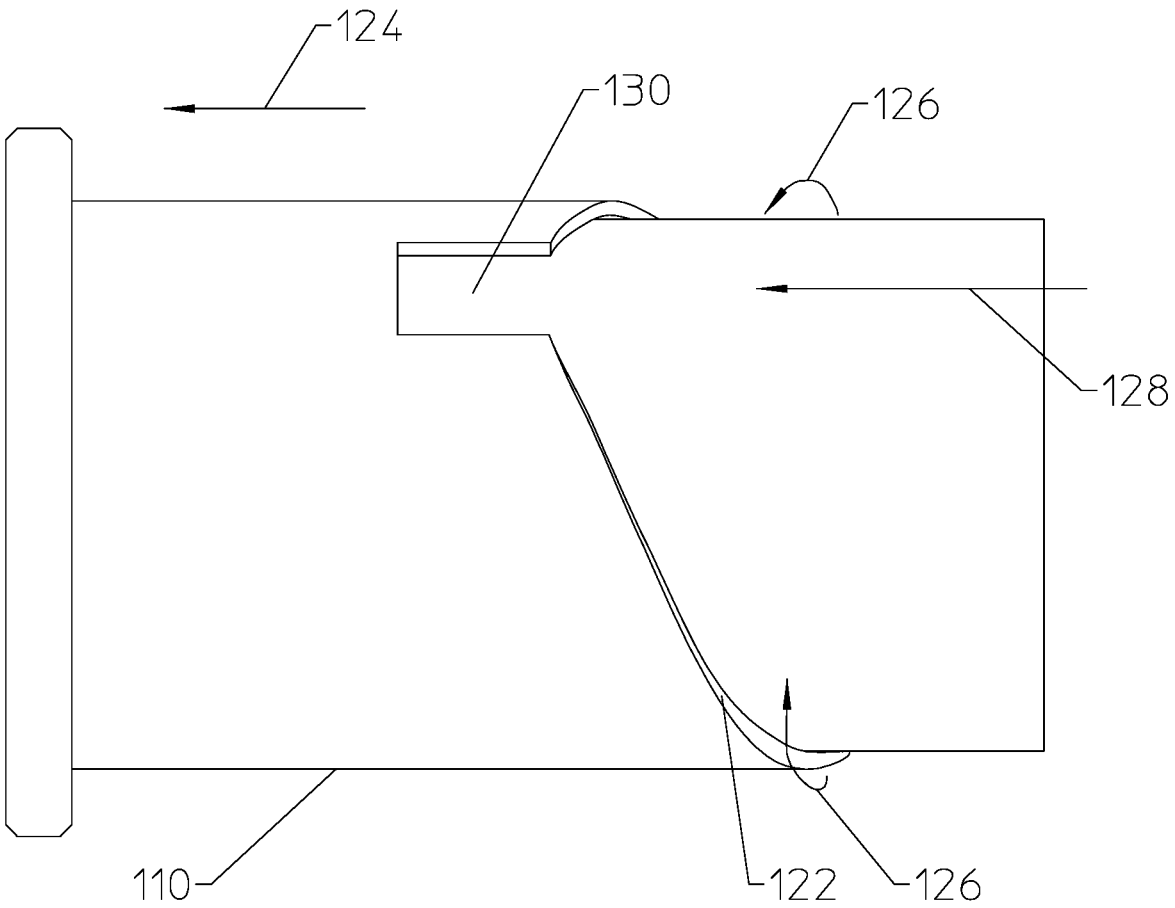
FIG. 7A is a perspective view of a mule shoe sub used in the tubing hanger alignment device of FIG. 7, in accordance with an embodiment of the present disclosure.

FIGS. 7 and 7A illustrate an embodiment of the tubing hanger alignment device 16 in which a mule shoe sub 110 is attached to the second subsea tubular member (hereinafter referred to as "tree") 18 and lowered along with the tree 18 onto the first subsea tubular member (hereinafter referred to as "tubing hanger") 14 to couple and align the tree 18 with the tubing hanger 14. In such embodiments, an alignment key 112 forms part of the tubing hanger 14. In other embodiments, though, this configuration is reversed. For example, as shown in FIGS. 8 and 8A, an alignment key 112A on a rotating sub 134 may be attached to the tree 18 and lowered along with the tree 18 onto the tubing hanger 14 to couple and align the tree 18 with the tubing hanger 14, while a mule shoe sub 110A may be part of the tubing hanger 14.

The tubing hanger alignment device 16 of FIGS. 7 and 7A will now be described. The mule shoe sub 110 of FIGS. 7 and 7A may house standard fluidic (e.g., hydraulic), electric, and/or fiber optic couplings 118 that interface with the corresponding couplings/stabs 32 at a top end of the tubing hanger 14 upon landing of the tree 18. The mule shoe sub 110 is generally mounted to the production stab sub 114, as shown. The mule shoe sub 110 may include fluid ports and/or electrical cables 120 extending therethrough. The ports and/or cables 120 may be connected to or through the coiled fluidic tubing and/or electrical conduits 116 at the top of the mule show sub 110 to allow the mule shoe sub 110 to rotate relative to the body of the tree 18. Electrical cables and/or fluid ports 120 disposed through the mule shoe sub 110 are terminated to a series of wet mate electric contacts and/or fluidic (e.g., hydraulic) connectors 118 that interface with the tubing hanger 14 at the bottom of the mule shoe sub 110.

The mule shoe sub 110 is able to rotate relative to the tree body 18 and the production stab sub 114. A mule shoe profile drives the mule shoe sub 110 to rotate as it is lowered through the wellhead 112. The mule shoe profile 122 is illustrated in FIG. 7A. The mule shoe profile 122 is a profile formed about the outer circumference of the mule shoe sub 110, as shown. The mule shoe profile 122 may feature a protruding edge that slopes in a relatively downward direction (arrow 124) from one side of the mule shoe sub 110 in both directions circumferentially around the sub 110 (arrows 126) to an opposite side 128 of the mule shoe sub 110. At the lowest point on the side 128 of the mule shoe profile 122, the profile 122 may include an alignment slot 130. The alignment slot 130 may be oriented in the downward direction (arrow 124).

As shown in FIG. 7, the alignment key 112 may be mounted directly to the tubing hanger 14. The mule shoe profile 122 may drive the mule shoe sub 110 to rotate against the alignment key 112 until the alignment key 112 is set into the alignment slot 130. At this point, the mule shoe sub 110 will be properly oriented relative to the tubing hanger 14 so as to make the desired mating connections at the interface of couplings 118 and 32. As such, rotation of the mule shoe sub 110 stops when the couplings 118 of the mule shoe sub 110 are aligned to the couplings 32 on the tubing hanger 14.

The production stab sub 114 may be mounted to the tree body 18. The mule shoe sub 110 is disposed around an outer circumference of the production stab sub 114. The production stab sub 114 may retain the mule shoe sub 110 thereon while allowing the mule shoe sub 110 rotational freedom about the production stab sub 114. As such, the production stab sub 114 rotationally couples the mule shoe sub 110 to the tree 18. The mule shoe sub 110 is able to rotate relative to the production stab sub 114 and the tree 18 as the tree 18 is being lowered into the wellhead 12.

The coiled fluid tubing (i.e., conduit) (116) provides a communication path for fluid (e.g., hydraulic fluid) being communicated from fluid ports in the tree 18 to corresponding fluid ports in the mule shoe sub 110 and ultimately the tubing hanger 14. The coiled arrangement of the fluid tubing (116) allows the conduit to flex as the mule shoe sub 110 rotates in either direction to align the couplings 118 with those of the tubing hanger 14 while the tree 18 is being lowered.

The electrical conduits (116) provide a communication path for electrical and/or fiber optic signals being communicated from cables in the tree 18 to corresponding cables in the mule shoe sub 110 and ultimately the tubing hanger 14. The coiled arrangement of the electrical conduits (116) allows the conduit to flex as the mule shoe sub 110 rotates in either direction to align the couplings 118 with those of the tubing hanger 14 while the tree 18 is being lowered.

A general description of a method for operating the tubing hanger alignment device 16 of FIGS. 7 and 7A will now be described. The production stab sub 114 may be installed onto a lower portion of the tree 18. The production stab sub 114 may be coupled to the tree 18 via threads, a lock ring, or any other known method. The production stab sub 114 may be connected to the tree 18 in a manner that does not allow rotation of the production stab sub 114 relative to the tree 18. In other embodiments, the production stab sub 114 may be formed integral with the tree 18. In either case, the production stab sub 114 extends from a body of the tree 18.

The method may also include installing the mule shoe sub 110 onto the production stab sub 114. The mule shoe sub 110 may be disposed around the outside circumference of the generally cylindrical production stab sub 114, and the mule shoe sub 110 may be rotatably coupled to the production stab sub 114. The mule shoe sub 110, for example, may be connected to the outside of the production stab sub 114 via a bearing interface that enables free rotation of the mule shoe sub 110 around the production stab sub 114 while these components are lowered through the wellhead 12.

The one or more lengths of fluid tubing and/or electrical conduits 116 may be connected between the bottom of the tree body 18 and the top of the mule shoe sub 110. The electrical conduits and/or fluid tubing 116 may be coiled around the outer diameter of the production stab sub 114 in a space located longitudinally between the tree 18 and the mule shoe sub 110. In some embodiments, the conduits 116 may be extended upward from the connected cables and/or ports 120 in the mule shoe sub 110, coiled one or more times each around the production stab sub 114, and connected to contacts 132 at a lower end of the tree body 18. In other embodiments, the conduits 116 may be extended from an interface at the lower end of the tree body 18, coiled one or more times each around the production stab sub 114, and connected to cables and/or ports 120 in the mule shoe sub 110 via contacts on the mule shoe sub 110. In some embodiments, the contacts may be located at an upper end of the mule shoe sub 110, as shown. However, other locations may be possible in other embodiments.

During assembly of the tubing hanger assembly, the alignment key 112 may be installed along an inner diameter of the tubing hanger 14. The alignment key 112 may be installed securely within a recess formed in the tubing hanger 14 along the inner diameter. As shown, the alignment key 112 is disposed in a particular position along the circumference of the inner surface of the tubing hanger 14. The alignment key 112 does not extend about the entire circumference of the inner surface of the tubing hanger 14. The alignment key 112 may be installed via a fastener such as a bolt or screw into the recess of the tubing hanger 14. The alignment key 112 may have a width that is sized to be received into the vertical slot 130 of the mule shoe profile 122 associated with the mule shoe sub 110. In other embodiments, the alignment key 112 may be formed entirely integral with the tubing hanger 14, such that the tubing hanger 14 is initially manufactured with the alignment key 112 as part of the inner diameter of the tubing hanger 14.

Upon assembly of the above components, the tubing hanger 14 may be run into the wellhead 12 in any orientation, locked into place, and sealed within the wellhead 12. The tree assembly having the tree body 18 and the tubing hanger alignment device 16 (i.e., production stab sub 114, mule shoe sub 110, and coiled conduits 116) is then run and oriented into a desired location in the wellhead 12 prior to landing within the wellhead 12.

While the tree 18 is landed from an initial position in the wellhead 12 to its final connected position, the mule shoe sub 110 may engage the alignment key 112 so as to orientate the couplings 32 and 118 associated with the tubing hanger 14 and the mule shoe sub 110, respectively. The mule shoe profile 122 on the outer edge of the mule shoe sub 110 may directly engage the alignment key 112 on the tubing hanger 14. Lowering the tree 18 further causes the mule shoe sub 110 to rotate about the production stab sub 114 and align with the tubing hanger 14. That is, the stationary alignment key 112 forces the mule shoe sub 110 to rotate in one direction or the other (depending on the direction of the slope of the mule shoe profile 122 at the point of initial contact with the alignment key 112) as the tree 18 is lowered until the alignment key 112 is received into the alignment slot 130 of the mule shoe profile 122. At this point, the mule shoe sub 110 will be in a proper alignment with the tubing hanger 14.

The tree 18 may then be landed and locked to the wellhead 12. All couplings between the mule shoe sub 110 and the tubing hanger 14 will be engaged at this point. The fluidic, electric, and/or fiber optic couplings between the tree 18 and the tubing hanger 14 will then be tested to ensure a proper connection has been made.

The tubing hanger alignment device 16 of FIGS. 8 and 8A will now be described. In FIGS. 8 and 8A, a rotating sub 134 having the alignment key 112A disposed thereon forms part of the tree assembly being lowered onto the wellhead 12. The rotating sub 134 may be similar to the mule shoe sub 110 of FIG. 7, but having the alignment key 112A instead of a mule shoe profile. The rotating sub 134 of FIGS. 8 and 8A may house standard fluidic (e.g., hydraulic), electric, and/or fiber optic couplings 118 that interface with the corresponding couplings/stabs 32 at a top end of the tubing hanger 14 upon landing of the tree 18. The rotating sub 134 is generally mounted to the production stab sub 114, as shown. The rotating sub 134 may include fluid ports and/or electrical cables (not shown) extending therethrough. The ports and/or cables may be connected to or through the coiled fluid tubing and/or electrical conduits 116 at the top of the rotating sub 134 to allow the rotating sub 134 to rotate relative to the body of the tree 18. Electrical cables and/or fluid ports disposed through the rotating sub 134 are terminated to a series of wet mate electric contacts and/or fluidic connectors 118 that interface with the tubing hanger 14 at the bottom of the rotating sub 134.

As shown in FIGS. 8 and 8A, the mule shoe sub 110A may be mounted directly to the tubing hanger 14. A mule shoe profile 122A on the mule shoe sub 110A of the tubing hanger 14 drives the rotating sub 134 to rotate as it is lowered through the wellhead 112. The mule shoe profile 122A is illustrated in FIG. 8A. The mule shoe profile 122A is a profile formed about the inner circumference of the mule shoe sub 110A, as shown. The mule shoe profile 122A may feature a recessed edge that slopes in a relatively downward direction (arrow 124) from one side of the mule shoe sub 110A in both directions circumferentially around the sub 110A to an opposite side 128A of the mule shoe sub 110. At the lowest point on the side 128A of the mule shoe profile 122A, the profile 122A may include an alignment slot 130A. The alignment slot 130A may be vertically oriented such that the slot 130A extends in the downward direction (arrow 124). In other embodiments, the mule shoe profile 122A may not include an elongated alignment slot 130A, but rather a lowest point of the mule shoe profile 122A where the key 112A can be seated.

The rotating sub 134 is able to rotate relative to the tree body 18 and the production stab sub 114. The mule shoe profile 122A may drive the rotating sub 134 with the alignment key 112A to rotate against the mule shoe sub 110A until the alignment key 112A is set into the alignment slot 130A. At this point, the rotating sub 134 will be properly oriented relative to the tubing hanger 14 so as to make the desired mating connections at the interface of couplings 118 and 32. As such, rotation of the rotating sub 134 stops when the couplings 118 of the rotating sub 134 are aligned to the couplings 32 on the tubing hanger 14.

In some embodiments, the alignment key 112A may be specially shaped to interact with the mule shoe sub 110A. For example, as shown in FIG. 8B, the alignment key 112A may include two downward facing angled surfaces 150 on a lower end thereof and two vertically oriented surfaces 152 extending upward from the downward facing angled surfaces 150. The downward facing angled surfaces 150 may each be oriented at a same angle as the corresponding angled surfaces 154 of the mule shoe profile 122A. It should be understood that the alignment key 112 and mule shoe profile 122 of FIGS. 7 and 7A may have similar shapes as those shown in FIG. 8B.

The production stab sub 114 may be mounted to the tree body 18. The rotating sub 134 is disposed around an outer circumference of the production stab sub 114. The production stab sub 114 may retain the rotating sub 134 thereon while allowing the rotating sub 134 rotational freedom about the production stab sub 114. As such, the production stab sub 114 rotationally couples the rotating sub 134 and alignment key 112A to the tree 18. The rotating sub 134 is able to rotate relative to the production stab sub 114 and the tree 18 as the tree 18 is being lowered into the wellhead 12.

The coiled fluid tubing (i.e., conduit) (116) provides a communication path for fluid (e.g., hydraulic fluid) being communicated from fluid ports in the tree 18 to corresponding fluid ports in the rotating sub 134 and ultimately the tubing hanger 14. The coiled arrangement of the fluid tubing (116) allows the conduit to flex as the rotating sub 134 rotates in either direction to align the couplings 118 with those of the tubing hanger 14 while the tree 18 is being lowered.

The coiled electrical conduits (116) provide a communication path for electrical and/or fiber optic signals being communicated from cables in the tree 18 to corresponding cables in the rotating sub 134 and ultimately the tubing hanger 14. The coiled arrangement of the electrical conduits (116) allows the conduit to flex as the rotating sub 134 rotates in either direction to align the couplings 118 with those of the tubing hanger 14 while the tree 18 is being lowered.

In some embodiments, the production system of FIG. 8 may include one or more fluid flow paths 136 extending through the production stab sub 114. These flow paths 136 may provide, for example, an annulus flow path for fluid routed through the tubing hanger 14 from an annulus of the production tubing (e.g., tubing string 24 of FIG. 1). The one or more flow paths 136 extending through the production stab sub 114 may fluidly couple an annulus flow path 138 of the tubing hanger 14 to an annulus flow path 140 of the tree 18.

As shown, the interface between the production stab sub 114 and the tubing hanger 14 (upon landing of production stab sub 114) provides a sealed annular gallery 142. The annular gallery 142 may enable fluid to flow from the annulus flow path 138 of the tubing hanger 14 into the one or more flow paths 136 extending through the production stab sub 114, regardless of the orientation of the tree 18 (and attached production stab sub 114) with respect to the tubing hanger 14. The production stab sub 114 may include annular seals 142A and 142B that define the upper and lower bounds of the annular fluid gallery 142.

In some embodiments, the interface between the production stab sub 114 and the tree body 18 may include a sealed gallery 144 as well. This sealed gallery 144 may enable fluid to flow from the one or more flow paths 136 extending through the production stab sub 114 into the annulus flow path 140 of the tree 18, regardless of the orientation of the production stab sub 114 when it is initially attached to the tree 18. The production stab sub 114 may include annular seals 144A and 144B that define the upper and lower bounds of the annular fluid gallery 144. Such a sealed gallery 144 may be similarly implemented in the alignment device 16 described above with reference to FIGS. 7 and 7A for providing annulus fluid flow through the tubing hanger alignment device 16.

In embodiments where the one or more flow paths 136 through the production stab sub 114 are used to route annulus fluid therethrough, the annular seals 142A, 142B, 144A, and 144B for one or more flow paths 136 may act as a second barrier between the annulus fluid and the environment outside the subsea wellhead 12. Specifically, a gasket 143 between the connector of the subsea tree 18 and the wellhead 12 may form a primary barrier between the annulus fluid and the outside environment while the annular seals 142A, 142B, 144A, and 144B may form a secondary barrier between the annulus fluid and the outside environment. This may be beneficial as regulations for dual-barrier arrangements of annulus flow paths through subsea wellheads become more common.

A general description of a method for operating the tubing hanger alignment device 16 of FIGS. 8 and 8A will now be described. The production stab sub 114 may be installed onto a lower portion of the tree 18. The production stab sub 114 may be coupled to the tree 18 via threads, a lock ring, or any other known method. The production stab sub 114 may be connected to the tree 18 in a manner that does not allow rotation of the production stab sub 114 relative to the tree 18. In other embodiments, the production stab sub 114 may be formed integral with the tree 18. In either case, the production stab sub 114 may extend from a body of the tree 18.

In some embodiments, initial assembly of the rotating sub 134 may include installing the alignment key 112A along an outer diameter of the rotating sub 134. The alignment key 112A may be installed securely within a recess formed in the rotating sub 134 along the outer diameter. The alignment key 112A may extend outward from the outer edge of the rotating sub 134, though, for interfacing with the mule shoe sub 110A. As shown, the alignment key 112A is disposed in a particular position along the circumference of the outer surface of the rotating sub 134. The alignment key 112A does not extend about the entire circumference of the outer surface of the rotating sub 134. The alignment key 112A may be installed via a fastener such as a bolt or screw into the recess of the rotating sub 134. In other embodiments, the alignment key 112A may be formed entirely integral with the rotating sub 134 such that the alignment key 112A is part of the outside surface of the rotating sub 134. The alignment key 112A may have a width that is sized to be received into the vertical slot 130A of the mule shoe profile 122A associated with the mule shoe sub 110A.

The method may include installing the rotating sub 134 with the alignment key 112A onto the production stab sub 114. The rotating sub 134 having the alignment key 112A may be disposed around the outside circumference of the generally cylindrical production stab sub 114, and the rotating sub 134 may be rotatably coupled to the production stab sub 114. The rotating sub 134, for example, may be connected to the outside of the production stab sub 114 via an interface 133 that enables free rotation of the rotating sub 134 around the production stab sub 114 while these components are lowered through the wellhead 12. In some embodiments, the interface 133 may include a bearing interface.

The one or more lengths of fluid and/or electrical conduits 116 may be connected between the bottom of the tree body 18 and the top of the rotating sub 134. The electrical conduits and/or fluid tubing (i.e., conduits) 116 may be coiled around the outer diameter of the production stab sub 114 in a space located longitudinally between the tree 18 and the rotating sub 134. In some embodiments, the conduits 116 may be extended upward from the connected cables and/or ports 120 in the rotating sub 134, coiled one or more times each around the production stab sub 114, and connected to contacts 132 at a lower end of the tree body 18. In other embodiments, the conduits 116 may be extended from an interface at the lower end of the tree body 18, coiled one or more times each around the production stab sub 114, and connected to cables and/or ports 120 in the rotating sub 134 via contacts at an upper end of the rotating sub 134. In some embodiments, the contacts may be located at an upper end of the rotating sub 134, as shown. However, other locations may be possible in other embodiments.

During assembly of the tubing hanger assembly, the mule shoe sub 110A having the mule shoe profile 122A is installed along an inner diameter of the tubing hanger 14. The mule shoe sub 110A may be installed via threads, a lock ring, or any other known method. The mule shoe sub 110A may be connected to the tubing hanger 14 in a manner that does not allow rotation of the mule shoe sub 110A relative to the tubing hanger 14. In other embodiments, the mule shoe sub 110A may be formed integral with the tubing hanger 14. The mule shoe sub 110A is coupled to (or integral with) the tubing hanger 14 in a particular orientation with respect to the couplings 32 associated with the tubing hanger 14.

Upon assembly of the above components, the tubing hanger 14 (with the mule shoe sub 110A) may be run into the wellhead 12 in any orientation, locked into place, and sealed within the wellhead 12. The tree assembly having the tree body 18 and the tubing hanger alignment device 16 (i.e., production stab sub 114, rotating sub 134, and coiled conduits 116) is then run and oriented into a desired location in the wellhead 12 prior to landing within the wellhead 12.

While the tree 18 is landed from an initial position in the wellhead 12 to its final connected position, the alignment key 112A on the rotating sub 134 may engage the mule shoe sub 110A so as to orientate the couplings 32 and 118 associated with the tubing hanger 14 and the rotating sub 134, respectively. The alignment key 112A on the outer edge of the rotating sub 134 may directly engage the mule shoe profile 122A on the mule shoe sub 110A attached to the tubing hanger 14. Lowering the tree 18 further causes the rotating sub 134 to rotate about the production stab sub 114 and align with the tubing hanger 14. That is, the stationary mule shoe sub 110A forces the alignment key 112A and rotating sub 134 to rotate in one direction or the other (depending on the direction of the slope of the mule shoe profile 122A at the point of initial contact with the alignment key 112A) as the tree 18 is lowered until the alignment key 112A is received into the alignment slot 130A of the mule shoe profile 122A. At this point, the rotating sub 134 will be in a proper alignment with the tubing hanger 14.

The tree 18 may then be landed and locked to the wellhead 12. All couplings between the rotating sub 134 and the tubing hanger 14 will be engaged at this point. The fluidic, electric, and/or fiber optic couplings between the tree 18 and the tubing hanger 14 will then be tested to ensure a proper connection has been made. At this point, the fluid flow path(s) 136 through the production stab sub 114 may also be sealingly connected between the annulus flow path 138 of the tubing hanger 14 and the annulus flow path 140 of the tree 18.

As mentioned above, landing and locking the tree 18 to the wellhead 12 may fully engage the couplings 118 and 32 between the rotating sub 134 and the tubing hanger 14. This may include connecting a large number of couplings 118/32 between these two members. For example, in some embodiments twelve hydraulic couplings, two electrical couplings, and one fiber optic coupling on the rotating sub 134 may be connected to the tubing hanger 14 simultaneously. At the same time, a lower end of the production stab sub 114 may also be fully connected to the tubing hanger 14. To connect the production stab sub 114 along with the many couplings 118 of the rotating sub 134 to the tubing hanger 14 at one time takes a large amount of downward force. As discussed above, the system may include an interface 133 coupled to the production stab sub 114 above the alignment device 134. In some embodiments, the interface 133 may include a C-shaped ring component that acts as a load ring during the final installation of the tree 18 onto the tubing hanger 14. When all the couplings 118 are being initially received into corresponding couplings or stabs 32, the production stab sub 114 may be lowered into a pocket in the tubing hanger 14. At that point, the alignment device 134 will not fully engage the couplings 118 with the corresponding couplings 32 until the load ring (interface 133) lands on the alignment device 134 and transfers the load of the tree 18 onto the couplings. This loading provided through the interface 133 allows the couplings 118 and 32 to fully mate at the same time the production stab sub is connected to the tubing hanger 14. The load ring (interface 133) may also pre-load the couplings 118 and 32 to prevent any movement between their connected communication paths as hydraulic pressure is applied.

Certain details regarding the fluid/electric conduits 116 in the embodiments of FIGS. 7-8C will now be provided. The fluid/electric conduits 116 each include an inlet at one end and an outlet at the other end. Either end may act as the inlet/outlet depending on the direction of fluid, electric, or other communication being provided through the conduit 116. For example, if electrical power or control signals are being transmitted from the surface to a downhole component, the upper end of the corresponding conduit 116 acts as the "inlet" while the lower end of the conduit 116 acts as the "outlet." If annulus fluid is being communicated from the subsea wellbore to the surface, the lower end of the corresponding conduit 116 acts as the "inlet" while the upper end of the conduit 116 acts as the "outlet." One end of each coiled conduit 116 may be coupled to the rotatable alignment sub (i.e., mule shoe sub 110 in FIGS. 7-7A and rotating sub 134 in FIGS. 8-8C) while the opposing end of the coiled conduit 116 is coupled to a subsea tubular component (e.g., tree body 18). In some embodiments, one end of each coiled conduit 116 may be coupled to the rotatable alignment sub while the opposing end of the coiled conduit 116 is coupled directly to a portion of the production stab sub 114 (which may be separate or integral with the subsea tubular component), as shown in FIGS. 8 and 8C. At either end, the coiled conduit 116 may be coupled to a corresponding component (e.g., rotatable alignment sub, subsea component, and/or production stab sub 114) via any desired type of connection including, but not limited to, a fitting, a welded connection, or a sealed connector. At either end, the coiled conduit 116 may be positioned within and simply extend through an opening in the corresponding component to transition from the "coiled conduit" 116 between the subsea components and a fluid, electric, or fiber optic line extending through one or more of the subsea components.

The coiled conduits 116 of FIGS. 7-8C maintain the desired fluid, electric, and/or fiber optic connections between subsea components being coupled together while providing flexibility for the alignment of the rotatable alignment sub (e.g., mule shoe sub 110 in FIGS. 7-7A and rotating sub 134 in FIGS. 8-8C) with respect to the subsea component being landed on. In some embodiments, the coiled conduits 116 may provide flexibility for the positioning of the rotatable alignment sub in both a rotational direction and a vertical direction. In some embodiments, the production stab sub 114 may include a groove 170 in which a portion of the rotatable alignment sub or bearing interface 133 is captured (e.g., as shown in FIGS. 8 and 8C). In some embodiments, this groove 170 may be sized to allow some amount of vertical movement of the rotatable alignment sub (e.g., 110 or 134) with respect to the production stab sub 114. This vertical movement may allow the rotatable alignment sub to "float" with respect to the production stab sub 114 during lowering and self-aligning of the tree body 18 with respect to the tubing hanger 14.

As the rotatable alignment sub rotates in one direction, the coils in the coiled conduit(s) 116 may expand or separate with respect to each other. As the rotatable alignment sub rotates in the opposite direction, the coils may tighten or compress with respect to each other. In embodiments where the rotatable alignment sub is "floating," as the rotatable alignment sub moves vertically downward with respect to the production stab sub 114, the coils in the coiled conduit(s) 116 may expand or separate with respect to each other. Similarly, as the rotatable alignment sub moves vertically upward with respect to the production stab sub 114, the coils in the coiled conduit(s) 116 may tighten or compress with respect to each other. The coiled conduits 116 are coiled in a manner to prevent additional stress or loading on the connections to the corresponding subsea components (e.g., tree body 18 and tubing hanger 14). The number of wraps and the diameter of the coils for each coiled conduit 116 may be engineered, selected, and/or calculated based on the relative cross-sectional diameters and/or wall thicknesses of the conduits 116 as well as expected pressures, temperatures, and environments to which the conduits 116 will be exposed. The number of wraps and the diameter of the coils may be designed to minimize or prevent any additional stresses or loading on the connections between the coiled conduits 116 and the corresponding subsea components (e.g., tree body 18 and tubing hanger 14) during installation and rotation of the tubing hanger alignment device 16. The coiled conduits 116 may be protected from clashing, rubbing, or cycling movements due to pressure and temperature changes during production of the well. In some embodiments, coiled conduits 116 having a greater ("thicker") cross-sectional diameter may be positioned radially inward from coiled conduits 116 having a smaller ("thinner") cross-sectional diameter. In such instances, the "thicker" coiled conduits 116 may be wrapped more closely around the production stab sub 114 while the "thinner" coiled conduits 116 may be wrapped around the "thicker" coiled conduits 116. This may prevent the different sized coiled conduits 116 from rubbing against each other and causing undesired fatigue on the coiled conduits 116.

The coiled conduits 116 may be constructed from material(s) that are resistant to corrosion and harsh environments of the subsea production system. As shown in FIG. 8C, some embodiments of the tubing hanger alignment device 16 may include a protective housing or shroud 172 that covers the outside diameter of the one or more coiled conduits 116 and contains the coiled conduits 116. This protective housing or shroud 172 may help to protect the coiled conduits 116 from undesired impact forces during lowering of the tree body 18 with the attached tubing hanger alignment device 16.

The coiled conduit(s) 116 may include one or more fluid, power, and/or communication lines. The coiled conduit(s) 116 may allow for communication of hydraulic fluid(s), injection fluid(s), and/or annulus fluid(s) therethrough. The coiled conduit(s) 116 may allow for power and/or communication signals (both electrical and fiber optic) to be transferred from the tree body 18 through the coiled conduit(s) 116 and the tubing hanger alignment device 16 and to/through the tubing hanger 14.

The coiled conduit(s) 116 may help provide a bridge for communicating power, communication signals, and/or fluid through the hazardous environment and conditions in the well to the tree body 18. This bridge between the environment and the well condition is constructed entirely from material that meet or exceed the requirements needed to perform in extreme conditions as seen in wells. The bridge includes all metal-to-metal sealing technology throughout the entire system from the inlet to the final outlet (e.g., between the tree body 18 and the production stab sub 114, between the production stab sub 114 and the upper end of the coiled conduits 116, from the lower end of the coiled conduits 116 to the rotatable alignment sub, and from the couplings 118 on the rotatable alignment sub to the couplings or stabs 32 on the tubing hanger 14, and/or any other couplings in the system).

In some embodiments, the rotatable alignment sub (i.e., mule shoe sub 110 in FIGS. 7-7A and rotating sub 134 in FIGS. 8-8C) may be coupled to the production stab sub 114 such that the rotatable alignment sub is vertically movable with respect to the production stab sub 114. For example, as illustrated in FIG. 8, the interface 133 between the rotating sub 134 and the production stab sub 114 may include a ring portion of the rotating sub 134 that is fit into a groove formed in an outer diameter of the production stab sub 114. In some embodiments, this groove in the outer diameter of the production stab sub 114 may have a vertical clearance that is larger than the vertical height of the ring portion of the rotating sub 134 that is captured in the groove. This additional vertical clearance at an interface 133 between the rotatable alignment sub and the production stab sub 114 may allow the rotatable alignment sub to float and not remain vertically fixed to the tree body 18 by bolts, threads, pins, etc. The rotatable alignment sub is attached through the coiled conduits 116 to the tree body 18. As such, the coiled conduits 116 may flex, allowing for the rotatable alignment sub to float up or down and to rotate clockwise or counterclockwise with respect to the production stab sub 114 and the tree body 18. By being detached in this vertical dimension as well as rotationally from the production stab sub 114, the rotatable alignment sub may allow for the alignment and makeup of the hydraulic, electric, and/or fiber optic lines with greater ease than would be possible if the rotatable alignment sub were fixed in the vertical direction.

The coiled conduits 116 may each be configured to flex in response to rotation of the rotatable alignment sub about the production stab sub 114 in either direction (clockwise or counterclockwise) for up to 180 degrees. In other embodiments, the coiled conduits 116 may each be configured to flex in response to rotation of the rotatable alignment sub about the production stab sub 114 in either direction (clockwise or counterclockwise) for up to 360 degrees. The coiled conduits 116 are generally configured to flex in response to whatever number of degrees rotation of the rotatable alignment sub is needed to align the couplings 118 on the rotatable alignment sub with the corresponding couplings 32 of the tubing hanger 14, making the system self-aligning. If upon landing the subsea tree body 18, the tree and/or other subsea field equipment are out of rotational alignment with each other, the tree body 18 may be picked up, rotated to a desired orientation, and set back down. The coiled conduits 116 and rotatable alignment sub may adjust for the difference in rotation and connect the tree body 18 to the tubing hanger 14.

It should be noted that the embodiments of FIGS. 7-8C are exemplary and that variations on this system may be used as well. For example, as discussed above with reference to FIGS. 2A-6, different orientations of the components making up the alignment device 16 may be used in other embodiments. The alignment device 16 may include a rotating sub located on the bottom of the assembly while the stationary component is at the top of the assembly. The radial direction in which the orienting profiles are facing may be reversed. Different combinations of orientation profiles may be used, such as two helical components interacting. Other variations on the alignment device 16 will be understood based on the present disclosure.

The disclosed tubing hanger alignment device 16 of FIGS. 7-8C may achieve the goal of aligning the tubing hanger penetrations (i.e., couplings/stabs 32 and 118) independent of the orientation about the longitudinal axis in which the tree 18 is landed. The alignment process is passive and resets without manual intervention subsea or on the surface. Existing vendor seals, fluidic couplers, and electrical connectors of the tubing hanger 14 may be utilized in implementations of the disclosed alignment device 16. Existing tree body designs may need some modification to remove and replace existing couplers with conduit connections leading to the conduits 116. Existing tubing hangers may be utilized with only a minor modification to add the alignment key 112 or the mule shoe sub 110A. Existing tubing hanger running tools may be utilized without modification.

Coiled Conduit Alignment Mechanism with Multi-Start Alignment Threads

Another embodiment of an alignment device 16 having a coiled conduit mechanism is shown in FIGS. 9A-13B. The alignment device 16 as described below may be a tubing hanger alignment device used to couple a tree to a tubing hanger. However, it will be understood that the disclosed alignment device 16 may be similarly used to couple other types of subsea tubular members as well. The alignment device (hereinafter referred to as "tubing hanger alignment device") 16 of FIGS. 9A-13B includes a production stab sub 610, an alignment sub 612, an outer timing ring 614, and one or more lengths of coiled fluid and/or electrical and/or fiber optic conduits 616. The arrangement and interaction of these components will now be described.

Figure 14:
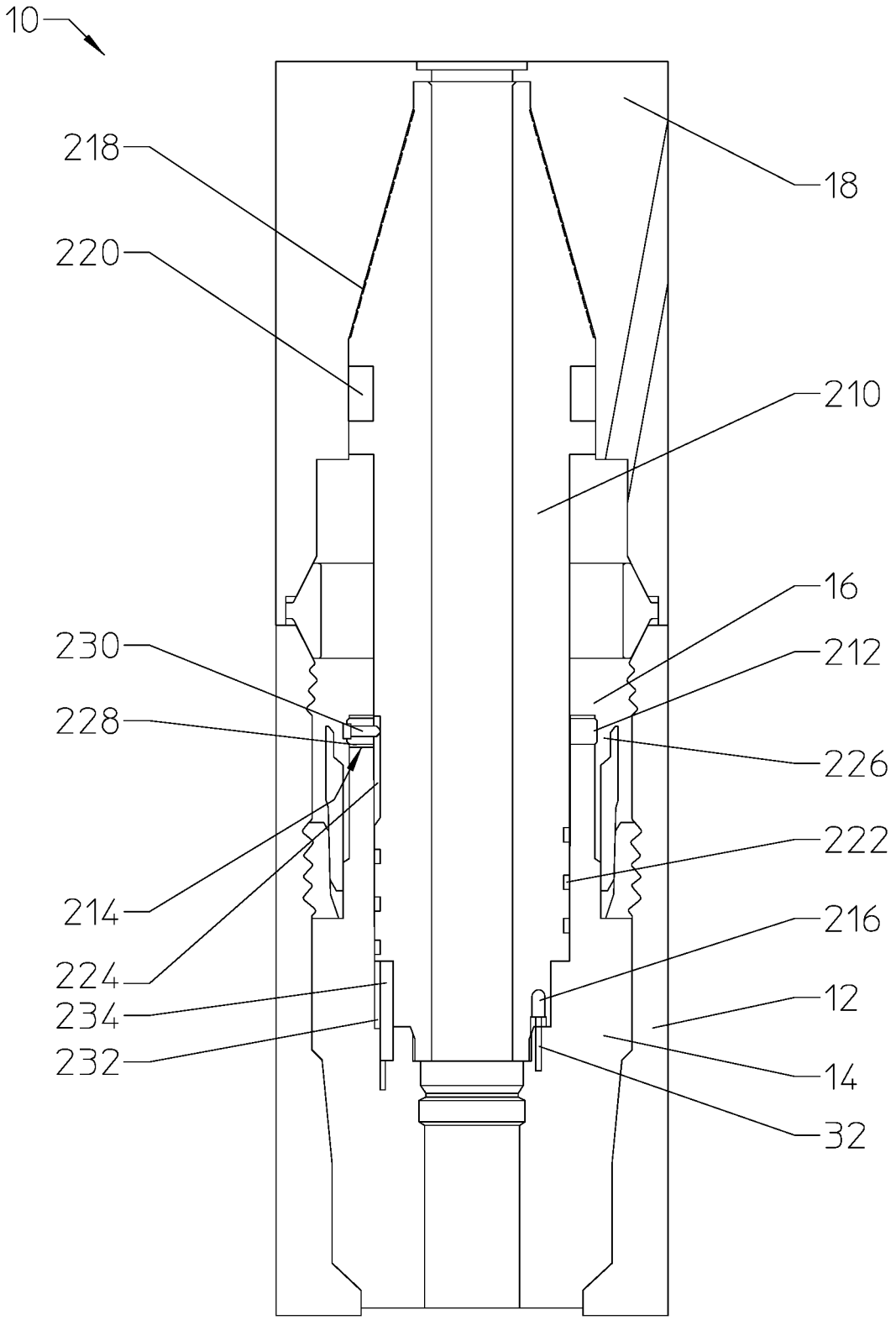
FIG. 14 is a cross-sectional view of a production system comprising a tubing hanger alignment device with a helical slot alignment mechanism, in accordance with an embodiment of the present disclosure.

Similar to the mule shoe sub 110 (110A) of FIGS. 7-8C and the alignment body of FIG. 14, the alignment sub 612 may house standard fluidic (e.g., hydraulic), electric, and/or fiber optic couplings 118 that interface with the corresponding couplings/stabs at a top end of the first subsea tubular member (e.g., "tubing hanger") (not shown) upon landing of the second subsea tubular member (e.g., "tree") (not shown). The alignment sub 612 is generally mounted to the production stab sub 610, as shown. In the running position, the alignment sub 612 extends downward to approximately the same ultimate position as that of the production stab sub 610, so that the alignment sub 612 provides a protective barrier between seals 618 at a lower end of the production stab sub 610 and external components.

The alignment sub 612 includes fluid ports and/or electrical cables 120 extending therethrough. The ports and/or cables 120 may be connected to or through the coiled fluid and/or electrical and/or fiber optic conduits 616 at the top of the alignment sub 612 to allow the alignment sub 612 to rotate relative to the body of the tree. Electrical cables and/or fluid ports 120 disposed through the alignment sub 612 may be terminated to a series of electric/fiber contacts and/or fluidic connectors 118 that interface with the tubing hanger at the bottom of the alignment sub 612.

Similar to the embodiments of FIG. 7 and FIG. 14, the alignment sub 612 is able to rotate relative to the tree body (not shown) and the production stab sub 610. Similar to the embodiment of FIG. 14, this rotation is driven by the outer timing ring 614. As illustrated, an external surface of the alignment sub 612 features a plurality of alignment threads 620 formed therein. These alignment threads 620 are a series of helical shaped slots or grooves formed into the alignment sub 612 and spaced about the circumference of the alignment sub 612. Each alignment thread 620 includes an independent starting point at the bottom thereof, each starting point designed to receive a corresponding pin 622 of the outer timing ring 614. In the illustrated embodiment, the alignment threads 620 include a six-pitch alignment thread, meaning there are six starting points corresponding to six threads. Other numbers of threads are possible in other embodiments as well. The outer timing ring 614 includes a plurality of pins 622, which extend from an internal diameter of the outer timing ring 614 in a radially inner direction and are located in corresponding alignment threads 620 of the alignment sub 612. As such, the outer timing ring 614 generally functions as a nut riding on the threads 620 of the alignment sub 612. At an upper portion of the alignment sub 612, the alignment threads 620 transition into vertical alignment slots 624 located around the circumference of the alignment sub 612.

The outer timing ring 614 includes one or more key features 626 designed to interact with complementary key features of the tubing hanger (not shown). For example, as shown, the outer timing ring 614 may feature lugs 626 extending in a downward direction from a lower surface of the outer timing ring 614. These lugs 626 are designed to interface with corresponding grooves or slots formed in an upward facing surface of the tubing hanger (not shown) to time the start of alignment rotation so that couplings 118 at the bottom of the alignment sub 612 will be aligned with the corresponding couplings/stabs at the top of the tubing hanger. The lugs 626 may include three lugs, four lugs, or some other number of lugs. The lugs 626 on the outer timing ring 614 may be unevenly spaced from each other around the circumference of the outer timing ring 614, unevenly spaced in a radial direction from a longitudinal axis of the outer timing ring, extending different lengths in the longitudinal direction, having different shapes in a plane perpendicular to the longitudinal axis, or a combination thereof. The corresponding grooves or slots extending into the tubing hanger may be arranged in a similar unevenly positioned, shaped, and/or sized manner. That way, the lugs 626 of the outer timing ring 614 are received into the corresponding grooves or slots of the tubing hanger only when the outer timing ring 614 is in a particular orientation with respect to the tubing hanger about a longitudinal axis.

It should be noted that, in other embodiments, the key features on the outer timing ring and the tubing hanger may be reversed, such that the outer timing ring includes keyed slots or grooves formed therein to be received on upwardly extending lugs of the tubing hanger.

The outer timing ring 614 seats the tubing hanger alignment device 16 in a desired orientation within the tubing hanger, regardless of how the tubing hanger is oriented within the wellhead. Once the outer timing ring 614 is keyed into the tubing hanger, it cannot be rotated with respect to the tubing hanger. The alignment sub 612 then moves downward, rotating with respect to the stationary outer timing ring 614 until it reaches an aligned position relative to the tubing hanger (not shown) for making the desired fluid, electric, and/or fiber optic connections. At this point, the alignment sub 612 will be properly oriented relative to the tubing hanger so as to make the desired mating connections at the interface of couplings 118 and couplings (e.g., 32 of FIG. 1). As such, rotation of the alignment sub 612 stops when the couplings 118 of the alignment sub 612 are aligned to the couplings 32 on the tubing hanger.

The production stab sub 610 may be mounted to the tree body (not shown), similar to the production stab sub 114 of FIG. 7. The alignment sub 612 is disposed around an outer circumference of the production stab sub 610. The production stab sub 610 may retain the alignment sub 612 thereon while allowing the alignment sub 612 rotational freedom about the production stab sub 610. As such, the production stab sub 610 rotationally couples the alignment sub 612 to the tree. The alignment sub 612 is able to rotate relative to the production stab sub 610 and the tree as the tree is lowered onto the wellhead.

The alignment sub 612 may be equipped with an actuation mechanism 628 used to release the production stab sub 610 from the alignment sub 612 so that the production stab sub 610 can move in a longitudinal direction with respect to the alignment sub 612. The actuation mechanism 628 is designed so that it can only be activated once the alignment sub 612 is in an aligned position with respect to the tubing hanger. In the illustrated embodiment, the actuation mechanism 628 includes one or more actuation buttons 630 and a split ring 632. The split ring 632 is held in position within a circumferential groove formed along a radially inner diameter of the alignment sub 612. The split ring 632 is biased in a radially outward direction so that it retains the alignment sub 612 at a particular longitudinal position relative to the production stab sub 610. Although not shown, the split ring 632 may be coupled to the production stab sub 610 via a shoulder or some other attachment feature. The actuation buttons 630 may extend from a radially outer diameter of the alignment sub 612 to the radially inner diameter of the alignment sub 612 where the split ring 632 is retained. A force applied in a radially inward direction to the one or more buttons 630 presses the buttons 630 into the split ring 632, thereby collapsing the split ring 632 so that the alignment sub 612 is no longer held in a fixed longitudinal position with respect to the production stab sub 610. This enables the production stab sub 610 to move further downward so that the seals 618 at the bottom thereof can be extended to interface with the tubing hanger. It should be noted that other types of actuation mechanisms may be used to selectively allow the production stab sub 610 to move downward and expose the seals 618.

While in the retracted position, gallery seals are not energized, allowing for free rotation of the alignment sub 612 around the production stab sub 610. Once the gallery seals are engaged, they will prevent further rotation such that the tree can be removed and reinstalled in the same orientation.

The coiled fluid tubing (i.e., conduit) (616) provides a communication path for fluid (e.g., hydraulic fluid) being communicated from fluid ports in the tree to corresponding fluid ports in the alignment sub 610 and ultimately the tubing hanger. The coiled arrangement of the fluid tubing (616) allows the conduit to flex as the alignment sub 612 rotates to align the couplings 118 with those of the tubing hanger while the tree is being lowered.

The electrical conduits (616) provide a communication path for electrical and/or fiber optic signals being communicated from cables in the tree to corresponding cables in the alignment sub 612 and ultimately the tubing hanger. The coiled arrangement of the electrical conduits (616) allows the conduit to flex as the alignment sub 612 rotates to align the couplings 118 with those of the tubing hanger while the tree is being lowered.

Figure 9A:
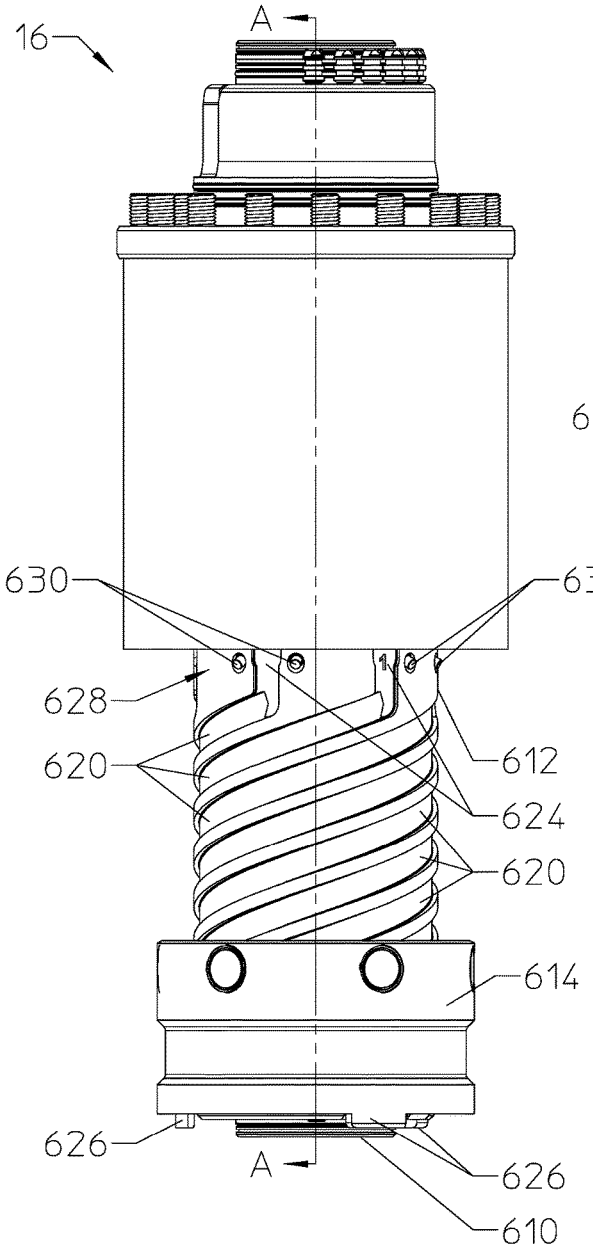
FIGS. 9A and 9B are a perspective view and a cross-sectional view, respectively, of a tubing hanger alignment device in a running configuration with a coiled conduit alignment mechanism, in accordance with an embodiment of the present disclosure.
Figure 9B:
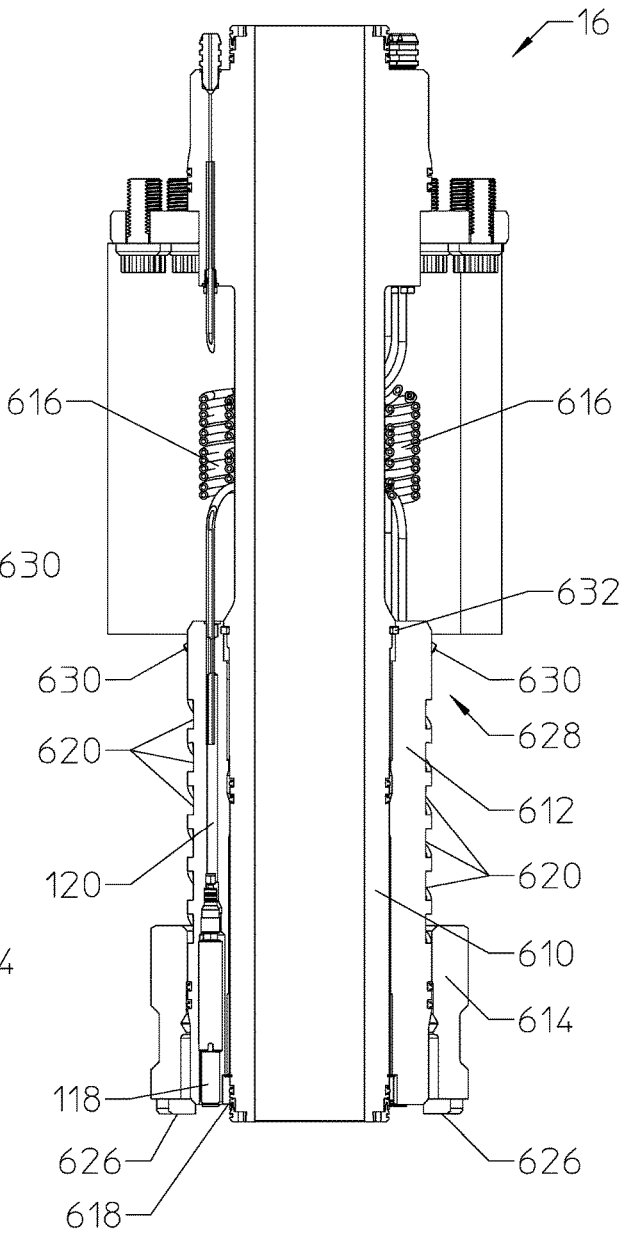

A general description of a method for operating the tubing hanger alignment device 16 of FIGS. 9A-13B will now be provided. FIGS. 9A and 9B show the tubing hanger alignment device 16 in a running configuration. This is the configuration of the tubing hanger alignment device 16 during the initial stage of lowering the tubing hanger alignment device 16 with the tree toward the wellhead. In this configuration, the outer timing ring 614 is located at the lower end of the alignment sub 612, with the pins 622 positioned in their corresponding alignment threads 620 where the threads begin. The components of the tubing hanger alignment device 16 remain in this position until the tubing hanger alignment device 16 is positioned in the wellhead just above the tubing hanger. Once the tubing hanger alignment device 16 is lowered far enough that the outer timing ring 614 contacts the tubing hanger in the wellhead, the outer timing ring 614, the alignment sub 612, or both, may rotate relative to the tree until the key features 626 (e.g., lugs) at the bottom of the outer timing ring 614 are received into the corresponding features (e.g., grooves or slots) of the tubing hanger.

Figure 10A:
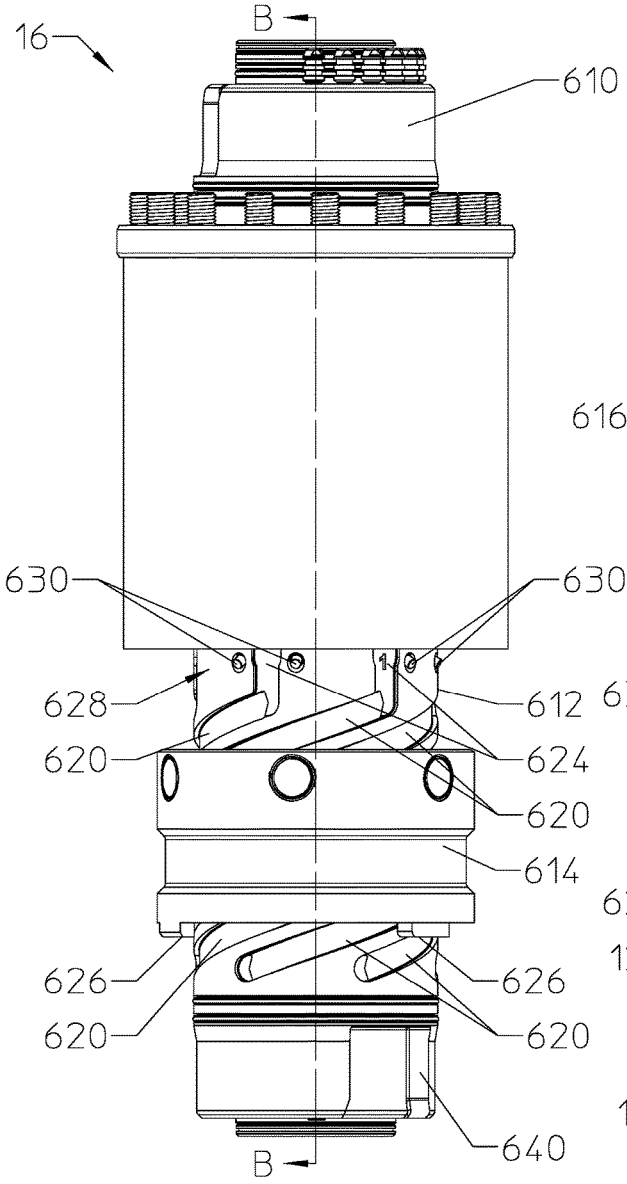
FIGS. 10A and 10B are a perspective view and a cross-sectional view, respectively, of the tubing hanger alignment device of FIGS. 9A and 9B in an aligning configuration, in accordance with an embodiment of the present disclosure.
Figure 10B:
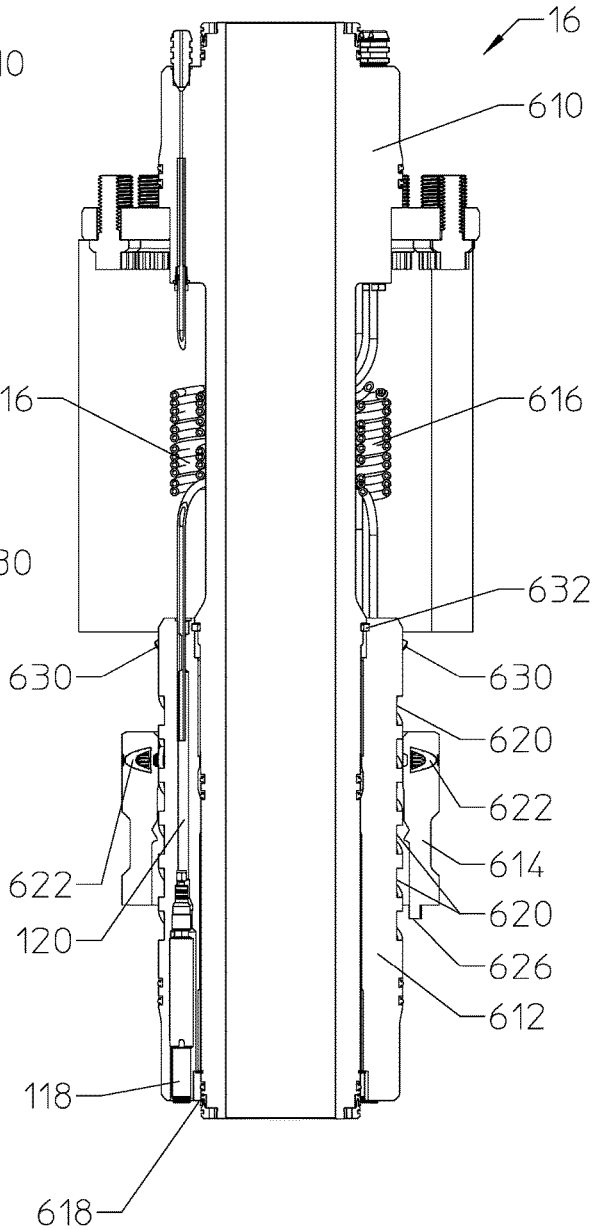

Once the outer timing ring 614 is firmly seated within the tubing hanger, further downward force applied to the tree causes the alignment sub 612 to rotate relative to the outer timing ring 614 and the tubing hanger. This is illustrated in FIGS. 10A and 10B. The tree and production stab sub 610 are being lowered relative to the tubing hanger and the outer timing ring 614, while the outer timing ring 614 is held stationary within the tubing hanger. With its pins 622 engaged in the alignment threads 620 of the alignment sub 612, the outer timing ring 614 drives the alignment sub 612 to rotate toward an aligned position relative to the tubing hanger where the fluidic, electric, and/or fiber optic couplings 118 of the alignment sub 612 are aligned with those of the tubing hanger. As this is happening, the coiled conduit(s) 616 flex to maintain the connections between the tree and the alignment sub 612 while the alignment sub 612 rotates relative to the tree.

Figure 11A:
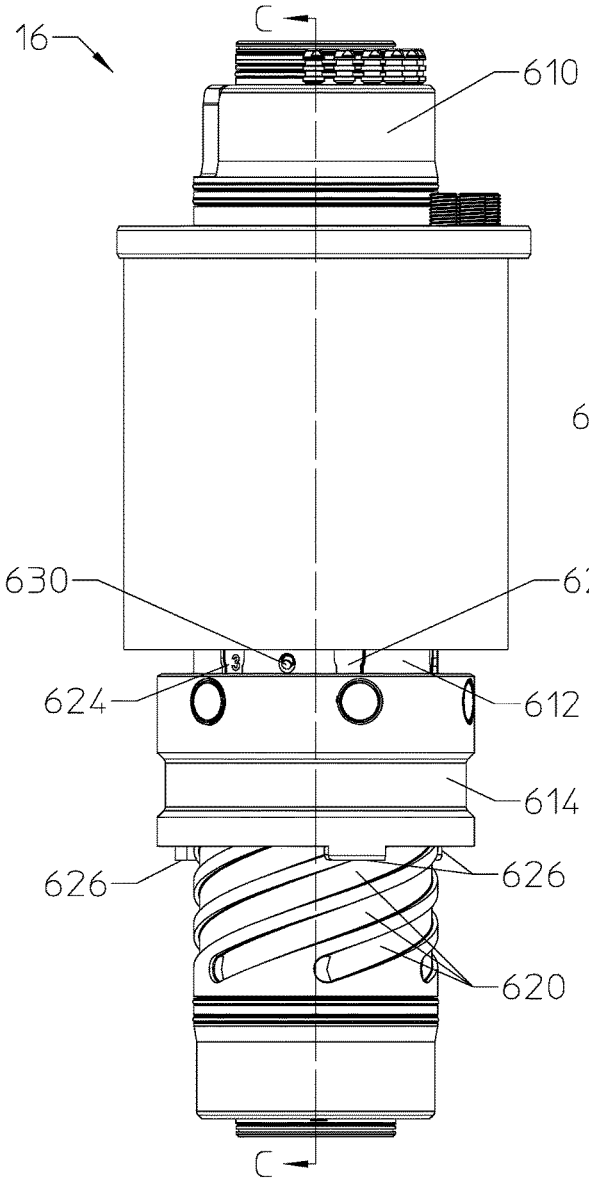
FIGS. 11A and 11B are a perspective view and a cross-sectional view, respectively, of the tubing hanger alignment device of FIGS. 9A-10B in an aligned configuration, in accordance with an embodiment of the present disclosure.
Figure 11B:
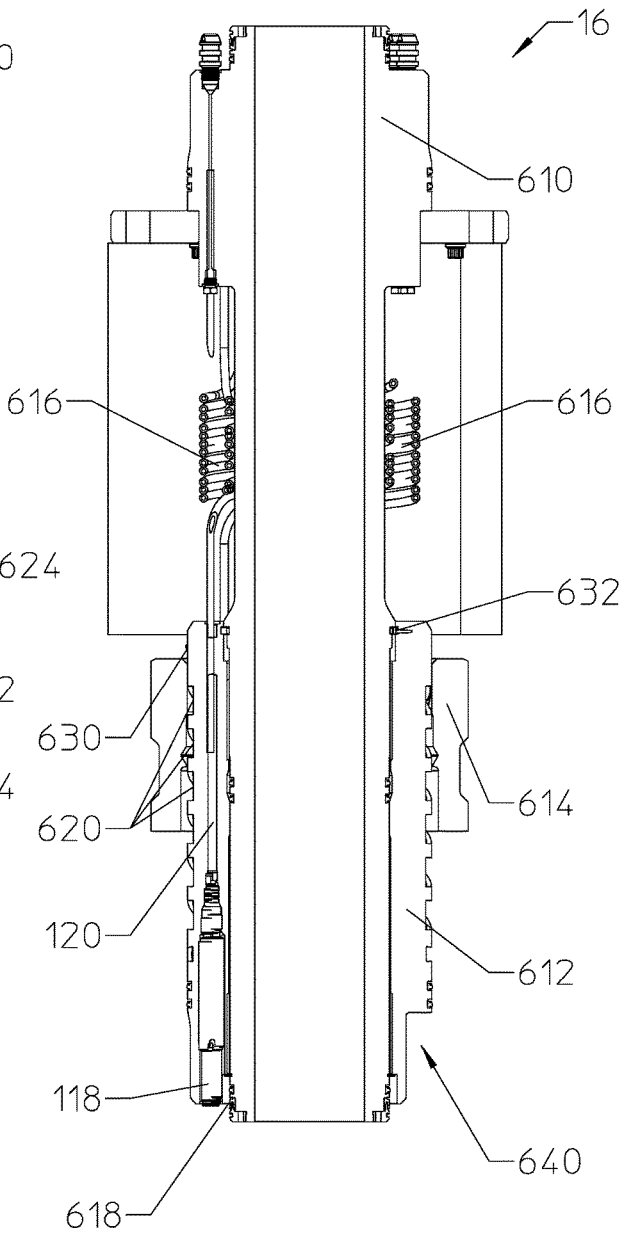
Figure 12A:
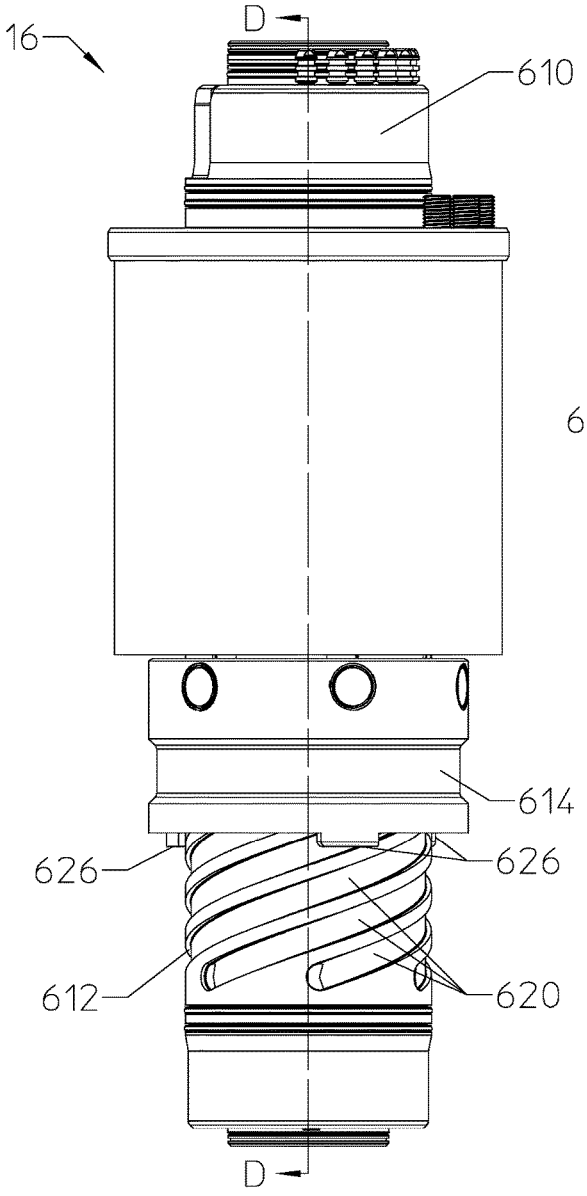
FIGS. 12A and 12B are a perspective view and a cross-sectional view, respectively, of the tubing hanger alignment device of FIGS. 9A-11B in a configuration with the lower body released, in accordance with an embodiment of the present disclosure.
Figure 12B:
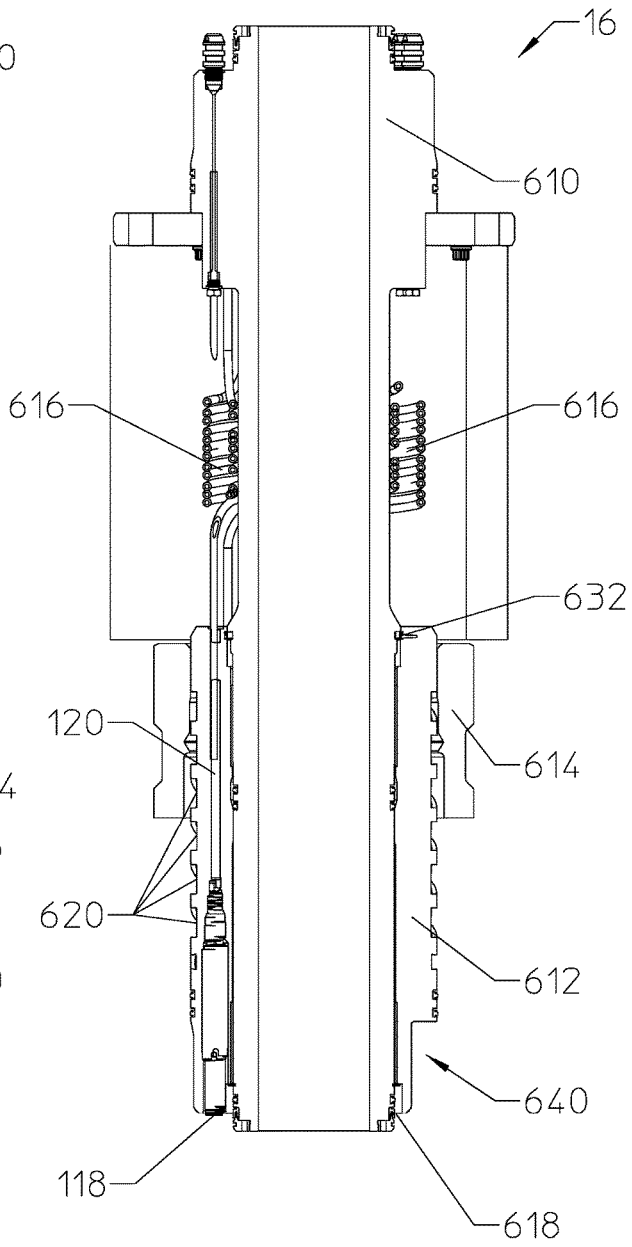

When the outer timing ring 614 reaches the top of the alignment threads 620, the alignment sub 612 and its couplings 118 will be rotationally aligned with the connectors of the tubing hanger, and the pins 622 of the outer timing ring 614 will enter the vertical alignment slots 624. This aligned configuration is shown in FIGS. 11A and 11B. From here, further downward force on the tree and tubing hanger alignment device 16 will cause the alignment sub 612, the production stab sub 610, and the tree to move vertically downward relative to the outer timing ring 614 and the tubing hanger. This position is shown in FIGS. 12A and 12B. In this position, the couplings 118 of the alignment sub 612 are just above the corresponding connectors of the tubing hanger, and the outer timing ring 614 is in a position where it is covering/depressing the actuation buttons 630 at the top of the alignment sub 612. These actuation buttons 630, once depressed, push the split ring 632 radially inward to release the production stab sub 610 so that it can travel longitudinally with respect to the alignment sub 612.

In some embodiments, the alignment sub 612 may be equipped with a final/fine alignment socket 640, and the tubing hanger may be equipped with a corresponding final/fine alignment key. The layout and description of these final/fine alignment features is discussed at length below with reference to final alignment key 232 and final alignment slot 234 of FIG. 14. Similar final/fine alignment features (e.g., alignment slot 640 and a corresponding key on the tubing hanger) may be implemented in the embodiment of FIGS. 9A-9B as well. The final alignment would be made via the alignment slot 640 and corresponding key while the alignment sub 612 is moving vertically downward relative to the outer timing ring 614 engaged with the vertical alignment slots 624.

Figure 13A:
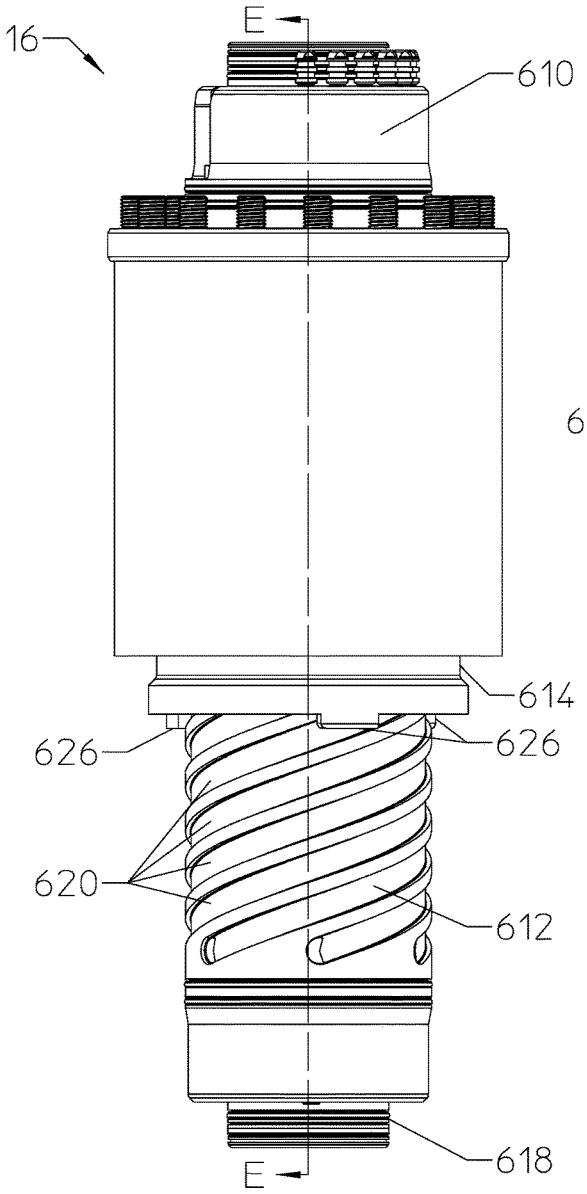
FIGS. 13A and 13B are a perspective view and a cross-sectional view, respectively, of the tubing hanger alignment device of FIGS. 9A-12B in a landed configuration, in accordance with an embodiment of the present disclosure.
Figure 13B:
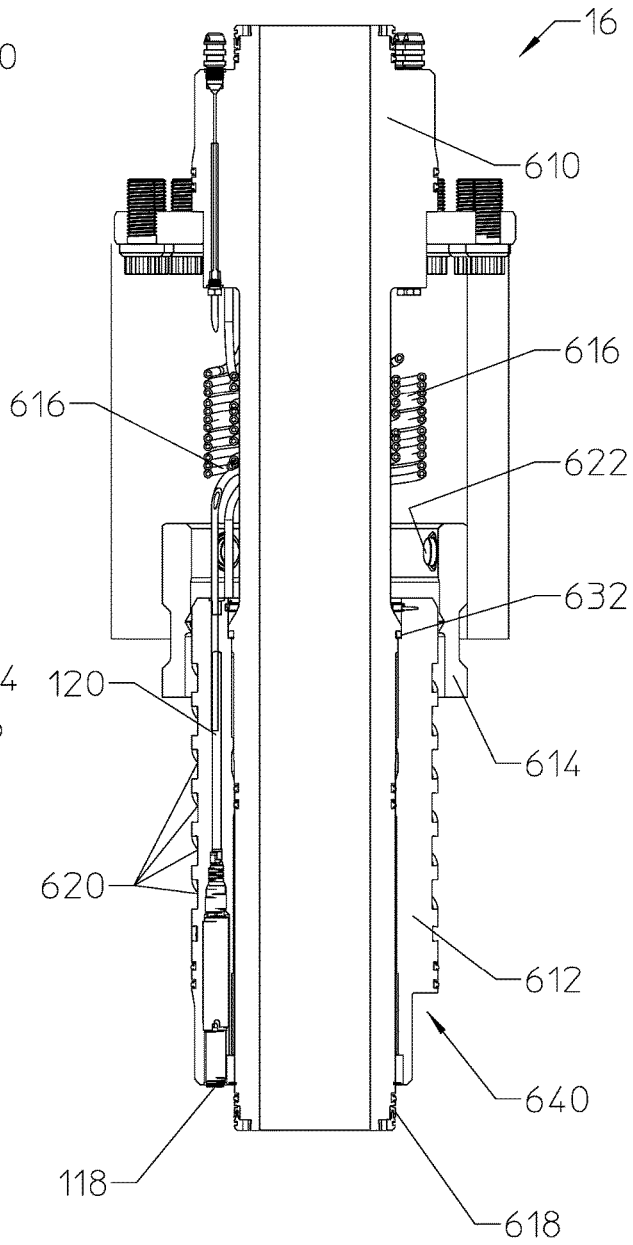

At this point, further lowering of the tree causes the production stab sub 610 to move downward relative to the alignment sub 612, uncovering the seals 618 at the lower end thereof and engaging gallery seals. The production stab sub 610 will move downward, stabbing into the tubing hanger and activating the seals 618 against the tubing hanger interface. The alignment sub 612 may also be lowered a certain amount to complete the stabbing connections between the couplings 118 and the corresponding connectors of the tubing hanger. This brings the tubing hanger alignment device 16 to the fully landed position within the wellhead, as shown in FIGS. 13A and 13B.

The tubing hanger alignment device 16 of FIGS. 9A-13B is similar to the embodiment of the tubing hanger alignment device 16 of FIGS. 7-8C, except for the addition of the outer timing ring 614 used to rotate the alignment sub 612 and to actuate the split ring 632, enabling downward movement of the production stab sub 610 relative to the alignment sub 612. This arrangement, which allows for the downward movement of the production stab sub 610 relative to the alignment sub 612, facilitates protection of the seals 618 at the bottom of the production stab sub 610 during initial lowering of the system through the wellhead.

It should be noted that the embodiments of FIGS. 9A-13B are exemplary and that variations on this system may be used as well. For example, as discussed above with reference to FIGS. 2A-6, different orientations of the components making up the alignment device 16 may be used in other embodiments. The alignment device 16 may include a rotating sub located on the bottom of the assembly while the stationary component is at the top of the assembly. The radial direction in which the orienting profiles are facing may be reversed. Different combinations of orientation profiles may be used, such as two helical components interacting. Other variations on the alignment device 16 will be understood based on the present disclosure.

Figure 15:
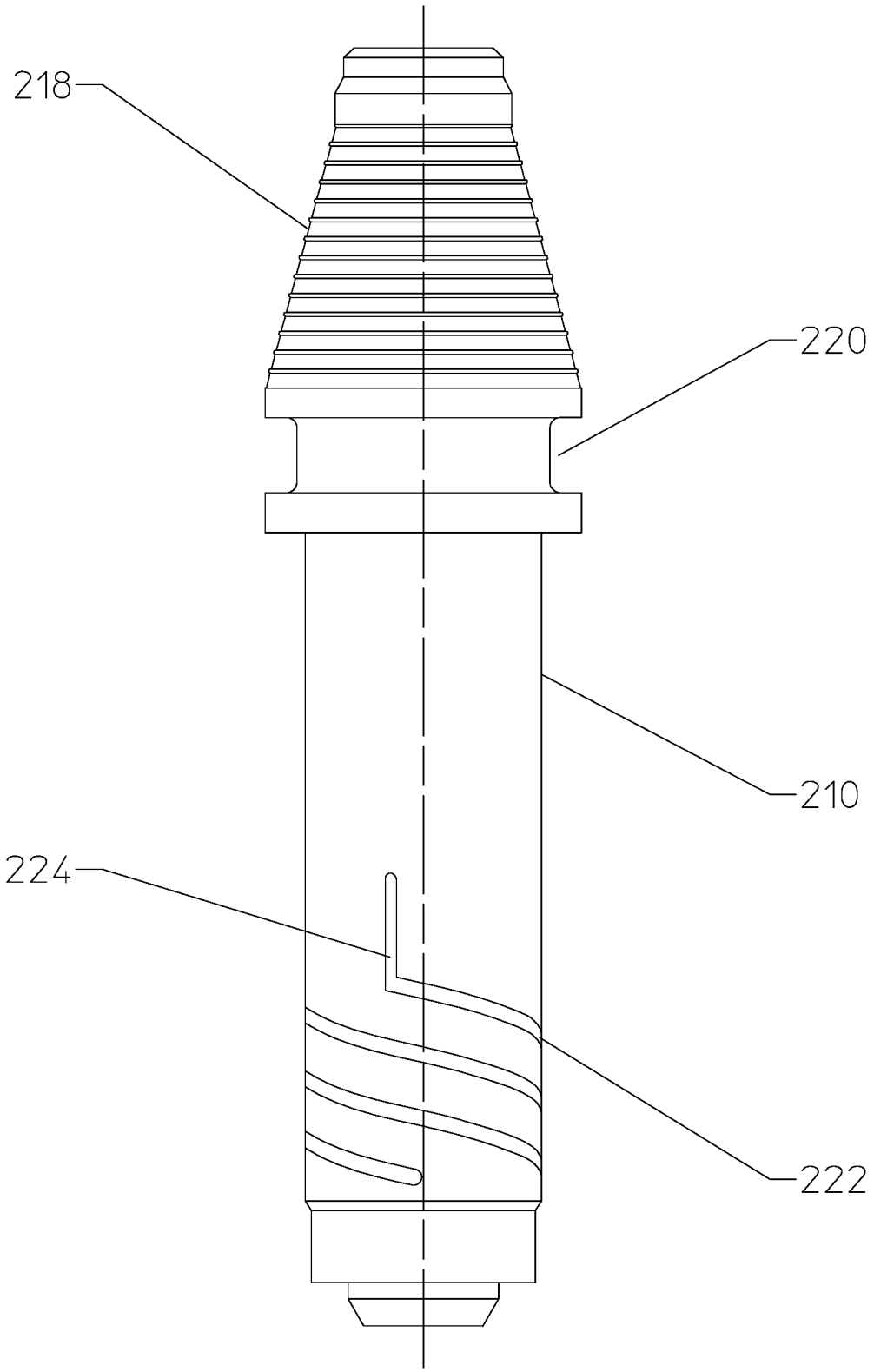
FIG. 15 is a side view of an alignment body used in the tubing hanger alignment device of FIG. 9, in accordance with an embodiment of the present disclosure.

The disclosed tubing hanger alignment device 16 of FIGS. 9A-13B may achieve the goal of aligning the tubing hanger penetrations (i.e., couplings/stabs 32 and 118) independent of the orientation about the longitudinal axis in which the tree 18 is landed. The alignment process is passive. Existing vendor seals, hydraulic couplers, and electrical connectors of the tubing hanger 14 may be utilized in implementations of the disclosed alignment device 16. Existing tree body designs may need some modification to remove and replace existing couplers with conduit connections leading to the conduits 616. Existing tubing hangers may be utilized with only a minor modification to add the keyed features for interfacing with the outer timing ring 614. Existing tubing hanger running tools may be utilized without modification Helical Slot Alignment Mechanism An alignment device 16 having a helical slot mechanism is shown in FIGS. 14 and 15. The alignment device 16 as described below may be a tubing hanger alignment device used to couple a tree to a tubing hanger. However, it will be understood that the disclosed alignment device 16 may be similarly used to couple other types of subsea tubular members as well. The alignment device (hereinafter referred to as "tubing hanger alignment device") 16 of FIG. 14 includes an alignment body 210, a timing ring 212, and a timing hub 214. The arrangement and interaction of these components will now be described.

The alignment body 210 may be a single, solid piece that houses standard type (or actuated type) fluidic (e.g., hydraulic), electric, and/or fiber optic couplings 216 that interface with the corresponding couplings/stabs 32 at a top end of the first subsea tubular member (hereinafter referred to as "tubing hanger") 14. In this embodiment, the alignment body 210 may function as the production stab sub that is coupled directly to the second subsea tubular member (hereinafter referred to as "tree") 18. In other embodiments, however, a separate annular production stab sub captured within the alignment body 210 may be used.

The alignment body 210 may include a fluidic port (not shown) extending therethrough and routed to a fluid (e.g., hydraulic) gallery 218. The fluid gallery 218 is open to and in fluid communication with a fluid (e.g., hydraulic) port (not shown) formed through the tree 18 as well. The fluid gallery 218 is located in an annular space between the tree body 18 and the alignment body 210, and the fluid gallery 218 extends entirely around the circumference of the alignment body 210. The fluid gallery 218 allows for rotation of the alignment body 210 relative to the tree 18 while maintaining fluid communication between the fluid port in the tree body 18 and the fluid port in the alignment body 210.

The alignment body 210 may include electric and/or fiber optic cables (not shown) extending therethrough and routed to an electrical/fiber optic gallery 220. The electric and/or fiber optic cables may be coiled in the electrical/fiber optic gallery 220 between the alignment body 210 and the tree 18. The electric and/or fiber optic cables may extend from the alignment body 210, through the gallery 220, and into the tree body 18. Containing the electric and/or fiber optic cables in a coiled arrangement within the gallery 220 may enable the alignment body 210 to rotate relative to the tree body 18 since the cables are able to flex in response to such movements of the alignment body 210. The cables located within the alignment body 210 may terminate at a series of wet mate electric contacts (couplings 216) on a lower end of the alignment body 210 designed to rotate relative to the tree 18.

The alignment body 210 includes one or more helical slots 222 formed along an outer surface thereof. The helical slot 222 can be seen more clearly in the illustration of FIG. 15. The helical slot 222 drives the alignment body 210 to rotate relative to the tree body 18 as it is lowered with the tree 18. Rotation of the alignment body 210 may stop when the fluidic (e.g., hydraulic), electric, and/or fiber optic couplings 216 are aligned to the couplings/stabs 32 on the tubing hanger 14. The one or more helical slots 222 may each have a straight portion 224 at one end to allow for a non-rotating landing of the alignment body couplings 216 onto the tubing hanger couplings/stabs 32. In other embodiments, the helical slots 222 may not have the straight portion 224 at one end.

The timing hub 214 is coupled to the tubing hanger 14, as shown. The timing hub 214 may be directly coupled to the tubing hanger 14 via an attachment mechanism such as a bolt or screw, or the timing hub 214 may be formed integral to the tubing hanger 14. The timing hub 214 may include specific keying features 226 formed on an upwardly facing surface thereof. These keying features 226 on the timing hub 214 are designed to capture the timing ring 212 when the ring 212 is clocked to a unique position and orientation relative to the tubing hanger 14. The keying features 226 on the timing hub 214 may include slots or holes formed on the upper face of the timing hub 214. The keying features 226 may be unevenly spaced from each other around the circumference of the timing hub 214, unevenly spaced in a radial direction from a longitudinal axis of the timing hub, extending different depths in the longitudinal direction, having different shapes in a plane perpendicular to the longitudinal axis, or a combination thereof. The timing ring 212 may include complementary keying features 228 designed to be received directly into the timing hub 214. The keying features 228 extending from the timing ring 212 may be arranged in a similar unevenly positioned, shaped and/or sized manner. The illustrated timing hub 214 includes timed slots machined on the upper face thereof. These slots (226) are positioned such that only one clocked alignment is possible between the timing ring 212 and the timing hub 214. That is, the timing ring 212 will not lock into the timing hub 214 via engagement by the keying features 226 until the timing ring 212 has rotated to a position relative to the timing hub 214 where the features 228 of the timing ring 212 are received into engagement with the corresponding keying features 226 of the timing hub 214.

The timing ring 212 may be attached to the alignment body 210 via one or more alignment pins 230 that land in one or more corresponding helical slots 222 of the alignment body 210. As mentioned above, the timing ring 212 may include uniquely clocked features 228 that interface with the upper face of the timing hub 214. During lowering of the tree 18 (along with the attached alignment body 210 and timing ring 212), the timing ring 212 may land on the timing hub 214. Once landed, continued lowering of the tree body 18 into the wellhead 12 causes the timing ring 212 to rotate until it is stopped by the timing hub 214 and received into mating engagement with the keying features 226 of the timing hub 214. Once the timing ring 212 has been stopped in the timing hub 214, continued lowering of the tree 18 may cause the alignment body 210 to rotate relative to the tree 18 via movement of the alignment pin 230 along the helical slot 222 of the alignment body 210. This rotation will continue until the couplings 216 of the alignment body 210 are aligned with the couplings 32 on the tubing hanger 14.

Once aligned in this manner, the alignment pin(s) 230 coupled to the timing ring 212 may move out of the helical slot 222 and into the straight vertical portion 224. In some embodiments, the alignment body 210 may engage with the tubing hanger 14 via a final alignment key 232 received in a final alignment slot 234. The final alignment slot 234 may be formed in the alignment body 210, and the final alignment key 232 may extend vertically from an engagement surface of the tubing hanger 14. In other embodiments, this arrangement may be reversed, such that the final alignment key extends from the alignment body 210 so as to be received into a final alignment slot formed in the tubing hanger 14. The final alignment key 232 and slot 234 may provide protection to the couplers 216 and 32 and increase machining tolerances of the helical slot 222, the vertical portion of the slot 224, the alignment pins 230, and the keying features of the timing ring 212 and hub 214.

A general description of a method for operating the tubing hanger alignment device 16 of FIGS. 14 and 15 will now be described. The alignment body 210 may be installed into a lower portion of the tree 18, similar to the way a production stab sub is installed in a traditional tree. The timing ring 212 may be installed onto the alignment body 210. Specifically, the timing ring 212 may be disposed around an outer circumference of the alignment body 210, and the alignment pin(s) 230 may be attached directly to the timing ring 212 and extended into the helical slot 222 formed in the alignment body 210.

During construction of the tubing hanger assembly, the timing hub 214 may be installed onto the tubing hanger 14. Specifically, the timing hub 214 may be connected to an upwardly extending portion of the tubing hanger 14 so as to provide a place for seating the timing ring 212 as the tree 18 and alignment body 210 are lowered relative to the tubing hanger 14. The tubing hanger 14 with the connected timing hub 214 may be run in any orientation relative to the wellhead 12 and locked into place within the wellhead 12.

During landing of the tree 18 on the wellhead 12, the timing ring 212 on the alignment body 210 may first land on the timing hub 214. Depending on the initial orientation of the alignment body 210 relative to the tubing hanger 14 and timing hub 214, the timing ring 212 may or may not land directly into a locked position within the timing hub 214. Assuming the timing ring 212 is not in full engagement with the keying features 226 of the timing hub 214 at first, further lowering of the tree 18 may cause the timing ring 212 to rotate relative to the alignment body 210. This rotation of the timing ring 212 relative to the alignment body 310 may be guided by the alignment pin 230 in the helical slot 222. After some rotation, the timing ring 212 may be properly oriented to drop into the slots or other features on the timing hub 214. After dropping into the features on the timing hub 214, the timing ring 212 can no longer rotate with respect to the timing hub 214 and tubing hanger 14.

Lowering the tree 18 further may now cause the alignment body 210 to rotate relative to the tree 18, guided by the helical slot 230 interacting with the stationary alignment pin 222 extending from the timing ring 212. This guiding of the alignment body via the clocked timing ring 212 will cause the alignment body 210 to rotate and align with the tubing hanger 14. Once the alignment body 210 is properly aligned with the tubing hanger 14, the final alignment key 232 may be received into the final alignment slot 234 to finalize the rotational alignment of the couplers 216 on the alignment body 210 to those on the tubing hanger 14.

The tree 18 and alignment body 210 may then be landed and locked to the wellhead 12. All couplings between the alignment body 210 and the tubing hanger 14 will be engaged at this point. The fluidic, electric, and/or fiber optic couplings between the tree 18 and the tubing hanger 14 will then be tested to ensure a proper connection has been made.

It should be noted that the embodiments of FIGS. 14 and 15 are exemplary and that variations on this system may be used as well. For example, as discussed above with reference to FIGS. 2A-6, different orientations of the components making up the alignment device 16 may be used in other embodiments. The alignment device 16 may include a rotating sub located on the bottom of the assembly while the stationary component is at the top of the assembly. The radial direction in which the orienting profiles are facing may be reversed. Different combinations of orientation profiles may be used, such as two helical components interacting. Other variations on the alignment device 16 will be understood based on the present disclosure.

The disclosed tubing hanger alignment device 16 of FIGS. 14 and 15 may achieve the goal of aligning the tubing hanger penetrations (i.e., couplings/stabs 32 and 216) independent of the orientation about the longitudinal axis in which the tree 18 is landed. The alignment process is passive and resets without manual intervention subsea or on the surface. Existing vendor seals, fluidic (e.g., hydraulic) couplers, and electrical connectors of the tubing hanger 14 may be utilized in implementations of the disclosed alignment device 16. Existing tree body designs may need some modification to add a gallery seal for the alignment body 210 and/or production stab integration into the lower tree body. Existing tubing hangers may be utilized with only a minor modification to the actuator trap plate. Existing tubing hanger running tools may be utilized without modification.

Torsional Spring Alignment Mechanism

Figure 16:
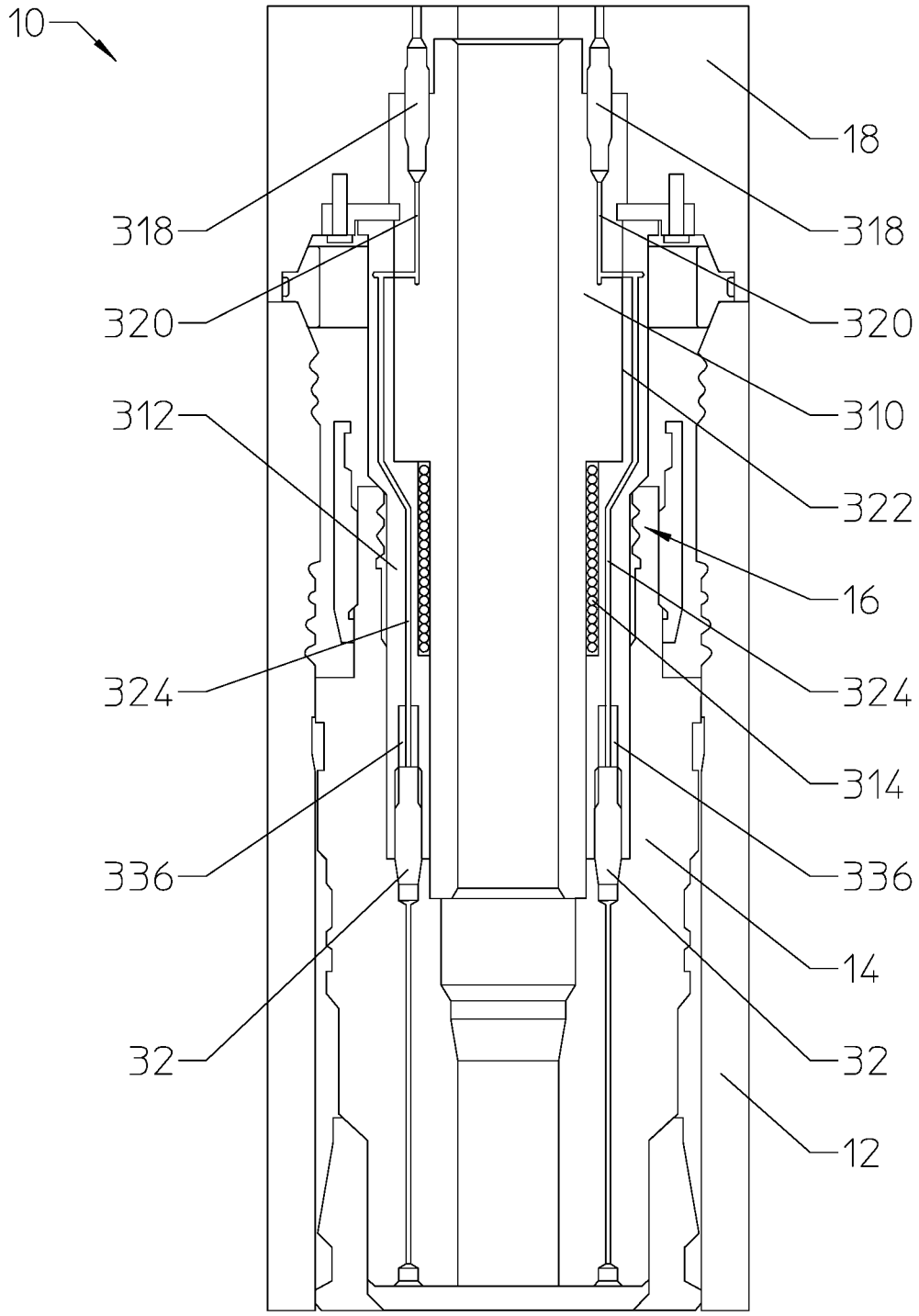
FIG. 16 is a cross-sectional view of a production system comprising a tubing hanger alignment device with a torsional spring alignment mechanism, in accordance with an embodiment of the present disclosure.
Figure 17:
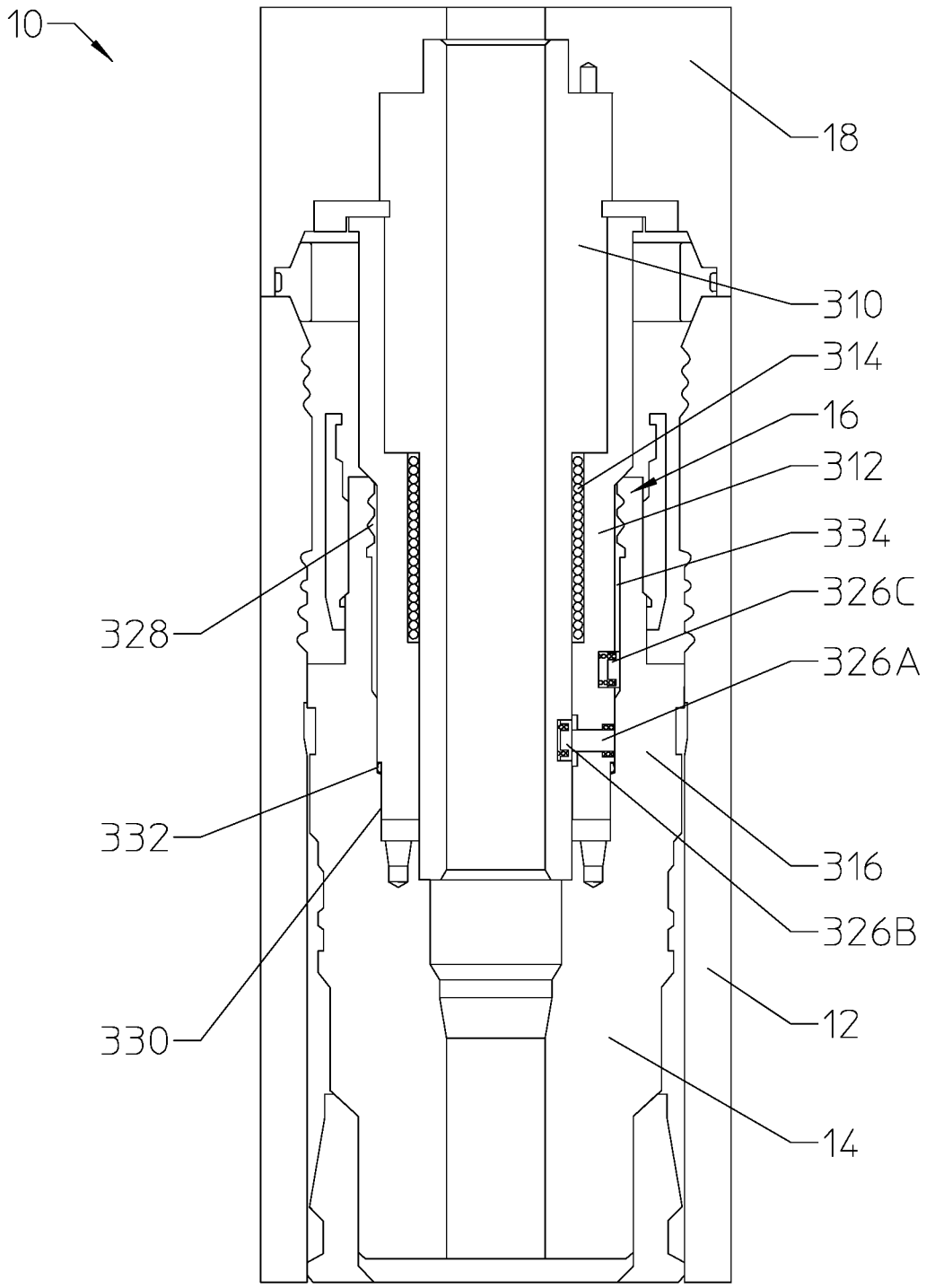
FIG. 17 is another cross-sectional view of the production system of FIG. 16, taken along a different cross section, in accordance with an embodiment of the present disclosure.
Figure 18:
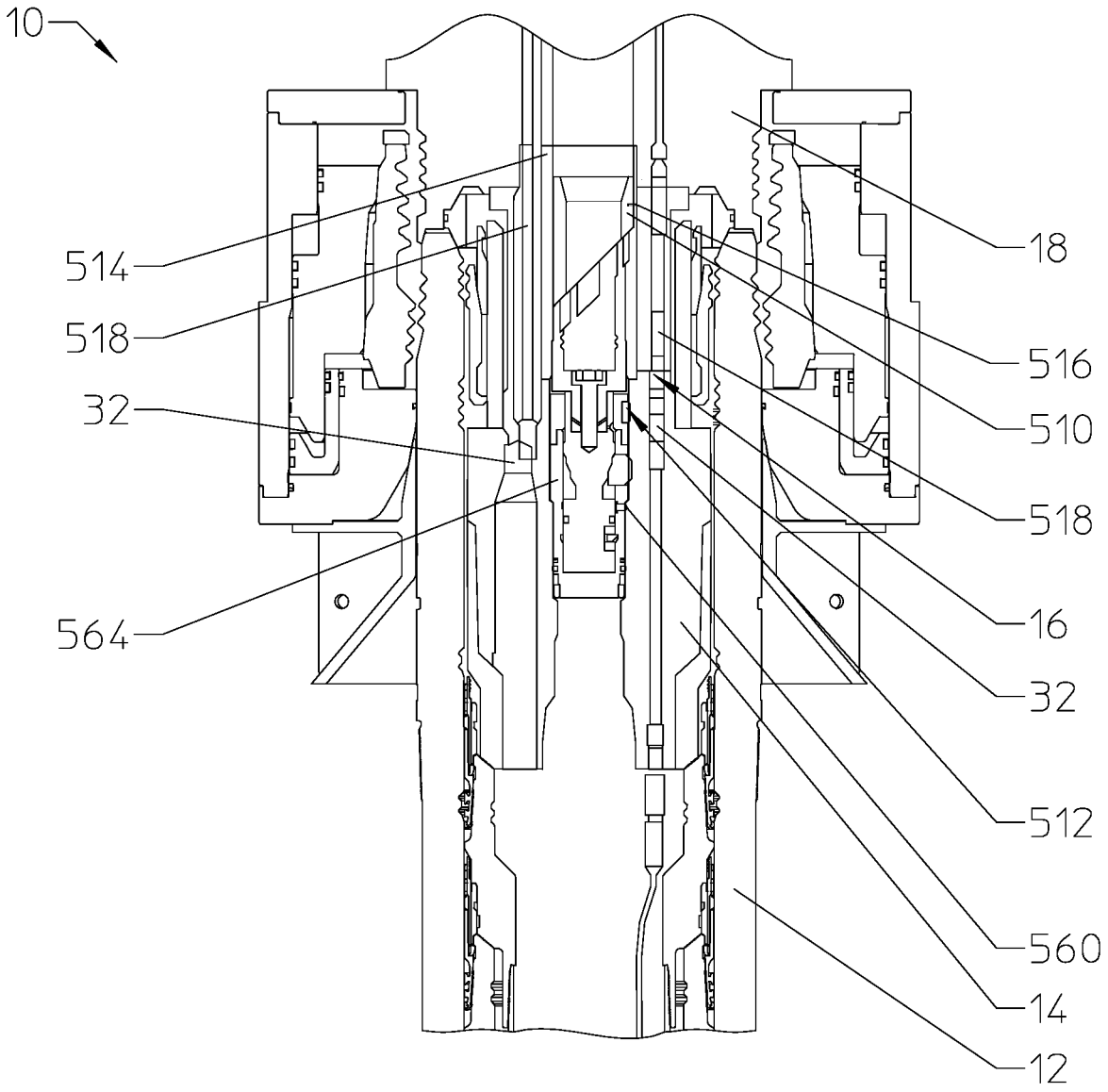
FIG. 18 is a partial cross-sectional view of a production system comprising a tubing hanger alignment device with a plug-based alignment mechanism, in accordance with an embodiment of the present disclosure.

An alignment device 16 having a torsional spring mechanism is shown in FIGS. 16 and 17. The alignment device 16 as described below may be a tubing hanger alignment device used to couple a tree to a tubing hanger. However, it will be understood that the disclosed alignment device 16 may be similarly used to couple other types of subsea tubular members as well. The alignment device (hereinafter referred to as "tubing hanger alignment device") 16 of FIGS. 16 and 17 includes an upper body 310, a lower body 312, a torsional spring 314, and a trigger assembly 316. The arrangement and interaction of these components will now be described.

The upper body 310 may be a solid piece that houses standard fluidic (e.g., hydraulic), electric, and/or fiber optic couplings 318 that interface with the bottom of the second subsea tubular member (hereinafter referred to as "tree") 18 to connect fluid ports and/or cables in the tree 18 to those in the upper body 310. In this embodiment, the upper body 310 may function as a production stab sub that is coupled directly to the tree body 18 or that is integral with the tree 18. The lower body 312 may be generally disposed around an outer diameter of the upper body 310, as shown. The lower body 312 may be locked in a particular rotational orientation with respect to the upper body 310 prior to release of the lower body 312 via the trigger assembly 316.

The upper body 310 may include one or more fluid ports 320 extending therethrough and routed to a fluid (e.g., hydraulic) gallery 322. The fluid gallery 322 is open to and in fluid communication with one or more fluid (e.g., hydraulic) ports 324 formed through the lower body 312 as well. The fluid gallery 322 may be located in an annular space located between the upper body 310 and the lower body 312, or the fluid gallery 322 may be located entirely within the lower body 312 as shown. The fluid gallery 322 may extend entirely around the circumference of the upper body 310. The fluid gallery 322 allows for rotation of the lower body 312 relative to the upper body 310 while maintaining fluid communication from the between the fluid port 320 in the upper body 310 and the fluid port 324 in the lower body 312.

The electric couplings (318) may be wired through the upper body 310 to a series of wet mate electric contacts (not shown) that sit between the upper body 310 and the lower body 312. These electric contacts may allow rotation of the lower body 312 with respect to the upper body 310. The upper body 310 may be mounted directly to the tree 18 (e.g., via threads, bolts, or other attachment features) or be integral with the tree 18 such that the upper body 310 is not rotatable with respect to the tree body 18. As shown in FIG. 17, the upper body 310 may house at least a portion of the trigger assembly 316.

The torsional spring 314 is disposed in an annular space between the upper body 310 and the lower body 312. The torsional spring 314 may be wound during assembly of the tubing hanger alignment device 16 and locked into place via the trigger assembly 316. The torsional spring 314 may be released from its wound position at a desired time in response to actuation by the trigger assembly 316. Such release of the torsional spring 314 may cause the lower body 312 to rotate with respect to the upper body 310.

As shown in FIG. 17, the trigger assembly 316 may include a series of spring loaded keys 326A, 326B, and 326C. It should be noted, however, that other possible arrangements of the trigger assembly 316 may be utilized in other embodiments.

The first pair of spring loaded keys 326A and 326B may together function as a trigger for releasing the torsional spring 314 to rotate the lower body 312 once tripped out to a specific elevation within the tubing hanger 14. The spring loaded key 326A may function as a trip key for the trigger assembly 316. This trip key 326A may be attached to the lower body 312 and biased in a radially outward direction. Before actuation of the trigger assembly 316, the trip key 326A may extend at least partially outward from the outer diameter of the lower body 312.

The spring loaded key 326B may function as a retention key for the triggering mechanism 316. This retention key 326B may be attached to the upper body 310 and biased in a radially outward direction. Before actuation of the trigger assembly 316, the retention key 326B may extend outward from the outer diameter of the upper body 310 into a recess formed along an inner diameter of the lower body 312. This retention key 326B extending into the recess in the lower body 312 may hold the lower body 312 in a particular orientation relative to the upper body 310 during the initial landing of the tree 18 and before the release of the spring 314. As shown, the retention key 326B extending into the recess of the lower body 312 may be aligned in a radial direction with the trip key 326A in the lower body 312.

As the tree 18 (along with the upper body 310 and lower body 312) is lowered toward the wellhead 12, the upper body 310 and lower body 312 are received through an initial opening 328 of the tubing hanger 14. This initial opening 328 may have a bore with a diameter that is slightly larger than the outer diameter of the lower body 312. As such, the trip key 326A is able to stay in the outwardly extended position. As the tree 18 continues lowering, the upper body 310 and lower body 312 may pass from the opening 328 into a portion 330 of the first subsea tubular member (hereinafter referred to as "tubing hanger") 14 having a relative smaller diameter bore that is just large enough to receive the lower body 312. The tubing hanger 14 may feature a trip shoulder 332 at the boundary between the larger bore initial opening 328 and the smaller bore portion 330. As the lower body 312 passes into the smaller bore portion 330 of the tubing hanger 14, the trip key 326A may be brought into contact with the trip shoulder 332, which presses the trip key 326A radially inward. This radially inward movement of the trip key 326A simultaneously forces the retention key 326B out of the recess in the lower body 312 such that the retention key 326B no longer holds the lower body 312 in rotational alignment with the upper body 310. This allows the lower body 312 to now rotate relative to the upper body 310 as urged by the previously set torsional spring 314.

The final spring loaded key 326C may function as an alignment key to stop rotation of the lower body 312 when the lower body 312 reaches the proper orientation relative to the tubing hanger 14. The alignment key 326C may be attached to the lower body 310 and biased in a radially outward direction. During rotation of the lower body 310 relative to the upper body 312 in response to force exerted by the torsional spring 314, the alignment key 326C may be held in place within a recess in the lower body 312 by the inner wall of the relatively smaller bore portion 330 of the tubing hanger 14. The lower body 312 may rotate until the alignment key 326C reaches a position that is rotationally aligned with a slot 334 formed in the inner diameter of the tubing hanger 14. The slot 334 may be vertically oriented, as shown. Once the alignment key 326C is aligned with the slot 334, the key 326C is biased radially outward into the slot 334, thereby halting rotation of the lower body 312 at a desired position relative to the tubing hanger 14.

The lower body 312 may be a solid piece that houses fluidic (e.g., hydraulic), electric, and/or fiber optic couplings 336 designed to interface directly with those couplings 32 on the tubing hanger 14. The couplings 336 may be a standard design, or they may be an actuated design so that they can make up linear differences in elevations between the bottom of the lower body 312 and the top of the tubing hanger 14. As mentioned above, the lower body 312 may include one or more fluid ports 324 routed to the fluid gallery 322 so as to allow rotation of the lower body 312 relative to the upper body 310. Electric couplings at the bottom of the lower body 312 may be wired to a series of wet mate electric contacts (not shown) that sit between the upper body 310 and the lower body 312. These electric contacts may allow rotation of the lower body 312 with respect to the upper body 310. The lower body 312 may also house the alignment key 326C and the retention key 326B of the trigger assembly 316.

In the embodiments of FIGS. 7-17, fiber optic communications between fiber optic cables in the tubing hanger 14 and tree 18 may be converted to an electric signal inside the tubing hanger alignment device 16 and then reconverted to fiber optic (light) communication on the output side of the tubing hanger alignment device 16.

A general description of a method for operating the tubing hanger alignment device 16 of FIGS. 16 and 17 will now be described. The upper body 310 (along with the attached lower body 312, torsional spring 314, and trigger assembly 316) may be installed into a lower portion of the tree 18, similar to the way a production stab sub is installed in a traditional tree. During assembly, the torsional spring 314 is wound and the trigger assembly 316 is set, effectively storing rotational energy in the alignment assembly.

The tubing hanger 14 may be run in any orientation and locked into place within the wellhead 12. The tree 18 (with connected alignment device 16) may then be run and oriented into a desired location prior to landing. While landing the tree 18, the trigger assembly 316 of the alignment device 16 trips out on the trip shoulder 332 in the inner diameter of the tubing hanger 14 to release the spring 314, as described at length above. Once the torsional spring 314 is released, the lower body 312 is able to rotate until the spring loaded alignment key 326C enters the mating slot 334 in the inner diameter of the tubing hanger 14. Once the lower body 312 is rotationally locked into the alignment slot 334, the fluidic, electric, and/or fiber optic couplings 336 may be engaged with the corresponding couplings 32 of the tubing hanger 14. The fluidic, electric, and/or fiber optic couplings between the tree 18 and the tubing hanger 14 will then be tested to ensure a proper connection has been made.

It should be noted that the embodiment of FIGS. 16 and 17 are exemplary and that variations on this system may be used as well. For example, as discussed above with reference to FIGS. 2A-6, different orientations of the components making up the alignment device 16 may be used in other embodiments. The alignment device 16 may include a rotating sub located on the bottom of the assembly while the stationary component is at the top of the assembly. The radial direction in which the orienting profiles are facing may be reversed. Different combinations of orientation profiles may be used, such as two helical components interacting or a helix interacting with a generally rectangular key having a tilted surface at one end. Other variations on the alignment device 16 will be understood based on the disclosure provided herein.

The disclosed tubing hanger alignment device 16 of FIGS. 16 and 17 may achieve the goal of aligning the tubing hanger penetrations (i.e., couplings/stabs 32 and 336) independent of the orientation about the longitudinal axis in which the tree 18 is landed. Existing tree body designs do not have to be modified to accommodate the disclosed tubing hanger alignment device 16. Existing tubing hangers may be utilized with only a minor modification to add the alignment slot 334, but otherwise this alignment device 16 utilizes standard interfaces to the tree 18 and the tubing hanger 14.

Plug-based Alignment Mechanism

An alignment device 16 having a plug-based alignment mechanism is shown in FIGS. 18-23. The alignment device 16 as described below may be a tubing hanger alignment device used to couple a tree to a tubing hanger. However, it will be understood that the disclosed alignment device 16 may be similarly used to couple other types of subsea tubular members as well. The alignment device (referred to hereinafter as "tubing hanger alignment device") 16 of FIG. 18 includes an alignment sleeve 510 and a plug assembly 512, among other things. The arrangement and interaction of these components will now be described.

The alignment sleeve 510 may be a solid piece that is located within and interfaces with an inner surface of a main bore of the second subsea tubular member (hereinafter referred to as "tree") 18. The alignment sleeve 510 may be directly coupled to a production stab sub 514 of the tree 18 and held in place relative to the sub 514 via a shear pin 516 or other type of shear mechanism. The tree 18 may include standard fluidic (e.g., hydraulic), electric, and/or fiber optic couplings 518 designed to be communicatively coupled with the couplings 32 on the first subsea tubular member (hereinafter referred to as "tubing hanger") 14.

Turning to FIGS. 19-23, the plug assembly 512 may include an inner plug body 520, an outer plug body 522, an orientation sleeve 524, a retaining bolt 526, a locking mechanism 528, an actuation mechanism 530, a seal or packing element 532, a tapered gear/spline 534, an anti-rotation key 535, and shear pins 536 and 538. The plug assembly 512 may be entirely separate from the tree 18 and the tubing hanger 14 and may be utilized to orient the tree 18 relative to the tubing hanger 14 after being placed, locked, and/or adjusted within a bore of the tubing hanger 14.

The inner plug body 520 is generally disposed within the outer plug body 522, as shown. The outer plug body 522 may include two components that are connected (e.g., via threads 540) together to define a cavity 542 within which the inner body 520 is partially captured. A distal portion 544 of the inner body 520 may extend outside the cavity 542 in one direction, and this distal portion 544 may have a bore formed therethrough. A connecting portion 546 of the orientation sleeve 524 may be received within the bore in the distal portion 544 of the inner plug body 520, and the retaining bolt 526 may be positioned through the connecting portion 546 of the orientation sleeve 524 and coupled directly to the inner body 520 via threads. As such, the retaining bolt 526 may couple the orientation sleeve 524 to the inner plug body 520. It should be noted that other arrangements of an orientation sleeve and one or more plug bodies may be utilized in other embodiments of the disclosed plug assembly 512.

The locking mechanism 528 may include a set of locking dogs or a split ring, or any other type of lock as known to one of ordinary skill in the art. The locking mechanism 528 may be disposed at least partially around an outer edge of the inner body 520 and may extend into and/or through at least one slot 548 formed radially through the outer body 522. This allows the locking mechanism 528 to be actuated into locking engagement with a radially inner surface of the tubing hanger 14 so as to lock the plug assembly 512 in place within the tubing hanger 14. A generally sloped surface 550 forming a radially outer edge of the inner plug body 520 may be used to hold the locking mechanism 528 into its extended locking position until it is time to remove the plug assembly 512 from the tubing hanger 14.

The actuation mechanism 530 may be used to actuate the plug and thereby set the locking mechanism 528 within the tubing hanger 14. The actuation mechanism 530 may include an actuation button 552 and a split ring 554 (or similar type of actuation ring). The actuation mechanism 530 may function as follows. The split ring 554 may be biased in a radially outward direction. When the plug assembly 512 is being run in, the split ring 554 may be held within two opposing recesses 556 and 558 formed in a radially outer surface of the inner body 520 and a radially inner surface of the outer body 522, respectively. In this position, the split ring 554 may generally prevent the inner body 520 and outer body 522 from moving relative to each other in an axial direction. The actuation button 552 may be positioned through the wall of the outer body 522 and have a flat surface extending into the recess 558 of the outer body 522.

When the plug assembly 512 is run into the tubing hanger 14, a shoulder 560 (FIG. 18) on the inner edge of the tubing hanger 14 may abut the actuation button 552, forcing the button 552 radially inward such that the button 552 compresses the split ring 554 fully into the recess 556 of the inner plug body 520. With the split ring 554 in this collapsed position, the inner body 520 is free to move axially downward relative to the outer body 522 in response to setting pressure placed on the plug assembly 512 by a running tool 574. This downward movement causes the sloped surface 550 of the inner body 520 to push radially outward against the locking mechanism 528, thereby setting the locking mechanism 528 into a locking groove 564 (FIG. 18) on the internal surface of the tubing hanger 14. The downward movement of the inner body 520 may also set the spring loaded shear pin 536 into a recess formed along the inner surface of the outer plug body 522. This shear pin 536 may keep the inner plug body 520 in the same axial position relative to the outer plug body 522 to maintain the plug assembly 512 in this locked position within the tubing hanger 14 until it is time to remove the plug assembly 512.

The seal or packing element 532 located at the lower end of the outer plug body 522 is used to provide a high pressure seal within the bore of the tubing hanger 14. When the plug assembly 512 enters the locked position, the seal or packing element 532 is energized. The seal or packing element 532 may seal the tubing hanger 14 so that the BOP can be removed from the wellhead, and replaced by the tree 18, while maintaining two high pressure seals in the system (one via a downhole safety valve and a backup via the plug 512).

The tapered gear/spline 534 may be disposed at the intersection of the connecting portion 546 of the orientation sleeve 524 and the inner body 520. The tapered gear/spline mechanism 534 may include threads that enable an incremental adjustment of the orientation (e.g., by 1 degree, 2 degrees, or some other amount) of the orientation sleeve 524 about the longitudinal axis relative to the rest of the plug assembly 512. The outer plug body 522 may be held rotationally in place via the anti-rotation key 535 fitted in a corresponding slot of the tubing hanger 14 when the plug assembly 512 is in the locked position. At this point, a running and/or adjustment tool disposed inside and engaged with running/adjustment grooves 566 of the orientation sleeve 524 may pick up the orientation sleeve 524 and rotate the orientation sleeve 524 relative to the outer and inner bodies of the plug. This rotation may be performed in an incremental fashion in accordance with the relative size and number of threads present in the tapered gear/spline mechanism 534. The retaining bolt 526 may be sized and positioned such that the orientation sleeve 524 can move axially back and forth as needed during this adjustment process. The orientation of the sleeve 524 is so that the sleeve 524 can be brought into a desired rotational alignment with respect to the wellhead 12. An ROV based tool or some other type of tool may be used to determine how far the orientation sleeve 524 has been adjusted within the wellhead.

The orientation sleeve 524 includes an orientation profile 568 formed along a distal end of the orientation sleeve 524. The orientation profile 568 may include, for example, a slanted end surface and a series of different sized slots 570 extending through the orientation sleeve 524. The alignment sleeve 510 on the tree 18 may feature a complementary profile 572 designed to fit into the orientation profile 568 of the orientation sleeve 524 when the alignment sleeve 510 (and consequently tree 18) are brought into a desired alignment with the orientation sleeve 524. The slots 50 may each have different widths so as to only allow mating engagement of the alignment sleeve 510 with the orientation sleeve 524 in a single orientation of the parts relative to each other. The alignment sleeve 510 may rotate until it is brought into this desired orientation. In this orientation, the couplings 518 on the tree 18 will be directly aligned with the couplings 32 on the tubing hanger 14. The slots 570 may be elongated in a vertical direction, as shown, so that the tree couplings 518 can be brought into the correct alignment with the tubing hanger couplings 32 first and then be lowered directly downward to form a mating connection.

It should be noted that other types or arrangements of an orientation profile 568 on the orientation sleeve 524 and complementary profile 572 on the alignment sleeve 510 may be utilized in other embodiments. For example, the orientation profile 568 may be a helix and the alignment sleeve 572 may include a pin designed to be received into the helix and directed therethrough until the tree 18 is brought into alignment and a mating connection with the tubing hanger 14. In other embodiments, the orientation profile 568 may have a helical shape and the alignment sleeve 572 may have a complementary helical shape designed to be received into the orientation profile 568 and directed therethrough until the tree 18 is aligned with the tubing hanger 14.

A general description of a method for operating the tubing hanger alignment device 16 of FIGS. 18-23 will now be described. The tubing hanger 14 may be run in the wellhead 12 through the BOP while the BOP is in place. The plug assembly 512 may then be lowered through the wellhead 12 and into the bore of the tubing hanger 14. The BOP is removed only after the plug assembly 512 is installed, and the plug assembly 512 remains in place until the tree 18 has been landed. After the tree 18 is landed, the plug assembly 512 may be removed and reused.

Figure 19:
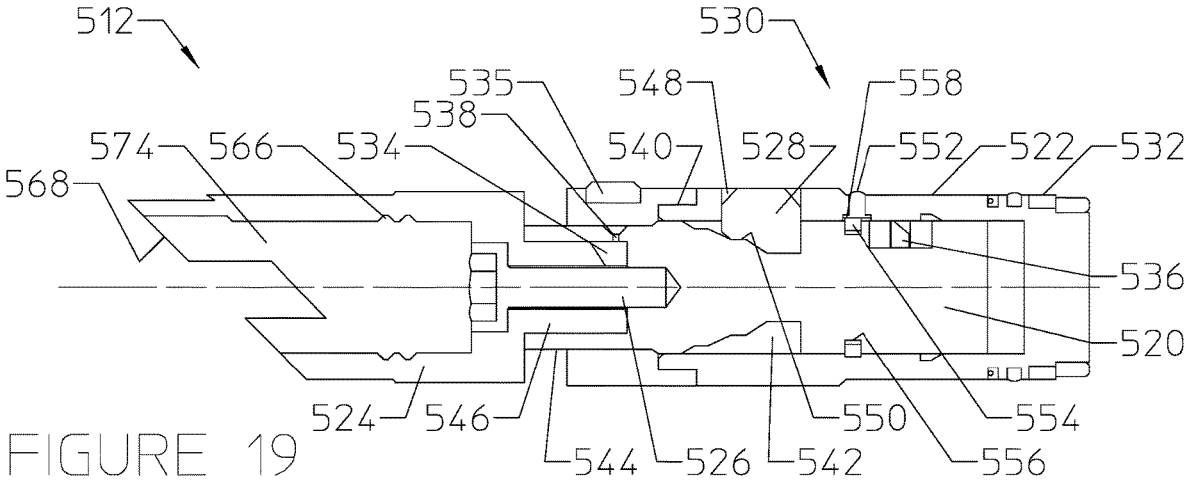
FIG. 19 is a cross-sectional view of a plug assembly used in the tubing hanger alignment device of FIG. 18 in a running position, in accordance with an embodiment of the present disclosure.

FIG. 19 shows the plug assembly 512 during the running operation. As mentioned above, while being run in, the locking mechanism 528 is in the collapsed state, the actuation mechanism 530 is unactuated, and the shear pin 536 is not engaged. A running tool 574 is positioned within the bore of the orientation sleeve 524 and connected to the orientation sleeve 524 via the running/adjustment grooves 566. As the running tool 574 lowers the plug assembly 512 into the tubing hanger 14, the running tool 574 may rotate the plug assembly 512 until it reaches an orientation where the anti-rotation key 535 is positioned in the corresponding slot of the tubing hanger 14.

Figure 20:
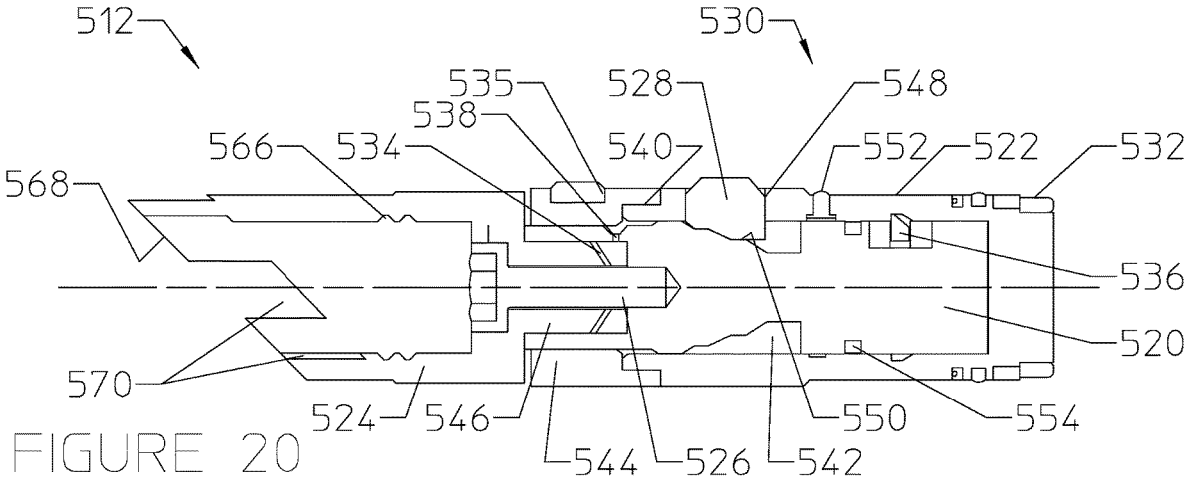
FIG. 20 is a cross-sectional view of the plug assembly of FIG. 19 being locked into a tubing hanger, in accordance with an embodiment of the present disclosure.

Further lowering of the plug assembly 512 will cause the plug assembly 512 to lock into the tubing hanger 14, as shown in FIG. 20. The shoulder 560 on the tubing hanger 14 may press against the actuation button 552, actuating the locking mechanism 528 so that the split ring 554 is received into the recess 556 of the inner body 520 and the inner body 520 moves downward relative to the outer body 522. The shear pin 536 may spring outward into the recess formed in the outer plug body 522 as the inner plug body 520 moves downward. As a result, the plug assembly 512 is locked in the tubing hanger 14. The seal or packing element 532 may be engaged with the inner diameter of the tubing hanger bore so as to provide a back-up for the downhole safety valve once the BOP is removed. The anti-rotation key 535 located in the slot of the tubing hanger 14 prevents the seal or packing element 532 from rotating.

Figure 21:
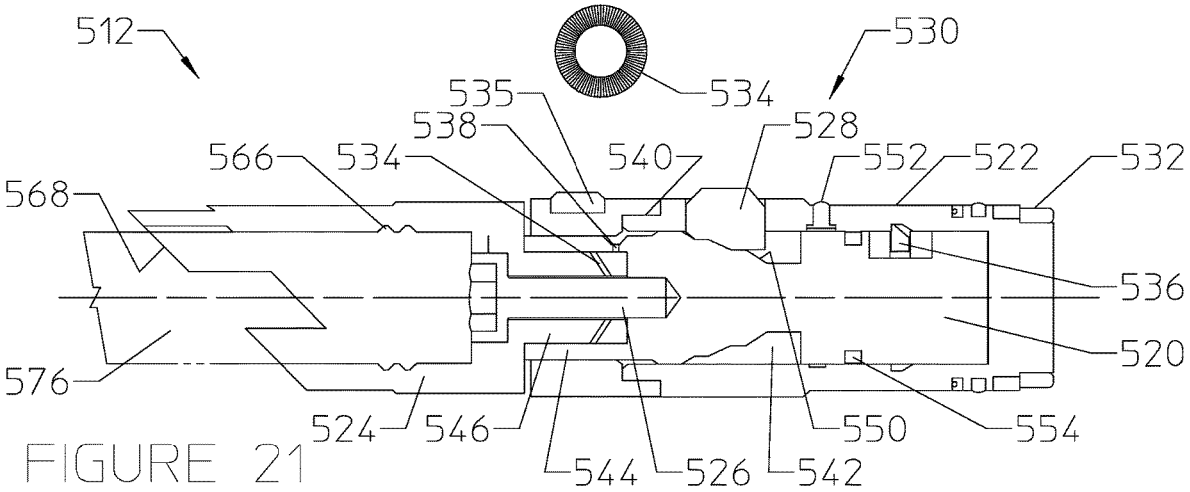
FIG. 21 is a cross-sectional view of the plug assembly of FIGS. 19 and 20 with an alignment sleeve being adjusted, in accordance with an embodiment of the present disclosure.
Figure 22:
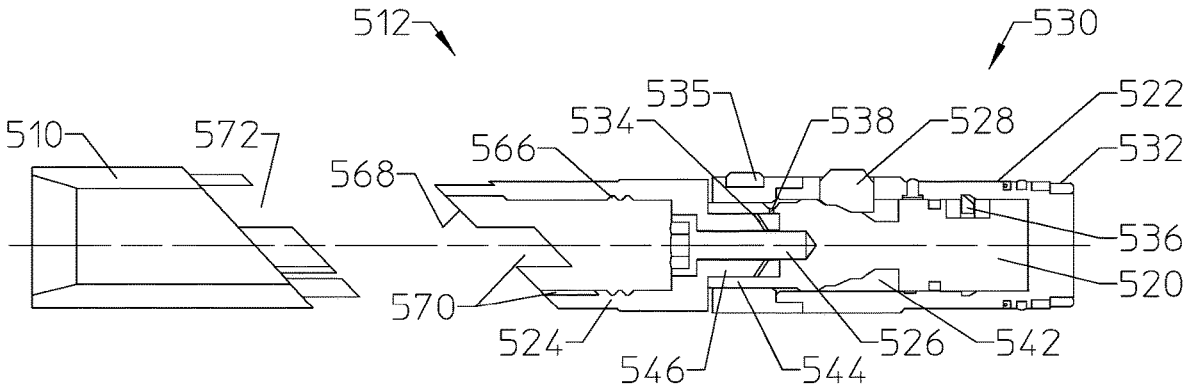
FIG. 22 is a cross-sectional view of a tree component being landed on the plug assembly of FIGS. 19-21, in accordance with an embodiment of the present disclosure.
Figure 23:
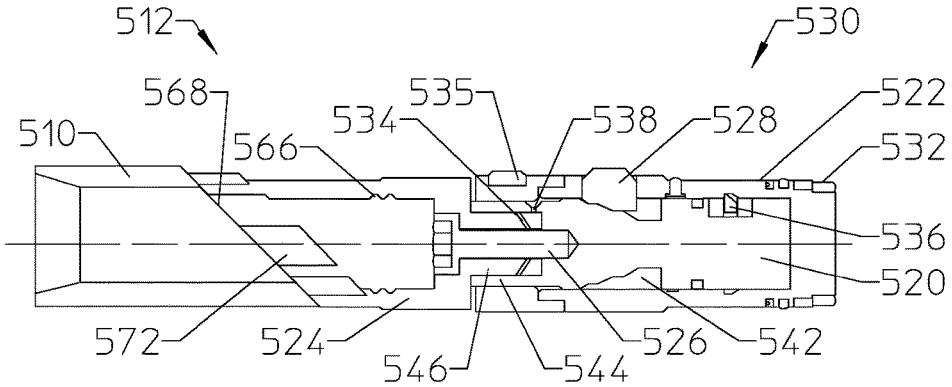
FIG. 23 is a cross-sectional view of the tree component being landed and aligned with the tubing hanger via the plug assembly of FIGS. 19-22, in accordance with an embodiment of the present disclosure.

Once the plug assembly 512 is locked, the BOP may be removed from the wellhead 12. The orientation sleeve 524 may be adjusted relative to the rest of the plug 512, as shown in FIG. 21. An adjustment tool 576, which may or may not be the same as the running tool described above, is positioned within the bore of the orientation sleeve 524 and connected to the orientation sleeve 524 via the running/adjustment grooves 566. As the adjustment tool 576 rotates the orientation sleeve 524 relative to the rest of the plug, the tapered gear/spline 534 guides this rotation to take place in small increments, which can be tracked by an outside tool. Whatever adjustment has been made to place the orientation sleeve 524 in a desired orientation relative to the wellhead, the same rotational adjustment may then be made on the tree 18 (e.g., between the alignment sleeve 510 and other portions of the tree 18). This adjustment of the tree 18 will enable direct connections between the tree couplings 518 and the tubing hanger couplings 32 to be made.

The tree 18 (illustrated just as the alignment sleeve 510 in FIGS. 22 and 23) may then be landed onto the wellhead 12. The alignment of the tree 18 relative to the tubing hanger 14 is guided by the orientation profile 568 on the orientation sleeve 524 interfacing with the complementary profile 572 on the alignment sleeve 510. Once the slots and corresponding legs of these profiles 568 and 572 are matched up, further lowering of the tree 18 onto the wellhead 12 will cause the alignment sleeve 510 to lower vertically through the elongated slots in the orientation sleeve 524, thereby providing a controlled descent of the tree couplings 518 onto the appropriate tubing hanger couplings 32. The tree 18 at this point is landed and the connections between the tree 18 and the tubing hanger 14 are made up.

After the tree is landed, the plug assembly 512 may be removed. The plug assembly 512 may be reusable in different wellheads once it is removed. To remove the plug assembly 512, a retrieval tool may be coupled to the orientation sleeve 524 and used to pull the plug upward. This upward force may cause the spring-loaded shear pin 536 to shear, thereby releasing the inner body 520 from its axial position within the outer body 522. The inner body 520 may be lifted up within the outer body 522, causing the sloped surface 550 to move out of the outwardly biasing contact with the locking mechanism 528. The locking mechanism 528 may collapse into the recess in the outer body 522, freeing the plug 512 to be extracted from the bore of the tubing hanger 14.

One or more aspects of the present disclosure provide a system including a subsea equipment alignment device for coupling a first subsea tubular member to a second subsea tubular member. The subsea equipment alignment device includes one or more fluid, electric, or fiber optic lines extending therethrough and one or more couplings disposed on at least one end thereof, and the subsea equipment alignment device is configured to couple one or more fluid, electric, or fiber optic lines of the first subsea tubular member with one or more fluid, electric, or fiber optic couplings of the second subsea tubular member regardless of a relative orientation of the first subsea tubular member and the second subsea tubular member with respect to each other.

In one or more aspects, the subsea equipment alignment device is configured to couple the one or more fluid, electric, or fiber optic lines of the second subsea tubular member with the one or more fluid, electric, or fiber optic couplings on the first subsea tubular member disposed in a wellhead during landing of the second subsea tubular member onto the wellhead regardless of a relative orientation of the first subsea tubular member and the second subsea tubular member with respect to the wellhead.

In one or more aspects, the subsea equipment alignment device includes: a production stab sub, an alignment sub disposed around and rotatably coupled to the production stab sub, one or more conduits wrapped around the production stab sub, and an outer timing ring disposed around and coupled to the alignment sub. One or more fluid, electric, or fiber optic lines of the subsea equipment alignment device extend through the alignment sub to the one or more couplings of the subsea equipment alignment device at an end of the alignment sub. The one or more conduits are coupled to the one or more fluid, electric, or fiber optic lines of the alignment sub at one end and configured to be coupled to the one or more fluid, electric, or fiber optic lines of the second subsea tubular member at an opposite end. The outer timing ring includes one or more keyed features configured to interface with complementary features on the first subsea tubular member.

In one or more aspects, the alignment sub includes multiple alignment threads formed therein, and wherein the outer timing ring includes multiple pins extending therefrom that interface with the alignment threads.

In one or more aspects, the system further includes multiple vertical alignment slots formed in the alignment sub and extending from ends of the multiple alignment threads.

In one or more aspects, the system further includes an actuation mechanism disposed on the alignment sub and configured to selectively release the production stab sub to move axially with respect to the alignment sub.

In one or more aspects, the actuation mechanism includes one or more buttons extending through the alignment sub and a split ring coupled between the alignment sub and the production stab sub, wherein a radially inward force on the one or more buttons from the outer timing ring collapses the split ring.

In one or more aspects, the production stab sub includes one or more seals located at a distal end thereof.

In one or more aspects, the subsea equipment alignment device includes an alignment body configured to be rotatably coupled to the second subsea tubular member, a timing ring coupled to the alignment body, and a timing hub configured to be mounted to the first subsea tubular member. The alignment body is configured to define an electrical gallery and a fluid gallery in an annular space between the second subsea tubular member and the alignment body. The timing ring includes keyed features extending therefrom. The timing hub includes complementary features that receive the keyed features of the timing ring therein when the timing ring is in a specific orientation.

In one or more aspects, the alignment body includes a helical groove formed in an external surface thereof and the timing ring is coupled to the alignment body via a pin extending from the timing ring into the helical groove.

In one or more aspects, the alignment body further includes: a vertical alignment slot which extends from a first end of the helical groove; and a final alignment pin disposed at a second end of the alignment body.

In one or more aspects, the subsea equipment alignment device includes: a first body configured to be coupled to the second subsea tubular member; a second body coupled to the first body; a torsional spring disposed in the second annular space between the first and second bodies; and a trigger assembly. First and second annular spaces are formed between the first body and the second body, the first annular space defining an electrical gallery and a fluid gallery, and the one or more couplings of the subsea equipment alignment device are disposed on the second body. The trigger assembly is configured to selectively trigger the torsional spring to rotate the second body relative to the first body until the one or more couplings on the second body are aligned with the one or more couplings on the first subsea tubular member.

In one or more aspects, the trigger assembly includes a first button extending radially outward from the second body, a second button extending radially outward from the first body into the second body immediately adjacent the first button, and a third button biased in a radially outward direction and disposed within the second body. The third button is configured to be received into an alignment slot on the first subsea tubular member to stop rotation of the second body in a desired orientation.

One or more aspects of the present disclosure provide a system for coupling a first subsea tubular member to a second subsea tubular member. The system includes: a rotating sub rotatably coupled to a portion of the first subsea tubular member; one or more fluid, electric, or fiber optic lines extending through the rotating sub and terminating at one or more couplings disposed at an end of the rotating sub; an orientation profile disposed on a surface of the rotating sub; and a corresponding alignment member with a profile designed to interface with the orientation profile of the rotating sub, wherein the alignment member remains stationary while the rotating sub rotates relative to the alignment member.

In one or more aspects, the first subsea tubular member includes one of a tree body, a spool, or a flowline connection body, and wherein the second subsea tubular member includes a tubing hanger.

In one or more aspects, the orientation profile of the rotating sub includes a key and the alignment member includes a helical profile, wherein the key is a generally rectangular shaped member having at least one tapered surface at one end thereof.

In one or more aspects, the orientation profile of the rotating sub includes a helical profile and the alignment member includes a key and wherein the key is a generally rectangular shaped member having at least one tapered surface at one end thereof.

In one or more aspects, the orientation profile of the rotating sub and the profile of the alignment member are both helically shaped.

In one or more aspects, the alignment member is disposed on an orientation sub that is mounted to the second subsea tubular member.

In one or more aspects, the alignment member is integral with the second subsea tubular member.

One or more aspects of the present disclosure provide a system for coupling a first subsea tubular member with a second subsea tubular member. The system includes at least one alignment member including a profile formed on a surface of the first subsea tubular member; a rotating sub; and an orientation profile disposed on a surface of the rotating sub. The orientation profile is designed to interface with the profile of the alignment member, wherein the alignment member remains stationary while the rotating sub rotates relative to the alignment member.

In one or more aspects, the first subsea tubular member includes a tubing hanger and the second subsea tubular member includes one of a tree body, a spool, or a flowline connection body.

In one or more aspects, the orientation profile of the rotating sub includes a key and the alignment member includes a helical groove, wherein the key is a generally rectangular shaped member having at least one tapered surface at one end thereof.

In one or more aspects, the orientation profile of the rotating sub includes a helical groove and the alignment member includes a key, wherein the key is a generally rectangular shaped member having at least one tapered surface at one end thereof.

In one or more aspects, the orientation profile of the rotating sub and the profile of the alignment member are both helically shaped.

In one or more aspects, the system further includes a production stab sub mounted to the second subsea tubular member, wherein the rotating sub is rotatably coupled to the production stab sub.

In one or more aspects, the system further includes a generally cylindrical body integral with a body of the second subsea tubular member, wherein the rotating sub is rotatably coupled to the generally cylindrical body.

In one or more aspects, the system further includes a generally cylindrical body extending from a body of the second subsea tubular member, wherein the rotating sub is disposed around and rotatably coupled to the generally cylindrical body.

In one or more aspects, the system further includes one or more conduits wrapped around the generally cylindrical body and coupled to one or more fluid, electric, or fiber optic lines of the second subsea tubular member at one end and to the one or more fluid, electric, or fiber optic lines of the rotating sub at an opposite end.

One or more aspects of the present disclosure provide a system for coupling subsea tubular members. The system includes an alignment sub and a corresponding alignment member. The alignment sub includes a generally cylindrical body having one or more fluid, electric, or fiber optic lines extending therethrough, one or more couplings coupled to at least one end of the alignment sub, and a helically shaped orientation profile disposed on a surface of the alignment sub. The alignment member has a helically shaped profile designed to interface with the orientation profile of the alignment sub. One of the alignment sub and the alignment member remains stationary while the other rotates relative to the stationary structure.

In one or more aspects, the alignment sub rotates while the alignment member remains stationary.

In one or more aspects, the alignment sub is rotatably coupled to a surface of one of the subsea tubular members.

In one or more aspects, the alignment member includes an orientation sub coupled to a surface of one the subsea tubular members.

In one or more aspects, the alignment member is integral with one of the subsea tubular members.

In one or more aspects, the orientation profile of the alignment sub includes at least one helical groove and the profile of the alignment member includes at least one helical protrusion.

In one or more aspects, the orientation profile of the alignment sub includes at least one helical protrusion and the profile of the alignment member includes at least one helical groove.

Although the present disclosure and its advantages have been described in detail, it should be understood that various changes, substitutions and alterations can be made herein without departing from the spirit and scope of the disclosure as defined by the following claims.

What is claimed is:

1. An apparatus for coupling subsea tubular members, comprising:

(a) an alignment sub adapted to be coupled to a stab, the alignment sub comprising:

(i) a generally cylindrical body having one or more fluid, electric, or fiber optic lines extending therethrough, wherein the generally cylindrical body is adapted to be connected to the stab via an interface that enables rotation of the alignment sub relative to the stab while the stab is moved in a direction of a longitudinal axis of the stab, (ii) one or more couplings coupled to at least one end of the alignment sub, and (iii) an orientation profile disposed on a surface of the alignment sub; and (b) a corresponding alignment member having a profile designed to interface with the orientation profile of the alignment sub, the alignment member remaining stationary while the alignment sub rotates relative to the alignment member.

2. The apparatus of claim 1, wherein the orientation profile is disposed on an outside surface of the alignment sub.

3. The apparatus of claim 1, wherein the orientation profile is disposed on an inside surface of the alignment sub.

4. The apparatus of claim 1, wherein the orientation profile comprises a helical recess.

5. The apparatus of claim 1, wherein the orientation profile comprises a helical protrusion.

6. The apparatus of claim 1, wherein the alignment member comprises a key and the orientation profile comprises a helical groove, wherein the key is a generally rectangular shaped member having at least one tapered surface at one end thereof.

7. The apparatus of claim 1, wherein the orientation profile of the alignment sub comprises a key and the profile of the alignment member comprises a helical groove, wherein the key is a generally rectangular shaped member having at least one tapered surface at one end thereof.

8. The apparatus of claim 1, wherein at least a portion of the orientation profile of the alignment sub and at least a portion of the profile of the alignment member are both helically shaped.

9. The apparatus of claim 8, wherein the orientation profile of the alignment sub comprises a helical groove and the profile of the alignment member comprises a helical protrusion.

10. The apparatus of claim 8, wherein the orientation profile of the alignment sub comprises a helical protrusion and the profile of the alignment member comprises a helical groove.

11. The apparatus of claim 8, wherein the orientation profile of the alignment sub and the profile of the alignment member both comprise at least one vertically oriented portion at an axial end thereof.

12. The apparatus of claim 11, wherein the at least one vertically oriented portion comprises a tapered shape at one end.

13. A system, comprising:

a subsea equipment alignment device for coupling a first subsea tubular member to a second subsea tubular member;

wherein the subsea equipment alignment device comprises one or more fluid, electric, or fiber optic lines extending therethrough and one or more couplings disposed on at least one end thereof;

wherein at least part of the subsea equipment alignment device is adapted to be connected to a stab via an interface that enables rotation of the at least part of the subsea equipment alignment device relative to the stab while the stab is moved in a direction of a longitudinal axis of the stab; and wherein the subsea equipment alignment device is configured to couple one or more fluid, electric, or fiber optic lines of the first subsea tubular member with one or more fluid, electric, or fiber optic couplings of the second subsea tubular member regardless of a relative orientation of the first subsea tubular member and the second subsea tubular member with respect to each other.

14. The system of claim 13, wherein the first subsea tubular member comprises a tubing hanger.

15. The system of claim 14, wherein the second subsea tubular member comprises one of a tree body, a spool, or a flowline connection body.

16. The system of claim 13, further comprising the first subsea tubular member coupled to the subsea equipment alignment device.

17. The system of claim 13, further comprising the second subsea tubular member coupled to the subsea equipment alignment device.

18. The system of claim 13, wherein the subsea equipment alignment device is self-aligning between the first subsea tubular member and the second subsea tubular member.

19. The system of claim 13, wherein the subsea equipment alignment device comprises:

the stab;

a rotating sub disposed around and rotatably coupled to the stab, wherein the one or more fluid, electric, or fiber optic lines of the subsea equipment alignment device extend through the rotating sub to the one or more couplings of the subsea equipment alignment device at an end of the rotating sub; and one or more conduits wrapped around the stab, wherein the one or more conduits are coupled to the one or more fluid, electric, or fiber optic lines of the rotating sub at one end and configured to be coupled to the one or more fluid, electric, or fiber optic lines of the second subsea tubular member at an opposite end.

20. The system of claim 19, wherein the stab is configured to be coupled to the second subsea tubular member.

21. The system of claim 19, wherein the subsea equipment alignment device further comprises an alignment key which is configured to interface with a radially inward facing orientation profile to align the one or more couplings of the rotating sub with the one or more couplings on the first subsea tubular member.

22. The system of claim 21, wherein the subsea equipment alignment device further comprises an orientation sub having the orientation profile disposed on an inner cylindrical surface thereof, wherein the orientation sub is configured to be coupled to the first subsea tubular member.

23. The system of claim 19, wherein the rotating sub comprises an orientation profile disposed on an outer cylindrical surface of the rotating sub, wherein the orientation profile is configured to interface with a radially inward facing alignment key to align the one or more couplings of the rotating sub with the one or more couplings on the first subsea tubular member.

24. The system of claim 23, wherein the subsea equipment alignment device further comprises the alignment key configured to be disposed on an inner cylindrical surface of the first subsea tubular member.

25. A system for coupling a first subsea tubular member to a second subsea tubular member, comprising:

a rotating sub rotatably coupled to a stab of the first subsea tubular member, the rotating sub being adapted to rotate relative to the stab while at least the stab is being moved in a direction of a longitudinal axis of the stab;

one or more fluid, electric, or fiber optic lines extending through the rotating sub and terminating at one or more couplings disposed at an end of the rotating sub;

an orientation profile disposed on a surface of the rotating sub; and a corresponding alignment member with a profile designed to interface with the orientation profile of the rotating sub, wherein the alignment member remains stationary while the rotating sub rotates relative to the alignment member.

26. The system of claim 25, wherein the stab is coupled to a body of the first subsea tubular member, wherein the rotating sub is disposed around and rotatably coupled to the stab of the first subsea tubular member.

27. The system of claim 26, further comprising conduits wrapped around the stab of the first subsea tubular member and coupled to one or more fluid, electric, or fiber optic lines of the first subsea tubular member at one end and to the one or more fluid, electric, or fiber optic lines of the rotating sub at an opposite end.

28. A system for coupling a first subsea tubular member with a second subsea tubular member, comprising:

at least one alignment member comprising a profile formed on a surface of the first subsea tubular member;

a rotating sub adapted to be connected to a stab via an interface that enables rotation of the rotating sub relative to the stab while the stab is moved in a direction of a longitudinal axis of the stab; and an orientation profile disposed on a surface of the rotating sub, the orientation profile being designed to interface with the profile of the alignment member, wherein the alignment member remains stationary while the rotating sub rotates relative to the alignment member.

29. The system of claim 28, wherein the profile of the alignment member is located on a radially inside surface of the first subsea tubular member.

30. The system of claim 28, further comprising the stab, wherein the stab is a production stab sub mounted to the second subsea tubular member.

* * * * *